US012723215B2

(12) United States Patent
Labb et al.

(10) Patent No.: US 12,723,215 B2
(45) Date of Patent: Sep. 1, 2026

(54) LUBRICANT COMPOSITIONS PROVIDING ROBUST VALVETRAIN WEAR PROTECTION IN THE FORD 6.7L ENGINE TEST

(71) Applicant: Infineum International Limited, Linden, NJ (US)

(72) Inventors: Alec C. Labb, Hoboken, NJ (US); Nancy Z. Diggs, Phoenix, AZ (US); Jun Cui, Berkeley Heights, NJ (US); Xiaobo Shen, Laurence Harbor, NJ (US)

(73) Assignee: Infineum International Limited, Linden, NJ (US)

( * ) Notice: Subject to any disclaimer, the term of this patent is extended or adjusted under 35 U.S.C. 154(b) by 0 days.

(21) Appl. No.: 18/944,570

(22) Filed: Nov. 12, 2024

(65) Prior Publication Data

US 2025/0207054 A1 Jun. 26, 2025

Related U.S. Application Data

(60) Provisional application No. 63/613,864, filed on Dec. 22, 2023.

(51) Int. Cl.

| | |
|---|---|
| ***C10M 149/22*** | (2006.01) |
| ***C10M 101/02*** | (2006.01) |
| ***C10M 129/54*** | (2006.01) |
| ***C10M 171/02*** | (2006.01) |
| *C10N 30/04* | (2006.01) |
| *C10N 30/06* | (2006.01) |
| *C10N 40/25* | (2006.01) |

(52) U.S. Cl.

CPC ..... *C10M 149/22* (2013.01); *C10M 101/02* (2013.01); *C10M 129/54* (2013.01); *C10M 171/02* (2013.01); *C10M 2207/124* (2013.01); *C10M 2217/06* (2013.01); *C10N 2030/04* (2013.01); *C10N 2030/06* (2013.01); *C10N 2040/252* (2020.05); *C10N 2040/255* (2020.05)

(58) Field of Classification Search

CPC ..... C10N 2030/06; C10N 2030/08; C10N 2040/26; C10N 2010/12; C10N 2010/04; C10N 2060/14; C10N 2030/02; C10N 2030/45; C10N 2070/02; C10N 2030/04; C10N 2030/42; C10N 2040/252; C10N 2030/52; C10N 2040/255; C10N 2020/02; C10L 1/224; C10L 2270/02; C10M 129/54; C10M 163/00; C10M 149/22; C10M 2207/282; C10M 2203/1025; C10M 2209/104; C10M 2219/044; C10M 2229/041; C10M 2219/046; C10M 2203/024; C10M 2209/108; C10M 2223/045; C10M 2219/068; C10M 101/02; C10M 171/02; C10M 2215/064; C10M 2207/262; C10M 2205/06; C10M 2203/1006; C10M 2209/062; C10M 2219/024; C10M 2217/06; C10M 2207/124; C10M 2215/28; C10M 2207/144; C10M 2209/086; C10M 2205/02

See application file for complete search history.

(56) References Cited

U.S. PATENT DOCUMENTS

| | | | | |
|---|---|---|---|---|
| 4,863,623 | A | 9/1989 | Nalesnik | |
| 5,084,197 | A * | 1/1992 | Galic | C10M 137/10 516/146 |
| 6,107,257 | A | 8/2000 | Valcho et al. | |
| 6,107,258 | A | 8/2000 | Esche, Jr. et al. | |
| 6,117,825 | A | 9/2000 | Liu et al. | |
| 2016/0326453 | A1* | 11/2016 | Galic Raguz | C10M 167/00 |
| 2019/0127655 | A1 | 5/2019 | Dance et al. | |
| 2020/0032158 | A1* | 1/2020 | Smith | C10M 133/16 |
| 2024/0141156 | A1 | 5/2024 | Haidaaz et al. | |
| 2025/0101336 | A1 | 3/2025 | Marsh et al. | |

FOREIGN PATENT DOCUMENTS

| | | | |
|---|---|---|---|
| WO | 2006/015130 | A1 | 2/2006 |
| WO | 2015/042337 | A1 | 3/2015 |
| WO | 2015/042340 | A1 | 3/2015 |
| WO | 2015/042341 | A1 | 3/2015 |
| WO | 2016/148708 | A1 | 9/2016 |
| WO | 2016/154167 | A1 | 9/2016 |
| WO | 2019/108588 | A1 | 6/2019 |
| WO | 2021/061808 | A1 | 4/2021 |
| WO | 2021/061986 | A1 | 4/2021 |
| WO | 2021/158757 | A1 | 8/2021 |
| WO | 2022/066721 | A1 | 3/2022 |
| WO | 2024/158648 | A1 | 8/2024 |
| WO | 2025/024623 | A1 | 1/2025 |

OTHER PUBLICATIONS

EP Form 1507W for related EP Application No. 24220929.4 dated Mar. 28, 2025.

* cited by examiner

*Primary Examiner* — Vishal V Vasisth
(74) *Attorney, Agent, or Firm* — Robert A. Migliorini; Catherine L. Bell

(57) ABSTRACT

This invention relates to lubricating oil compositions containing less than 1000 ppm phosphorus, comprising or resulting from the admixing of A) one or more base oil(s), B) one or more dispersant(s), wherein said one or more dispersants comprise at least 2.0 mass %, based on the total mass of the lubricating oil composition, of one or more unborated poly(alkenyl)succinimides, in which the polyalkenyl is derived from polyisobutylene and the imide is derived from polyamine ("PIBSA-PAM"); and C) one or more detergent(s), wherein said one or more detergent(s) together provide soap to the lubricating oil composition in an amount of 0.1 to 0.9 mass %, based on the total mass of the lubricating oil composition; wherein the ratio of mass %, based on the total mass of the lubricating oil composition, of the one or more unborated PIBSA-PAM(s) to soap of the lubricating oil composition is 6.65 or more.

31 Claims, No Drawings

LUBRICANT COMPOSITIONS PROVIDING ROBUST VALVETRAIN WEAR PROTECTION IN THE FORD 6.7L ENGINE TEST

PRIORITY

This application claims priority and the benefit of U.S. Ser. No. 63/613,864, filed Dec. 22, 2023 in the United States Patent and Trademark Office.

FIELD OF THE INVENTION

This disclosure relates to the use of a specific ratio of unborated PIBSA-PAM to soap in lubricant compositions having good anti-wear properties, especially for heavy-duty diesel engine applications.

BACKGROUND OF THE INVENTION

The present invention relates to lubricating oil compositions, such as heavy-duty diesel engine oils, which exhibit improved anti-wear characteristics, even at phosphorus levels below 1000 ppm. More specifically, the present invention relates to automotive crankcase lubricating oil compositions for use in natural gas engines, hydrogen engines ($H_2$ICE), gasoline (spark-ignited) and diesel (compression-ignited) internal combustion engines, such compositions being referred to as crankcase lubricants; and to the use of a certain ratio of PIBSA-PAM to soap in such lubricating oil compositions for reducing friction and/or wear between moving parts of such engines and/or improving the fuel economy performance of an engine lubricated with the lubricating oil composition.

Engine durability is an important consideration in the choice of a lubricant, especially for heavy duty diesel (HDD) engine applications. Original equipment manufacturers are continuing to increase their oil drain intervals and the average lifetime of vehicles has steadily increased over the last few decades. Likewise, there is a trend towards use of ashless anti-wear agents which have a lower impact on after treatment systems such as diesel particulate filters in heavy duty diesel vehicles.

Environmental and regulatory requirements are driving a desire to improve the efficiency of the internal combustion engine. Lower viscosity lubricants require less energy to pump around an engine and thus can improve its fuel economy. However, lower viscosity lubricants result in thinner oil films between contacting engine parts (e.g., in the valve train, piston zone and in bearings), which can lead to higher rates of wear, reduced friction modification, etc. Conventionally, zinc dialkyl dithiophosphates (ZDDPs) are often used as lubricant additives to prevent engine wear and or reduce friction in the boundary lubrication regimes.

Alongside the drive for improved fuel economy, there is also a desire to reduce the emissions from vehicles. Control of exhaust emissions is typically achieved by after-treatment devices, such as catalytic convertors, which generally employ precious metal catalysts to convert combustion products into less undesirable species. However, these catalysts are poisoned by, inter alia, phosphorous and sulfur, which impacts their catalytic activity. Another after-treatment device is the particulate filter, which can be blocked by sulfated ash or sludge generated from combustion of heavy-duty diesel oils. Hence, the levels of sulfated ash, phosphorous, and sulfur (SAPS) derived from heavy-duty diesel oils are desirably reduced. ZDDP additives contribute significant quantities of SAPS to a lubricating oil, so that the use of ZDDP is also desirably reduced.

In December of 2016, the American Petroleum Institute (API) released the latest heavy duty diesel performance categories: CK-4 and FA-4. Further, 800 ppm phosphorus oils gained increasing share of the market. Shortly after the implementation, Ford Motor Company became disinclined the use of CK-4 and FA-4 oils having 800 ppm or less of phosphorus, due to concerns that said phosphorus levels would be too low to protect its diesel engines from valvetrain wear. In this context, Ford developed the Ford 6.7 L Power Stroke Diesel Engine Test for soot induced wear and viscosity control, which evaluates the anti-wear performance of heavy duty diesel oils based on visual inspections of valvetrain parts The pass criteria for said Ford 6.7 L Test are:

Single test: <100 mg average rocker arm mass loss

Multiple tests: <115 mg average rocker arm mass loss.

Oils not meeting these targets are not subject to approval.

During engine operation, oil-insoluble oxidation byproducts, such as soot, are produced. Dispersants help keep these byproducts suspended or in solution, thus diminishing their deposition on metal surfaces. Common dispersants include (poly)alkenylsuccinic derivatives, such as hydrocarbyl-substituted succinic anhydrides, such as polyisobutylene succinic anhydride (PIBSA) and hydrocarbyl-substituted succinimides, such as polyisobutylene succinimides (PIBSA-PAM), such as those derived from reaction of maleated polyisobutylene with N-phenyl-p-phenylenediamine.

U.S. patent application Ser. No. 18/480,571 filed Oct. 4, 2023 claiming priority to U.S. Ser. No. 63/379,006, filed Oct. 11, 2022 discloses the use of amide, imide, and/or ester functionalized polymers comprising specific $C_{4-5}$ olefins as additives in lubricating oil compositions to reduce wear. U.S. Patent Application Ser. No. 63/584,675, filed Sep. 22, 2023, further discloses lubricant compositions comprising functionalized polymers comprising a specific olefin homopolymer or copolymer backbone while traditional polyalkenylsuccinimide dispersant(s), in which the polyalkenyl is derived from polyisobutylene and the imide is derived from polyamine (PIBSA-PAMs), are reduced or completely absent.

There remains a need to provide further or improved engine/transmission oil compositions that provide excellent anti-wear properties and fuel economy while also keeping the phosphorus levels of the lubricating oil composition below 1000 ppm. In particular, there remains a need to provide engine/transmission oil compositions that pass stringent wear tests, such as the Ford 6.7 L Power Stroke Diesel Engine Test for soot induced wear and viscosity control, while meeting the latest standards of performance categories.

It has surprisingly been found by the present inventors that using a specific ratio of unborated PIBSA-PAM dispersant(s) to soap in a lubricant composition, such as a heavy-duty diesel oil, significantly improves the anti-wear properties, thus providing improved durability. Further, it has surprisingly been found that using said specific ratio of unborated PIBSA-PAM dispersant(s) to soap in a lubricant composition facilitates passing the Ford 6.7 L Power Stroke Diesel Engine Test for soot induced wear and viscosity control even at phosphorus levels of less than 1000 ppm, such as 800 ppm.

SUMMARY OF THE INVENTION

This invention relates to a lubricating oil composition containing less than 1000 ppm phosphorus (as determined by ASTM D5185) comprising:

A) at least 50 mass % of one or more base oil(s), based on the total mass of the lubricating oil composition;

B) one or more dispersant(s), wherein said one or more dispersant(s) comprise 2.0 to 6.00 mass %, based on the total mass of the lubricating oil composition, of one or more poly(alkenyl) succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and C) one or more detergent(s), wherein said one or more detergent(s) together provide soap to the lubricating oil composition in an amount of 0.1 to 0.9 mass %, based on the total mass of the lubricating oil composition;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

This invention further relates to a lubricating oil composition containing less than 1000 ppm phosphorus (as determined by ASTM D5185) comprising:

A) at least 50 mass % of one or more base oil(s), based on the total mass of the lubricating oil composition;

B) one or more dispersant(s), wherein said one or more dispersant(s) comprise 2 to 10 mass %, based on the total mass of the lubricating oil composition, of one or more poly(alkenyl)succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and C) one or more detergent(s), wherein said one or more detergent(s) together provide soap to the lubricating oil composition in an amount of 0.1 to 0.9 mass %, based on the total mass of the lubricating oil composition;

wherein said one or more detergent(s) comprise 50 mass % or less, based on the total mass of detergent(s) present in the lubricating oil composition, of calcium salicylate;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

Preferably, the ratio of mass %, based on the total mass of the lubricating oil composition, of the one or more unborated PIBSA-PAM(s) to soap of the lubricating oil composition is from 7.0 to 15.0, such as from 7.2 to 13.0, such as from 7.4 to 11.0, such as from 7.6 to 10.0, such as from 7.8 to 9.0, such as from 8.0 to 8.5.

This invention further relates to a lubricating oil composition containing less than 1000 ppm phosphorus (as determined by ASTM D5185) comprising:

A) at least 50 mass % of one or more base oil(s), based on the total mass of the lubricating oil composition;

B) one or more dispersant(s), wherein said one or more dispersant(s) comprise 2 to 10 mass %, based on the total mass of the lubricating oil composition, of one or more poly(alkenyl)succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and C) one or more detergent(s), wherein said one or more detergent(s) together provide soap to the lubricating oil composition in an amount of 0.1 to 0.9 mass %, based on the total mass of the lubricating oil composition; and P) an amide, imide, and/or ester functionalized polymer comprising a partially or fully saturated polymer backbone comprising $C_{4-5}$ olefins having:

i) an Mw/Mn of less than 2, ii) a Functionality Distribution (Fd) value of 3.5 or less, and iii) an Mn of 10,000 g/mol or more (GPC-PS) of the polymer prior to functionalization;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

According to another aspect, the present invention provides a concentrate comprising or resulting from the admixing of A) 1 to less than 50 mass % of one or more base oils, based on the total mass of the concentrate;

B) one or more dispersant(s), wherein said one or more dispersants comprise one or more unborated poly(alkenyl)succinimides, in which the polyalkenyl is derived from polyisobutylene and the imide is derived from polyamine ("PIBSA-PAM"); and C) one or more detergent(s), wherein said one or more detergents provide soap to the concentrate;

wherein said one or more detergents comprise 50 mass % or less, based on the total mass of detergent(s) present in the concentrate, of calcium salicylate;

wherein: i) the ratio of mass %, based on the total mass of the concentrate, of the one or more unborated PIBSA-PAM(s) to soap of the concentrate is 6.65 or more.

Preferably, the ratio of mass %, based on the total mass of the concentrate, of the one or more unborated PIBSA-PAM(s) to soap of the concentrate is from 7.0 to 15.0, such as from 7.2 to 13.0, such as from 7.4 to 11.0, such as from 7.6 to 10.0, such as from 7.8 to 9.0, such as from 8.0 to 8.5.

According to yet a further aspect, the present invention provides a lubricating oil composition comprising or resulting from the admixing of the concentrate as disclosed herein with one or more base oils.

According to yet a further aspect, the present invention provides a method of lubricating an internal combustion engine during operation of the engine comprising:

(i) providing to a crankcase of the internal combustion engine the lubricating composition as described herein;

(ii) providing a fuel in the internal combustion engine; and (iii) combusting the fuel in the internal combustion engine.

According to yet a further aspect, the present invention provides a method of increasing the anti-wear capability of a lubricating oil composition containing less than 1000 ppm phosphorus (as determined by ASTM D5185), the method comprising including in the lubricating oil composition:

i) at least 50 mass % of one or more base oils, based on the total mass of the lubricating oil composition;

ii) one or more dispersants, wherein said one or more dispersants comprise 2.0 to 6.00 mass %, based on the total mass of the lubricating oil composition, of one or more poly(alkenyl) succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and iii) one or more detergents, wherein said one or more detergents together provide soap to the lubricating oil composition in an amount of 0.1 to 0.9 mass %, based on the total mass of the lubricating oil composition;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

According to yet a further aspect, the present invention provides a method of increasing the anti-wear capability of a lubricating oil composition containing less than 1000 ppm phosphorus (as determined by ASTM D5185), the method comprising including in the lubricating oil composition:

i) at least 50 mass % of one or more base oils, based on the total mass of the lubricating oil composition;

ii) one or more dispersants, wherein said one or more dispersants comprise 2 to 10 mass %, based on the total mass of the lubricating oil composition, of one or more poly(alkenyl)succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and iii) one or more detergents, wherein said one or more detergents together provide soap to the lubricating oil composition in an amount of 0.1 to 0.9 mass %, based on the total mass of the lubricating oil composition;

wherein said one or more detergent(s) comprise 50 mass % or less, based on the total mass of detergent(s) present in the lubricating oil composition, of calcium salicylate;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

Preferably, the anti-wear capability is increased such that the valve train rocker arm wear is less than 120 mg, such as less than 110 mg, such as less than 100 mg, such as less than 90 mg, such as less than 80 mg, such as less than 70 mg, such as less than 60 mg, such as less than 50 mg, such as less than 40 mg, as determined by the Ford 6.7 L Valve-Train Wear (VTW) test.

According to yet a further aspect, the present invention provides a method of making a lubricating oil composition containing less than 1000 ppm phosphorus (as determined by ASTM D5185), the method comprising combining:

i) at least 50 mass % of one or more base oils, based on the total mass of the lubricating oil composition;

ii) one or more dispersants, wherein said one or more dispersants comprise 2.0 to 6.00 mass %, based on the total mass of the lubricating oil composition, of one or more poly(alkenyl) succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and iii) one or more detergents, wherein said one or more detergents together provide soap to the lubricating oil composition in an amount of 0.1 to 0.9 mass %, based on the total mass of the lubricating oil composition;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

According to yet a further aspect, the present invention provides a method of making a lubricating oil composition containing less than 1000 ppm phosphorus (as determined by ASTM D5185), the method comprising combining:

i) at least 50 mass % of one or more base oils, based on the total mass of the lubricating oil composition;

ii) one or more dispersants, wherein said one or more dispersants comprise 2 to 10 mass %, based on the total mass of the lubricating oil composition, of one or more poly(alkenyl)succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and iii) one or more detergents, wherein said one or more detergents together provide soap to the lubricating oil composition in an amount of 0.1 to 0.9 mass %, based on the total mass of the lubricating oil composition;

wherein said one or more detergent(s) comprise 50 mass % or less, based on the total mass of detergent(s) present in the lubricating oil composition, of calcium salicylate;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

According to yet a further aspect of the present disclosure, there is provided the use of the lubricating oil composition as described herein, where the lubricating oil composition has a valve train rocker arm wear of less than 120 mg, such as less than 110 mg, such as less than 100 mg, such as less than 90 mg, such as less than 80 mg, such as less than 70 mg, such as less than 60 mg, such as less than 50 mg, such as less than 40 mg (as determined by Ford 6.7 L Power Stroke Diesel Engine Test for soot induced wear and viscosity control).

Definitions

For purposes of this specification and all claims to this invention, the following words and expressions, if and when used, have the meanings ascribed below.

For purposes herein, the new numbering scheme for the Periodic Table of the Elements is used as set out in CHEMICAL AND ENGINEERING NEWS, 63(5), 27 (1985), i.e., Alkali metals are group 1 metals (e.g., Li, Na, K, etc.) and Alkaline earth metals are group 2 metals (e.g., Mg, Ca, Ba, etc.).

The term "comprising" or any cognate word specifies the presence of stated features, steps, or integers or components, but does not preclude the presence or addition of one or more other features, steps, integers, components or groups thereof. The expressions "consists of" or "consists essentially of" or cognates may be embraced within "comprises" or cognates, wherein "consists essentially of" permits inclusion of substances not materially affecting the characteristics of the composition to which it applies.

The term "absent" (or "free of") as it relates to components or active ingredients included within the lubricating oil compositions described herein and the claims thereto means that the particular component or active ingredient is present at 0.000 wt %, based upon the weight of the lubricating oil composition, or if "substantially absent," the component or active ingredient is present at levels that do not impact the lubricating oil composition properties, such as at less than 100 ppm, such as less than 10 ppm, less than 1 ppm, or less than 0.001 ppm.

The term "about" means approximately, which includes values obtain by rounding. As used herein, the term "about" modifying the quantity of an ingredient, component, or reactant of the invention employed refers to variation in the numerical quantity that can occur, for example, through typical measuring and liquid handling procedures used for making concentrates or lubricating oil compositions. Furthermore, variation can occur from inadvertent error in measuring procedures, differences in the manufacture, source, or purity of the ingredients employed to make the compositions or carry out the methods, and the like. In one aspect, the term "about" means within 10% of the reported numerical value. In another aspect, the term "about" means within 5% of the reported numerical value. Yet, in another aspect, the term "about" means within 10, 9, 8, 7, 6, 5, 4, 3, 2, or 1% of the reported numerical value.

The term "LOC" means lubricating oil composition (which term is interchangeably used herein with the term "lubricant oil composition", or "lubricating composition", or "lubricant composition").

The term "major amount" means more than 50 mass % of a composition, such as more than 60 mass % of a composition, such as more than 70 mass % of a composition, such as from 80 to 99.009 mass % of a composition, such as from 80 to 99.9 from 80 to 99.009 mass % of a composition, of a composition based upon the mass of the composition.

The term "minor amount" means 50 mass % or less of a composition; such as 40 mass % or less of a composition; such as 30 mass % or less of a composition, such as from 20 to 0.001 mass %, such as from 20 to 0.1 mass %, based upon the mass of the composition.

The term "effective amount" in respect of an additive means an amount of such an additive in a lubricating oil composition so that the additive provides the desired technical effect.

The term "mass %" means mass percent of a component, based upon the mass of the composition as measured in grams, unless otherwise indicated, and is interchangeably referred to as weight percent ("weight %", "wt %", or "% w/w").

The term "active ingredient" (also referred to as "ai" "a.i." "AI" or "A.I.") refers to additive material that is neither diluent nor solvent. By way of example, a certain dispersant component in a lubricating oil composition may contain a specific dispersant and diluent oil (the specific dispersant in the dispersant component expressed e.g. in mass % based on the mass of the entire dispersant component including diluent oil). The active ingredient content in the lubricating oil composition is not the content of the dispersant component including the diluent oil but the content of the specific dispersant itself. Unless otherwise indicated, all amounts, ranges and ratios in the present specification and claims refer to active ingredient. Further, unless indicated otherwise, all active ingredient percentages of an additive in an additive component or in a lubricating oil composition or in a concentrate refer to mass %.

The terms "oil-soluble" and "oil-dispersible," or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired.

The term "hydrocarbon" means a compound of hydrogen and carbon atoms. A "heteroatom" is an atom other than carbon or hydrogen. When referred to as "hydrocarbons," particularly as "refined hydrocarbons," the hydrocarbons may also contain one or more heteroatoms or heteroatom-containing groups (such as halo, especially chloro and fluoro, amino, alkoxyl, mercapto, alkylmercapto, nitro, nitroso, sulfoxy, etc.) in minor amounts (e.g., where the heteroatom(s) do not substantially alter the hydrocarbon properties of the hydrocarbon compound).

The terms "unborated" and "non-borated" are used interchangeably herein.

The terms "group" and "radical" are used interchangeably herein.

The term "hydrocarbyl" means a radical that contains hydrogen and carbon atoms. Preferably, the group consists essentially of, more preferably consists only of, hydrogen and carbon atoms, unless specified otherwise. Preferably, the hydrocarbyl group comprises an aliphatic hydrocarbyl group. The term "hydrocarbyl" includes "alkyl," "alkenyl," "alkynyl," and "aryl" as defined herein. Hydrocarbyl groups may contain one or more atoms/groups other than carbon and hydrogen provided they do not affect the essentially hydrocarbyl nature of the hydrocarbyl group. Those skilled in the art will be aware of such atoms/groups (e.g., halo, especially chloro and fluoro, amino, alkoxyl, mercapto, alkylmercapto, nitro, nitroso, sulfoxy, etc.).

The term "alkyl" means a radical of carbon and hydrogen (such as a $C_1$ to $C_{30}$, such as a $C_1$ to $C_{12}$ group). Alkyl groups in a compound are typically bonded to the compound directly via a carbon atom. Unless otherwise specified, alkyl groups may be linear (i.e., unbranched) or branched, be cyclic, acyclic, or part cyclic/acyclic. Preferably, the alkyl group comprises a linear or branched acyclic alkyl group. Representative examples of alkyl groups include, but are not limited to, methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and triacontyl.

The term "alkenyl" means a radical of carbon and hydrogen (such as a $C_2$ to $C_{30}$ radical, such as a $C_2$ to $C_{12}$ radical) having at least one double bond. Alkenyl groups in a compound are typically bonded to the compound directly via a carbon atom. Unless otherwise specified, alkenyl groups may be linear (i.e., unbranched) or branched, be cyclic, acyclic or part cyclic/acyclic.

The term "alkylene" means a $C_1$ to $C_{20}$, preferably a $C_1$ to $C_{10}$, bivalent saturated aliphatic radical, which may be linear or branched. Representative examples of alkylene include methylene, ethylene, propylene, butylene, pentylene, hexylene, heptylene, octylene, nonylene, decylene, 1-methyl ethylene, 1-ethyl ethylene, 1-ethyl-2-methyl ethylene, 1,1-dimethyl ethylene and 1-ethyl propylene.

An "olefin", alternatively referred to as "alkene," is a linear, branched, or cyclic compound of carbon and hydrogen having at least one double bond. An "alpha olefin" is an olefin having a double bond in the alpha position. A "conjugated diene" is a diene having two double bonds separated by a single bond. For purposes of this invention and the claims thereto, styrene is considered a conjugated diene. For purposes of this specification and the claims appended thereto, when a polymer or copolymer is referred to as comprising an olefin, the olefin present in such polymer or copolymer is the polymerized form of the olefin. For example, when a copolymer is said to have an "isoprene" content of 55 wt % to 95 wt %, it is understood that the mer unit in the copolymer is derived from isoprene in the polymerization reaction and said derived units are present at 55 wt % to 95 wt %, based upon the weight of the copolymer. A "polymer" has two or more of the same or different mer units. A "homopolymer" is a polymer having mer units that are the same. A "copolymer" is a polymer having two or more mer units that are different from each other. "Different" as used to refer to mer units indicates that the mer units differ from each other by at least one atom or are different isomerically. An "isoprene polymer" or "isoprene copolymer" is a polymer or copolymer comprising at least 50 mol % isoprene derived units, a "butadiene polymer" or "butadiene copolymer" is a polymer or copolymer comprising at least 50 mol % butadiene derived units, and so on. Likewise, when a polymer is referred to as a "partially or fully saturated polymer comprising $C_{4-5}$ olefins," the $C_{4-5}$ olefin(s) present in such polymer or copolymer are the polymerized form of the olefin(s), and the polymer has been partially or fully saturated (such as by hydrogenation) after polymerization of the monomers. A polymer "backbone" is the polymer main chain containing the units of the monomer(s), typically without/prior to any (subsequent) functionalization.

The term "alkynyl" means a $C_2$ to $C_{30}$ (such as a $C_2$ to $C_{12}$) radical, which includes at least one carbon-to-carbon triple bond.

The term "aryl" means a group containing at least one aromatic ring, such a cyclopentadiene, phenyl, naphthyl, anthracenyl, and the like. Aryl groups are typically $C_5$ to $C_{40}$ (such as $C_5$ to $C_{18}$, such as $C_6$ to $C_{14}$) aryl groups, optionally substituted by one or more hydrocarbyl groups, heteroatoms, or heteroatom-containing groups (such as halo, hydroxyl, alkoxy and amino groups). Preferred aryl groups include phenyl and naphthyl groups and substituted derivatives thereof, especially phenyl, and alkyl substituted derivatives of phenyl.

The term "substituted" means that a hydrogen atom has been replaced with hydrocarbon group, a heteroatom, or a heteroatom-containing group. An alkyl substituted derivative means a hydrogen atom has been replaced with an alkyl group. An "alkyl substituted phenyl" is a phenyl group where a hydrogen atom has been replaced by an alkyl group, such as a $C_1$ to $C_{20}$ alkyl group, such as methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and/or triacontyl.

The term "halogen" or "halo" means a group 17 atom or a radical of group 17 atom, such as fluoro, chloro, bromo, and iodo.

The term "ashless" in relation to an additive means it does not include a metal.

The term "ash-containing" in relation to an additive means it includes a metal.

The term "ppm" means parts per million by mass, based on the total mass of the lubricating oil composition, unless otherwise indicated.

The term "metal content" of a lubricating oil composition or of an additive component, for example, magnesium content, molybdenum content or total metal content (i.e., the sum of all individual metal contents), is measured by ASTM D5185.

The term "aliphatic hydrocarbyl fatty acid" means a monocarboxylic acid having an aliphatic $C_7$ to $C_{29}$, preferably a $C_9$ to $C_{27}$, most preferably a $C_{11}$ to $C_{23}$ hydrocarbyl chain. Such compounds may be referred to herein as aliphatic ($C_7$ to $C_{29}$), more preferably ($C_9$ to $C_{27}$), most preferably ($C_{11}$ to $C_{23}$), hydrocarbyl monocarboxylic acid(s) or hydrocarbyl fatty acid(s) (wherein Cx to Cy designates the total number of carbon atoms in the aliphatic hydrocarbyl chain of the fatty acid, the fatty acid itself due to the presence of the carboxyl carbon atom includes a total of Cx+1 to Cy+1 carbon atoms). Preferably, the aliphatic hydrocarbyl fatty acid, inclusive of the carboxyl carbon atom, has an even number of carbon atoms. The aliphatic hydrocarbyl chain of the fatty acid may be saturated or unsaturated (i.e., includes at least one carbon-to-carbon double bond); preferably, the aliphatic hydrocarbyl chain is unsaturated and includes at least one carbon-to-carbon double bond—such fatty acids may be obtained from natural sources (e.g., derived from animal or vegetable oils) and/or by reduction of the corresponding saturated fatty acid. It will be appreciated that a proportion of the aliphatic hydrocarbyl chain(s) of the corresponding aliphatic hydrocarbyl fatty acid ester(s) is unsaturated (i.e., includes at least one carbon-to-carbon double bond) to permit reaction with other agents, such as sulfur, to form the corresponding functionalized, such as sulfurized, aliphatic hydrocarbyl fatty acid ester(s).

The term "aliphatic hydrocarbyl fatty acid ester" means an ester obtainable by converting the monocarboxylic acid functional group of the corresponding aliphatic hydrocarbyl fatty acid into an ester group. Suitably, the monocarboxylic acid functional group of the aliphatic hydrocarbyl fatty acid is converted to a hydrocarbyl ester, preferably a $C_1$ to $C_{30}$ aliphatic hydrocarbyl ester, such as an alkyl ester, preferably a $C_1$ to $C_6$ alkyl ester, especially a methyl ester. Alternatively, or additionally, the monocarboxylic acid functional group of the aliphatic hydrocarbyl fatty acid may be in the form of the natural glycerol ester. Accordingly, the term "aliphatic hydrocarbyl fatty acid ester" embraces aliphatic hydrocarbyl fatty acid glycerol ester(s) and aliphatic hydrocarbyl fatty acid $C_1$ to $C_{30}$ aliphatic hydrocarbyl ester(s), [e.g., aliphatic hydrocarbyl fatty acid alkyl ester(s), more preferably aliphatic hydrocarbyl fatty acid $C_1$ to $C_6$ alkyl ester(s), especially aliphatic hydrocarbyl fatty acid methyl ester(s)]. Suitably, the term "aliphatic hydrocarbyl fatty acid ester" embraces aliphatic ($C_7$ to $C_{29}$) hydrocarbyl, more preferably aliphatic ($C_9$ to $C_{27}$) hydrocarbyl, most preferably aliphatic ($C_{11}$ to $C_{23}$) hydrocarbyl fatty acid glycerol ester(s) and aliphatic ($C_7$ to $C_{29}$) hydrocarbyl, more preferably aliphatic ($C_9$ to $C_{27}$) hydrocarbyl, most preferably aliphatic ($C_{11}$ to $C_{23}$) hydrocarbyl fatty acid $C_1$ to $C_{30}$ aliphatic hydrocarbyl ester(s). Suitably, to permit functionalization, such as sulfurization, of the aliphatic hydrocarbyl fatty acid ester(s) a proportion of the aliphatic hydrocarbyl chain(s) of the fatty acid ester(s) is unsaturated and includes at least one carbon-to-carbon double bond.

The term "sulfurized aliphatic hydrocarbyl fatty acid ester" means a compound obtained by sulfurizing an aliphatic hydrocarbyl fatty acid ester as defined herein.

When the term "absent" is used in relation to monomer reactants and/or to repeat units in (co)polymers described herein, it means present at 0 wt %, based upon the weight of all (co)monomers in the (co)polymer, or, if present at all, at levels so low that they do not substantially impact the physical properties of the (co)polymer, such as at 0.2 wt % or less or at 0.1 wt % or less.

As used herein, Mn is number average molecular weight, Mw is weight average molecular weight, and Mz is z average molecular weight. Molecular weight distribution (MWD), also referred to as polydispersity index (PDI), is defined to be Mw divided by Mn. Unless otherwise noted, all molecular weight units (e.g., Mw, Mn, Mz) are reported in g/mol.

When used in context of functionalized polymers (such as dispersants, functionalized styrenic polymers, etc.), the molecular weights are typically reported in terms of the base polymer prior to modification. For example, PIBSA-PAM dispersant molecular weights are typically reported for the base polyisobutylene polymer prior to functionalization with the acylating agent (maleic acid or anhydride) and functional group (such as polyamine).

Total Base Number also referred to as "TBN," in relation to an additive component or of a lubricating oil composition (i.e., unused lubricating oil composition) means total base number as measured by ASTM D2896 and reported in units of mgKOH/g.

Total Acid Number ("TAN") is determined by ASTM D664.

The term "soap", as used herein, means the amount of metal salt(s), in particular alkali metal or alkaline earth metal salt(s), of organic acids provided by the one or more detergent(s), exclusive of any overbasing material. Detergent(s) are obtained from the neutralization of organic acidic molecules with metal bases. When the detergent is overbased, the organic acid is typically neutralized with a strong metal base in the presence of an acidic gas (often carbon dioxide). In consequence, both the organic acid and the acidic gas are converted into a metal salt and the detergent contains metal in an amount in excess of that required to neutralize the organic acid. The amount of metal salt(s) present in the detergent(s) in addition to the metal salt(s) of the organic acid(s) represents the "alkaline reserve" or "overbasing material" of the detergent(s). For example, if the overbased detergent is neutralized with metal bases in the presence of carbon dioxide, the overbasing material mostly consists of metal carbonate salt(s). In other words, the amount of the detergent(s) (active ingredient) comprises or consists of the amount of soap of the detergent(s) plus the optional amount of overbasing material of the detergent(s). Thus, if a lubricating oil composition or concentrate comprises overbased detergent(s), the mass % of soap is less than the mass % of detergent(s), based on the total mass of the lubricating oil composition or concentrate. If a lubricating oil composition or concentrate comprises only neutral detergent(s) which do not contain any overbasing material, the mass % of soap and the mass % of detergent, based on the total mass of the lubricating oil composition or concentrate, are similar. The amount of soap can be determined directly or can be derived from the manufacturing process mass balance. For sulfonates, in particular calcium sulfonates, the amount of soap can be measured by ASTM D3712. Further, the amount of soap can be derived by employing titrimetry, including two phase titrimetric methods, total acid number (TAN) as determined using ASTM D664, dialysis and other well-known analytical techniques. The amount of alkali metal or alkaline earth metal organic salt present in a detergent may be determined by dialyzing the detergent and quantifying the amount of the residue. If the average molecular weight of the organic salts is not known, the residue from the dialyzed detergent can be treated with strong acid to convert the salt to its acid form, analyzed by chromatographic methods, proton NMR, and mass spectroscopy and correlated to organic acids of known properties.

Phosphorus, Boron, Calcium, Zinc, Molybdenum, Sodium, Silicon, and Magnesium content are measured by ASTM D5185.

Sulfur content in oil formulations is measured by ASTM D5185.

Sulfated ash ("SASH") content is measured by ASTM D874.

Kinematic viscosity (KV100, KV40) is determined pursuant to ASTM D445-19a and reported in units of cSt, unless otherwise specified.

Viscosity index is determined according to ASTM D2270.

Saponification number is determined by ASTM D94, and reported in units of mgKOH/g.

"HTCBT, high temperature corrosion bench test, is determined pursuant to ASTM D6594.

Average functionality [also referred to as Average Functionality Value (Fv)] and Functionality Distribution (Fd) value are determined by Gel Permeation Chromatography using polystyrene standards as described in the Experimental section of U.S. patent application Ser. No. 18/480,571 filed Oct. 4, 2023 claiming priority to U.S. Ser. No. 63/379,006, filed Oct. 11, 2022.

PIBSA means polyisobutylene succinic anhydride.

PIBSA-PAM means polyisobutylene succinimides, e.g., a reaction product of PIBSA and polyamine.

Unless otherwise indicated, all percentages reported are mass % on an active ingredient basis, i.e., without regard to carrier or diluent oil, unless otherwise indicated. Unless otherwise indicated, "mass %" herein has the same meaning as "weight %" or "wt %".

Also, it will be understood that various components used, essential as well as optimal and customary, may react under conditions of formulation, storage or use and that the disclosure also provides the product obtainable or obtained as a result of any such reaction.

Further, it is understood that any upper and lower quantity, range and ratio limits set forth herein may be independently combined.

Also, it will be understood that the preferred features of each aspect of the present disclosure are regarded as preferred features of every other aspect of the present disclosure. Accordingly, preferred and more preferred features of one aspect of the present disclosure may be independently combined with other preferred and/or more preferred features of the same aspect or different aspects of the present disclosure.

DETAILED DESCRIPTION OF THE INVENTION

The features of the disclosure relating, where appropriate, to each and all aspects of the disclosure, will now be described in more detail as follows.

The lubricating oil compositions of the disclosure comprise components that may or may not remain the same chemically before and after mixing with an oleaginous carrier (such as a base oil) and/or other additives. This disclosure encompasses compositions which comprise the components before mixing, or after mixing, or both before and after mixing.

Lubricating Oil Compositions

This disclosure relates to lubricating oil compositions (also referred to as "LOC," "lubricant compositions," "lubricating compositions," or "lubricant oil compositions") containing less than 1000 ppm phosphorus, comprising or resulting from the admixing of:

A) at least 50 mass % of one or more base oil(s), based on the total mass of the lubricating oil composition;

B) one or more dispersant(s), wherein said one or more dispersant(s) comprise 2 to 10 mass %, based on the total mass of the lubricating oil composition, of one or more poly(alkenyl)succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and C) one or more detergent(s), wherein said one or more detergent(s) together provide soap to the lubricating oil composition in an amount of 0.1 to 0.9 mass %, based on the total mass of the lubricating oil composition;

wherein: i) the ratio of mass %, based on the total mass of the lubricating oil composition, of the one or more unborated PIBSA-PAM(s) to soap of the lubricating oil composition is 6.65 or more, where the lubricating oil composition preferably exhibits:

a) an SAE viscosity grade of 20W-X, 15W-X, 10W-X, or 5W-X, where X represents any one of 8, 12, 16, 20, 30, and 40, such as 30 or 40, such as 30; and b) a valve train rocker arm wear of less than 120 mg, such as less than 110 mg, such as less than 100 mg, such as less than 90 mg, such as less than 80 mg, such as less than 70 mg, such as less than 60 mg, such as less than 50 mg, such as less than 40 mg, as determined by the Ford 6.7 L Power Stroke Diesel Engine Test for soot induced wear and viscosity control.

This disclosure also relates to lubricating oil compositions containing less than 1000 ppm phosphorus, comprising or resulting from the admixing of:

A) at least 50 mass % of one or more base oil(s), based on the total mass of the lubricating oil composition;

B) 2 to 15 mass %, based on the total mass of the lubricating oil composition, of one or more dispersant(s), wherein said one or more dispersant(s) comprise 2 to 10 mass %, based on the total mass of the lubricating oil composition, of one or more poly(alkenyl)succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and C) 0.1 to 5 mass %, based on the total mass of the lubricating oil composition, of one or more detergent(s), wherein said one or more detergent(s) together provide soap to the lubricating oil composition in an amount of 0.1 to 0.9 mass %, based on the total mass of the lubricating oil composition;

wherein: i) the ratio of mass %, based on the total mass of the lubricating oil composition, of the one or more unborated PIBSA-PAM(s) to soap of the lubricating oil composition is 6.65 or more, where the lubricating oil composition preferably exhibits:

a) an SAE viscosity grade of 20W-X, 15W-X, 10W-X, or 5W-X, where X represents any one of 8, 12, 16, 20, 30, and 40, such as 30 or 40, such as 30; and b) a valve train rocker arm wear of less than 120 mg, such as less than 110 mg, such as less than 100 mg, such as less than 90 mg, such as less than 80 mg, such as less than 70 mg, such as less than 60 mg, such as less than 50 mg, such as less than 40 mg, as determined by the Ford 6.7 L Power Stroke Diesel Engine Test for soot induced wear and viscosity control.

This disclosure also relates to lubricating oil compositions containing less than 1000 ppm phosphorus, comprising or resulting from the admixing of:

A) at least 50 mass % of one or more base oil(s), based on the total mass of the lubricating oil composition;

B) 2 to 15 mass %, based on the total mass of the lubricating oil composition, of one or more dispersant(s), wherein said one or more dispersant(s) comprise 2 to 10 mass %, based on the total mass of the lubricating oil composition, of one or more poly(alkenyl)succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and C) 0.1 to 5 mass %, based on the total mass of the lubricating oil composition, of one or more detergent(s), wherein said one or more detergent(s) together provide soap to the lubricating oil composition in an amount of 0.1 to 0.9 mass %, based on the total mass of the lubricating oil composition;

D) optionally, from 0.01 to 5 mass % (in particular 0.01 wt % to about 2.5 wt %, or about 0.02 wt % to about 1.5 wt %, or about 0.03 wt % to about 1.0 wt %, or about 0.04 wt % to about 0.5 wt %, or about 0.05 wt % to about 0.2 wt %), based on total weight of the lubricating oil composition, of one or more friction modifiers (such as blends of friction modifiers);

E) optionally, from 0.01 to 10 wt % (in particular, 0.05 to 5 wt %, alternately 0.1 to 4.5 mass %, alternately 0.5 to 4 wt %, alternately 1 to 3.5 wt %, alternately 2.5 to 3.5 wt %), based on total weight of the lubricating oil composition, of one or more antioxidants (such as blends of antioxidants);

F) optionally, from 0.01 to 5 wt % (in particular, 0.01 to 3 mass %, alternately 0.1 to 1.5 mass %), based on total weight of the lubricating oil composition, of one or more pour point depressants (such as blends of pour point depressants);

G) optionally, from 0.001 to 5 wt % (in particular, 0.002 to 3 mass %, alternately 0.003 to 1 mass %), based on total weight of the lubricating oil composition, of one or more anti-foam agents (such as blends of anti-foam agents);

H) optionally, from 0.001 to 10 wt % (in particular, 0.01 to 6 wt %, alternately 0.01 to 5 mass %, alternately 0.1 to 4 mass %, alternately 0.2 to 2 mass %, alternately 0.2 to 1 mass %), based on total weight of the lubricating oil composition, of one or more viscosity modifiers (such as blends of viscosity modifiers);

J) optionally, from 0.001 to 5 wt % (in particular from 0.005 wt % to 3.0 wt %, alternately from 0.01 to 1.5 wt %, alternately from 0.03 to 1.0 wt %, alternately 0.05 to 0.5 mass %), based on total weight of the lubricating oil composition, of one or more corrosion inhibitors and/or anti-rust agents (such as blends of corrosion inhibitors and/or anti-rust agents);

K) optionally from 0.001 to 10 wt % (in particular, 0.01 to 5 wt %, alternately 0.05 to 3 mass %, alternately 0.1 to 2 mass %, alternately 0.4 to 1.2 mass %, alternately 0.5 to 1.0 mass %, alternately 0.6 to 0.8 mass %), based on total weight of the lubricating oil composition, of one or more antiwear agents (such as blends of antiwear agents, such as ZDDP);

M) optionally, from 0.01 to 5 wt % (in particular, 0.05 to 2 mass %, alternately 0.1 to 1 mass %), based on total weight of the lubricating oil composition, of one or more seal compatibility agents, such as seal swell agents, N) optionally, from 0.01 to 5 wt % (in particular, 0.05 to 3 mass %, alternately 0.1 to 1 mass %), based on total weight of the lubricating oil composition, of one or more extreme pressure agents, O) optionally, from 0.01 to 5 wt % (in particular, 0.1 to 3 mass %, alternately 0.1 to 1.5 mass %), based on total weight of the lubricating oil composition, of one or more unsaturated $C_{12}$-$C_{60}$ hydrocarbons (such as $C_{12}$-$C_{24}$ linear alpha-olefins (LAOs), oligomers/polymers of polyisobutylenes, and/or blends thereof), and/or P) optionally 0.001 to 10 wt % (in particular, 0.01 to 6 wt %, alternately 0.01 to 5 mass %, alternately 0.05 to 4 mass %, alternately 0.1 to 3 mass %, alternately 0.2 to 1.0 mass %, alternately 0.4 to 0.8 mass %), based on total weight of the lubricating oil composition, of one or more functionalized polymers (such as blends of functionalized polymers);

wherein: i) the ratio of mass %, based on the total mass of the lubricating oil composition, of the one or more unborated PIBSA-PAM(s) to soap of the lubricating oil composition is 6.65 or more, where the lubricating oil composition preferably exhibits:

a) an SAE viscosity grade of 20W-X, 15W-X, 10W-X, or 5W-X, where X represents any one of 8, 12, 16, 20, 30, and 40, such as 30 or 40, such as 30; and b) a valve train rocker arm wear of less than 120 mg, such as less than 110 mg, such as less than 100 mg, such as less than 90 mg, such as less than 80 mg, such as less than 70 mg, such as less than 60 mg, such as less than 50 mg, such as less than 40 mg, as determined by the Ford 6.7 L Power Stroke Diesel Engine Test for soot induced wear and viscosity control.

In certain embodiments of the lubricating oil compositions of the present invention, the A) one or more dispersant(s) of the lubricating oil composition of the present invention comprise 2.0 to 6.00 mass %, based on the total mass of the lubricating oil composition, of one or more poly(alkenyl)succinimides, in which the polyalkenyl is derived from polyisobutylene and the imide is derived from polyamine ("PIBSA-PAM").

In certain embodiments of the lubricating oil compositions of the present invention, the A) one or more dispersant(s) of the lubricating oil composition of the present invention comprise 2 to 10 mass %, such as 2.5 to 10 mass %, such as 3 to 8 mass %, such as 3.5 to 6 mass %, based on the total mass of the lubricating oil composition, of one or more poly(alkenyl)succinimides, in which the polyalkenyl is derived from polyisobutylene and the imide is derived from polyamine ("PIBSA-PAM"); and the B) one or more detergent(s) comprise 50 mass % or less, based on the total mass of detergent(s) present in the lubricating oil composition, of calcium salicylate.

In certain embodiments of the lubricating oil compositions of the present invention, the A) one or more dispersant(s) of the lubricating oil composition of the present invention comprise 2 to 10 mass %, such as 2.5 to 10 mass %, such as 3 to 8 mass %, such as 3.5 to 6 mass %, based on the total mass of the lubricating oil composition, of one or more poly(alkenyl)succinimides, in which the polyalkenyl is derived from polyisobutylene and the imide is derived from polyamine ("PIBSA-PAM"); and the lubricating oil composition further comprises P) an amide, imide, and/or ester functionalized polymer comprising a partially or fully saturated polymer backbone comprising $C_{4-5}$ olefins having:

i) an Mw/Mn of less than 2, ii) a Functionality Distribution (Fd) value of 3.5 or less, and iii) an Mn of 10,000 g/mol or more (GPC-PS) of the polymer prior to functionalization.

For purposes of this disclosure, component P) functionalized polymer(s) are not added in the elements B, C, D, E, F G, H, I, J, K, M, and/or O above for determining weight percentages, even though they may show similar properties, e.g., element P) functionalized polymer(s) may impact viscosity and may have dispersant activity, but is not added into element B) or H) for determining weight percent of dispersants or viscosity modifiers.

In embodiments, all of elements D, E, F G, H, J, K, M, N, O, and P are present in addition to the base oil(s), the one or more detergent(s), and the one or more dispersant(s) described herein.

In embodiments, elements D, E, F G, H, K, J, and P are present in addition to the base oil(s), the one or more detergent(s), and the one or more dispersant(s) described herein.

In embodiments, elements F, G, H, K, and P are present in addition to the base oil(s), the one or more detergent(s), and the one or more dispersant(s) described herein.

In embodiments, element K is present in addition to the base oil(s), the one or more detergent(s), and the one or more dispersant(s) described herein.

In embodiments, element P is present in addition to the base oil(s), the one or more detergent(s), and the one or more dispersant(s) described herein.

In the present invention, it has been found that the anti-friction and anti-wear properties of a lubricating oil composition can be significantly improved by using the disclosed ratio of unborated PIBSA-PAM dispersant(s) to soap in the lubricating oil composition, such as a heavy-duty diesel oil. Further, it has been found in the present invention that using the disclosed ratio of unborated PIBSA-PAM dispersant(s) to soap in a lubricant composition, such as a heavy-duty diesel oil, provides advantageous anti-wear properties at phosphorus levels of less than 1000 ppm, such as 800 ppm. In particular, it has been found in the present invention that using the disclosed ratio of unborated PIBSA-PAM dispersant(s) to soap in a lubricant composition, such as a heavy-duty diesel oil, allows passing the Ford 6.7 L Power Stroke Diesel Engine Test for soot induced wear and viscosity control at phosphorus levels of less than 1000 ppm, such as 800 ppm.

In the present invention, it has further been found that the improved anti-wear properties described above can also be obtained when using the disclosed ratio of unborated PIBSA-PAM dispersant(s) to soap in lubricant oil compositions having a SAE viscosity grade of 10W-30 or 5W-30.

In embodiments, i) the ratio of mass %, based on the total mass of the lubricating oil composition, of the one or more unborated PIBSA-PAM(s) to soap of the lubricating oil composition is from 7.0 to 15.0, such as from 7.2 to 13.0, such as from 7.4 to 11.0, such as from 7.6 to 10.0, such as from 7.8 to 9.0, such as from 8.0 to 8.5.

Suitably, the lubricant composition may have a total base number (TBN) of 2 to 15 mgKOH/g, preferably 5 to 13 mgKOH/g, such as 6 to 11 mgKOH/g, such as 7 to 9 mgKOH/g, as measured by ASTM D4739.

The lubricating compositions of the present disclosure may contain low levels of phosphorus, namely less than 1000, preferably less than 900, more preferably less than 850 parts per million (ppm) by mass of phosphorus, expressed as atoms of phosphorus, based on the total mass of the lubricating compositions, as measured by ASTM D5185.

Suitably, the lubricant composition may contain 700 ppm to 900 ppm, alternately 750 ppm to 850 ppm, alternately about 800 ppm of phosphorus, as measured by ASTM D5185.

Typically, the lubricating compositions may contain low levels of sulfur. Preferably, the lubricating composition contains up to 0.4, more preferably up to 0.3, most preferably up to 0.2, such as 0.1 to 0.4 mass % sulfur, based on the total mass of the lubricating oil composition, as measured by ASTM D5185.

Typically, the lubricating compositions may contain low levels of sulfated ash, such as 1.2% or less, such as 1.0 mass % or less, preferably 0.9 mass or less %, alternately 0.0001 to 0.9 mass % or less sulfated ash, based on the total mass of the lubricating composition, as measured by ASTM D874-13a (2018).

Generally, the kinematic viscosity at 100° C. ("KV100") of the lubricating composition may range from 2 to 30 cSt ($mm^2/s$), such as 2 to 20 cSt ($mm^2/s$), such as 5 to 15 cSt ($mm^2/s$), such as 7 to 13 cSt ($mm^2/s$), such as 9 to 11 cSt ($mm^2/s$), such as 9.5 to 10 cSt ($mm^2/s$), as determined according to ASTM D 445-19a).

The lubricating composition disclosed herein, such as diesel engine lubricating compositions, may have a high temperature, high shear viscosity (HTHS) as measured by ASTM D4683 at 150° C. of less than 4.5 mPa s, or less than 4.4 mPa s, or less than 4.3 mPa s, or less than 4.2 mPa s. In another embodiment, the HTHS of the lubricating composition is from 2.0 to 4.5 mPa s, or from 2.3 to 4.4 mPa s, or from 2.5 to 4.3 mPa s, or from 2.7 to 4.2 mPa s, such as from 2.7 to 3.5 mPa s or from 3.3 to 4.2 mPa s.

Preferably, the lubricating composition of the present disclosure may be a multigrade oil identified by the viscometric descriptor SAE 20W-X, SAE 15W-X, SAE 10W-X, SAE 5W-X or SAE OW-X, where X represents any one of 8, 12, 16, 20, 30, 40, and 50; the characteristics of the different viscometric grades can be found in the SAE J300 classification. Alternately, the lubricating composition may be the form of viscosity grade SAE 15W-X, SAE 10W-X, SAE 5W-X or SAE OW-X, such as in the form of SAE 10W-X or SAE 5W-X, wherein X represents any one of 8, 12, 16, 20, 30, 40, and 50. Preferably X is 30 or 40. Alternately, the lubricating composition of the present disclosure may be a multigrade oil identified by the viscometric descriptor SAE 10W-30, 15W-40, 5W-30, 5W-40, 10W-40, 5W-50. (See standard SAE J300 published January 2015 by SAE International, formerly known as Society of Automotive Engineers). In embodiments, the lubricating oil composition has an SAE viscosity grade of 15W-40, 5W-30, or 10W-30. In a particular embodiment, the lubricating oil composition has an SAE viscosity grade of 10W-30. In another particular embodiment, the lubricating oil composition has an SAE viscosity grade of 5W-30.

Optionally, the lubricating composition may be absent or substantially absent phenolic antioxidant.

Optionally, the lubricating composition may be absent or substantially absent phenate detergent.

Optionally, the lubricating composition may be absent colloidal particles comprising a ZnO core.

In embodiments, the lubricating oil composition may comprise less than 75 ppm boron, alternately less than 70 ppm boron, alternately from 1 to 70 ppm boron.

In embodiments, the lubricating compositions of the present disclosure may be a heavy-duty diesel oil (e.g., for use in an engine for a heavy-duty diesel vehicle, i.e., a heavy-duty diesel vehicle having a gross vehicle weight rating of 10,000 pounds or more.)

In embodiments, the lubricating compositions of the present disclosure may be a passenger car motor oil.

In embodiments, the lubricating compositions of the present disclosure may be a hydrogen fuel and/or natural gas.

Concentrates

A concentrate, also referred to as an additive package, adpak, or addpack, is a composition having less than 50 mass % (such as less than 40 mass %, such as less than 30 mass %, such as less than 25 mass %, such as less than 20 mass %) base oil and lubricant composition additives (such as described herein) which is typically then further blended with additional base oil to form a lubricating oil product.

This disclosure relates to concentrate compositions comprising or resulting from the admixing of:

A) 1 to less than 50 mass % of one or more base oils, based on the total mass of the concentrate;

B) one or more dispersant(s), wherein said one or more dispersants comprise one or more unborated poly(alkenyl)succinimides, in which the polyalkenyl is derived from polyisobutylene and the imide is derived from polyamine ("PIBSA-PAM"); and C) one or more detergent(s), wherein said one or more detergents provide soap to the concentrate;

wherein: i) the ratio of mass %, based on the total mass of the concentrate, of the one or more unborated PIBSA-PAM(s) to soap of the concentrate is 6.65 or more.

In embodiments, this disclosure relates to concentrate compositions comprising or resulting from the admixing of:

A) 1 to less than 50 mass % of one or more base oils, based on the total mass of the concentrate;

B) one or more dispersant(s), wherein said one or more dispersants comprise one or more unborated poly(alkenyl)succinimides, in which the polyalkenyl is derived from polyisobutylene and the imide is derived from polyamine ("PIBSA-PAM"); and C) one or more detergent(s), wherein said one or more detergents provide soap to the concentrate;

wherein said one or more detergents comprise 50 mass % or less, based on the total mass of detergent(s) present in the concentrate, of calcium salicylate;

wherein: i) the ratio of mass %, based on the total mass of the concentrate, of the one or more unborated PIBSA-PAM(s) to soap of the concentrate is 6.65 or more.

In embodiments, this disclosure relates to concentrate compositions comprising or resulting from the admixing of:

A) 1 to less than 50 mass % of one or more base oils, based on the total mass of the concentrate;

B) one or more dispersant(s), wherein said one or more dispersants comprise one or more unborated poly(alkenyl)succinimides, in which the polyalkenyl is derived from polyisobutylene and the imide is derived from polyamine ("PIBSA-PAM"); and C) one or more detergent(s), wherein said one or more detergents provide soap to the concentrate; and P) an amide, imide, and/or ester functionalized polymer comprising a partially or fully saturated polymer backbone comprising $C_{4-5}$ olefins having:

i) an Mw/Mn of less than 2, ii) a Functionality Distribution (Fd) value of 3.5 or less, and iii) an Mn of 10,000 g/mol or more (GPC-PS) of the polymer prior to functionalization, wherein: i) the ratio of mass %, based on the total mass of the concentrate, of the one or more unborated PIBSA-PAM(s) to soap of the concentrate is 6.65 or more.

Optionally, the concentrate compositions of the present invention comprise one or more additional additives selected from the group consisting of friction modifiers, antioxidants, pour point depressants, anti-foam agents, viscosity modifiers, corrosion inhibitors, anti-rust agents, antiwear agents, seal compatibility agents, unsaturated $C_{12}$-$C_{60}$ hydrocarbons, and functionalized polymer(s).

In embodiments, i) the ratio of mass %, based on the total mass of the concentrate, of the one or more unborated PIBSA-PAM(s) to soap of the concentrate is from 7.0 to 15.0, such as from 7.2 to 13.0, such as from 7.4 to 11.0, such as from 7.6 to 10.0, such as from 7.8 to 9.0, such as from 8.0 to 8.5.

In embodiments, the concentrate composition may optionally be absent solvent (such as aliphatic or aromatic solvent) and/or absent functionalized base oil.

Optionally, the concentrate may be absent or substantially absent phenolic antioxidant.

Optionally, the concentrate may be absent phenate or substantially absent detergent.

Optionally, the concentrate may be absent or substantially absent colloidal particles comprising a ZnO core.

In embodiments, the concentrate may be absent or substantially absent unborated PIBSA-PAM(s), where the polyalkenyl is derived from polyisobutylene having a Mn of less than 1600 g/mol (GPC-PS) ("low molecular weight PIBSA-PAM") and the imide is derived from tetraethylenepentamine.

In embodiments, the ratio of the one or more unborated high molecular weight PIBSA-PAM(s) to the one or more unborated low molecular weight PIBSA-PAM(s) in the concentrate is less than 3 to 1, such as less than 2.5 to 1, such as less than 2 to 1.

In the following, further details and preferences regarding the components of the lubricating oil composition and the concentrate of the present invention are described.

A. Base Oil

The base oil (also referred to as "base stock," "lubricating oil basestock," or "oil of lubricating viscosity") useful herein may be a single oil or a blend of oils, and is typically a large liquid constituent of a lubricating composition, also referred to as a lubricant, into which additives and optional additional oils are blended, for example, to produce a lubricating composition, such as a final lubricant composition, a concentrate, or other lubricating composition.

A base oil may be selected from vegetable, animal, mineral, and synthetic lubricating oils, and mixtures thereof. It may range in viscosity from light distillate mineral oils to heavy lubricating oils, such as those for gas engine oil, mineral lubricating oil, motor vehicle oil, and heavy-duty diesel oil. Generally, the kinematic viscosity at 100° C. ("KV100") of the base oil ranges from 1 to 30 cSt, such as 2 to 25 cSt, such as 5 to 20 cSt, as determined according to ASTM D445-19a, in particular, from 1.0 cSt to 10 cSt, from 1.5 cSt to 3.3 cSt, from 2.7 cSt to 8.1 cSt, from 3.0 cSt to 7.2 cSt, or from 2.5 cSt to 6.5 cSt. Generally, the high temperature high shear (HTHS) viscosity at 150° C. of the base oil ranges from 0.5 to 20 cP such as 1 to 10 cP, such as 2 to 5 cP as determined according to ASTM D4683-20.

Typically, when lubricating oil basestock(s) is used to make a concentrate, it may advantageously be present in a concentrate-forming amount to give a concentrate containing, from 5 wt % to 80 wt %, from 10 wt % to 70 wt %, or from 5 wt % to 50 wt % of active ingredient, based upon the weight of the concentrate.

Common oils useful as base oils include animal and vegetable oils (e.g., castor and lard oil), liquid petroleum oils, and hydrorefined and/or solvent-treated mineral lubricating oils of the paraffinic, naphthenic, and mixed paraffinic-naphthenic types. Oils derived from coal or shale are also useful base oils. Base stocks may be manufactured using a variety of different processes including, but not limited to, distillation, solvent refining, hydrogen processing, oligomerization, esterification, and re-refining.

Synthetic lubricating oils useful herein as base oils include hydrocarbon oils such as homopolymerized and copolymerized olefins, referred to as polyalphaolefins or PAO's or group IV base oils [according to the API EOLCS 1509 definition (American Petroleum Institute Publication 1509, see section E.1.3, 19th edition, January 2021, www.API.org)]. Examples of PAO's useful as base oils include: poly(ethylenes), copolymers of ethylene and propylene, polybutylenes, polypropylenes, propylene-isobutylene copolymers, chlorinated polybutylenes, poly(1-hexenes), poly(1-octenes), poly(1-decenes), homo- or co-polymers of $C_8$ to $C_{20}$ alkenes, homo- or co-polymers of $C_8$, and/or $C_{10}$, and/or $C_{12}$ alkenes, $C_8/C_{10}$ copolymers, $C_8/C_{10}/C_{12}$ copolymers, and $C_{10}/C_{12}$ copolymers, and the derivatives, analogues and homologues thereof.

In another embodiment, the base oil may comprise polyalphaolefins comprising oligomers of linear olefins having 6 to 14 carbon atoms, more preferably 8 to 12 carbon atoms, more preferably 10 carbon atoms having a Kinematic viscosity at 100° C. of 10 or more (as measured by ASTM D445); and preferably having a viscosity index ("VI"), as determined by ASTM D2270, of 100 or more, preferably 110 or more, more preferably 120 or more, more preferably 130 or more, more preferably 140 or more; and/or having a pour point of −5° C. or less (as determined by ASTM D97), more preferably −10° C. or less, more preferably −20° C. or less.

In another embodiment polyalphaolefin oligomers useful in the present disclosure may comprise $C_{20}$ to $C_{1500}$ paraffins, preferably $C_{40}$ to $C_{1000}$ paraffins, preferably $C_{50}$ to $C_{750}$ paraffins, preferably $C_{50}$ to $C_{500}$ paraffins. The PAO oligomers are dimers, trimers, tetramers, pentamers, etc., of $C_5$ to $C_{14}$ alpha-olefins in one embodiment, and $C_6$ to $C_{12}$ alpha-olefins in another embodiment, and $C_8$ to $C_{12}$ alpha-olefins in another embodiment. Suitable olefins include 1-pentene, 1-hexene, 1-heptene, 1-octene, 1-nonene, 1-decene, 1-undecene, and 1-dodecene. In one embodiment, the olefin is a combination of 1-octene, 1-decene, and 1-dodecene, or alternately may be substantially 1-decene, and the PAO is a mixture of dimers, trimers, tetramers, and pentamers (and higher) thereof. Useful PAO's are described more particularly in, for example, U.S. Pat. Nos. 5,171,908 and 5,783,531, and in Synthetic Lubricants and High-Performance Functional Fluids 1-52 (Leslie R. Rudnick & Ronald L. Shubkin, ed. Marcel Dekker, Inc. 1999).

PAO's useful in the present disclosure typically possess a number average molecular weight of from 100 to 21,000 g/mol in one embodiment, and from 200 to 10,000 g/mol in another embodiment, and from 200 to 7,000 g/mol in yet another embodiment, and from 200 to 2,000 g/mol in yet another embodiment, and from 200 to 500 g/mol in yet another embodiment. Desirable PAO's are commercially available as SpectraSyn™ Hi-Vis, SpectraSyn™ Low-Vis, SpectraSyn™ plus, SpectraSyn™ Elite PAO's (ExxonMobil Chemical Company, Houston Texas) and Durasyn PAO's from Ineos Oligomers USA LLC.

Synthetic lubricating oils useful as base oils also include hydrocarbon oils such as homopolymerized and copolymerized: alkylbenzenes (e.g., dodecylbenzenes, tetradecylbenzenes, dinonylbenzenes, di(2-ethylhexyl)benzenes); polyphenols (e.g., biphenyls, terphenyls, alkylated polyphenols); and alkylated diphenyl ethers, and alkylated diphenyl sulfides; and the derivatives, analogues, and homologues thereof.

Another suitable class of synthetic lubricating oils useful as base oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) reacted with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils herein also include those made from $C_5$ to $C_{12}$ monocarboxylic acids and polyols, and polyol ethers such as neopentyl glycol, trimethylolpropane, pentaerythritol, dipentaerythritol, and tripentaerythritol.

Desirable ester base oils are commercially available as Esterex™ Esters (ExxonMobil Chemical Company, Houston, Texas).

Silicon-based oils such as the polyalkyl-, polyaryl-, polyalkoxy- or polyaryloxysilicone oils and silicate oils comprise another useful class of synthetic lubricants useful herein; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes, and poly(methylphenyl)-siloxanes.

Other synthetic lubricating oils useful herein include liquid esters of phosphorous-containing acids (e.g., tricresyl phosphate, trioctyl phosphate, diethyl ester of decylphosphonic acid) and polymeric tetrahydrofurans.

Unrefined, refined, and re-refined oils can be used in the lubricating compositions of the present disclosure. Unrefined oils are those obtained directly from a natural or synthetic source without further purification treatment. For example, a shale oil obtained directly from retorting operations, a petroleum oil obtained directly from distillation, or an ester oil obtained directly from an esterification process and used without further treatment is considered an unrefined oil. Refined oils are similar to the unrefined oils except they have been further treated in one or more purification steps to improve one or more properties. Many such purification techniques, such as distillation, solvent extraction, acid or base extraction, filtration, and percolation are used by those in the art. Re-refined oils are oils obtained by processes similar to those used to obtain refined oils where the refining processes are applied to previously refined oils which have been previously used in service. Such re-refined oils are also referred to as reclaimed or reprocessed oils and often are additionally processed for removal of spent additive and oil breakdown products. A re-refined base oil is preferably substantially free from materials introduced through manufacturing, contamination, or previous use.

Other examples of useful base oils are gas-to-liquid ("GTL") base oils, i.e., the base oil is an oil derived from hydrocarbons made from synthesis gas ("syn gas") containing H2 and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed. For further information on useful GTL base oils and blends thereof, please see U.S. Pat. No. 10,913,916 (col 4, ln 62 to col 5, ln 60) and U.S. Pat. No. 10,781,397 (col 14, ln 54 to col 15, ln 5, and col 16, ln 44 to col 17, ln 55).

In particular, oils from renewable sources, i.e., based in part on carbon and energy captured from the environment, such as biological sources, are useful herein.

The various base oils are often categorized as Group I, II, III, IV, or V according to the API EOLCS 1509 definition (American Petroleum Institute Publication 1509, see section E.1.3, 19th edition, January 2021, www.API.org). Generally speaking, Group I base stocks have a viscosity index of between about 80 to 120 and contain greater than about 0.03% sulfur and/or less than about 90% saturates. Group II base stocks have a viscosity index of between about 80 to 120 and contain less than or equal to about 0.03% sulfur and greater than or equal to about 90% saturates. Group III base stocks have a viscosity index greater than about 120 and contain less than or equal to about 0.03% sulfur and greater than about 90% saturates. Group IV base stocks includes polyalphaolefins (PAO). Group V base stocks include base stocks not included in Groups I-IV. (Viscosity index measured by ASTM D 2270, saturates is measured by ASTM D2007, and sulfur is measured by ASTM D5185, D2622, ASTM D4294, ASTM D4927, and ASTM D3120).

Base oils for use in the formulated lubricating compositions useful in the present disclosure are any one, two, three, or more of the variety of oils described herein. In desirable embodiments, base oils for use in the formulated lubricating compositions useful in the present disclosure are those described as API Group I, Group II, Group III (including Group III+), Group IV, and Group V oils and mixtures thereof, preferably API Group II, Group III, Group IV, and Group V oils and mixtures thereof, more preferably the Group III, Group III+, IV, and Group V base oils due to their exceptional volatility, stability, viscometric, and cleanliness features. Minor quantities of Group I basestock, such as the amount used to dilute additives for blending into formulated lube oil products, can be tolerated but are typically kept to a minimum, e.g., amounts only associated with their use as diluent/carrier oil for additives used on an "as-received" basis. In regard to the Group II stocks, it is often more useful that the Group II base stock be in the higher quality range associated with that stock, i.e., a Group II stock having a viscosity index in the range from 100 to 120.

The base oil useful herein may be selected from any of the synthetic, natural, or re-refined oils (such as those typically used as crankcase lubricating oils for spark-ignited and compression-ignited engines). Mixtures of synthetic and/or natural and/or re-refined base oils may be used if desired. Multi-modal mixtures (such as bi- or tri-modal mixtures) of Group I, II, III, IV, and/or V base stocks may be used if desired.

The base oil or base oil blend used herein conveniently has a kinematic viscosity at 100° C. (KV100, as measured according to ASTM D445-19a, and reported in units of centistoke (cSt) or it its equivalent, $mm^2/s$), of about 2 to about 40 cSt, alternately of 3 to 30 cSt, alternately 4 to 20 cSt at 100° C., alternately 5 to 10 cSt, alternately the base oil or base oil blend may have a kinematic viscosity at 100° C. of 2 to 20 cSt, of 2.5 to 2 cSt, and preferably of about 2.5 cSt to about 9 cSt.

The base oil or base oil blend preferably has a saturate content of at least 65 mass %, more preferably at least 75 mass %, such as at least 85 mass %, such as at least than 90 mass % as determined by ASTM D2007.

Preferably, the base oil or base oil blend will have a sulfur content of less than 1 mass %, preferably less than 0.6 mass %, most preferably less than 0.4 mass %, such as less than 0.3 mass %, based on the total mass of the lubricating composition, as measured by ASTM D5185.

In embodiments, the volatility of the base oil or base oil blend, as measured by the Noack test (ASTM D5800, procedure B), is less than or equal to 30 mass %, such as less than or equal to 25 mass %, such as less than or equal to 20 mass %, such as less than or equal to 16 mass %, such as less than or equal to 12 mass %, such as less than or equal to 10 mass %, based on the total mass of the lubricating composition.

In embodiments, the viscosity index (VI) of the base oil is at least 95, preferably at least 110, more preferably at least 120, even more preferably at least 125, most preferably from about 130 to 240, in particular from about 105 to 140 (as determined by ASTM D2270).

The base oil may be provided in a major amount, in combination with a minor amount of one or more additive components as described hereinafter, constituting a lubricant. This preparation may be accomplished by adding the additives directly to the oil or by adding the one or more additives in the form of a concentrate thereof to disperse or dissolve the additive(s). Additives may be added to the oil by any method known to those skilled in the art, either before, at the same time as, or after addition of other additives.

The base oil may be provided in a minor amount, in combination with minor amounts of one or more additive components as described hereinafter, constituting an additive concentrate. This preparation may be accomplished by adding the additives directly to the oil or by adding the one or more additives in the form of a solution, slurry or suspension thereof to disperse or dissolve the additive(s) in the oil. Additives may be added to the oil by any method known to those skilled in the art, either before, at the same time as, or after addition of other additives.

The base oil typically constitutes the major component of an engine oil lubricant composition of the present disclosure and typically is present in an amount ranging from at least 50 wt %, such as about 50 to about 99 wt %, preferably from about 70 to about 95 wt %, and more preferably from about 80 to about 95 wt %, based on the total weight of the composition. In certain embodiments, the lubricating oil composition of the present disclosure comprises 50 to 95 mass %, such as 60 to 90 mass %, such as 70 to 85 mass % of one or more base oils, based on the total mass of the lubricating oil composition.

The base oil of the present invention may be comprised entirely of one or more Group II base oil(s), of one or more Group III base oil(s), or of a mixture of one or more Group II and one or more Group III base oil(s). In certain embodiments, the base oil comprises at least 50 mass %, such as at least 70 mass %, such as at least 90 mass % of one or more Group II base oil(s) (based on the total mass of base oil present in the lubricating oil composition). In certain embodiments, the base oil is a mixture of one or more Group II and one or more Group III base oil(s), wherein the base oil comprises at least 50 mass %, such as at least 70 mass %, such as at least 90 mass % of one or more Group II base oil(s) (based on the total mass of base oil present in the lubricating oil composition). In certain embodiments, the base oil is solely one or more Group II base oils. In certain embodiments, the lubricating oil composition of the present invention comprises at least 50 mass %, such as at least 60 mass %, such as at least 65 mass % of a Group II base oil based on the total mass of the lubricating oil composition.

In certain embodiments, the Group II base oil comprises at least 10%, such as at least 25%, such as at least 50%, such as at least 75%, up to 100% (based on the total mass of base oil present in the lubricating oil composition) of a Group II base oil having a viscosity of 6 to 7 cSt, such as 6.5 cSt and/or a Group II base oil having a viscosity of 4 to 5 cSt, such as 4.6 cSt. In particular embodiments, the lubricating oil composition comprises at least 45 mass % of a Group II oil having a viscosity of less than 6.5 cSt, such as less than 6.0 cSt, such as less than 5.5 cSt, such as less than 5.0 cSt.

The base oils and blends thereof described above are also useful for making concentrates as well as for making lubricants therefrom.

Concentrates constitute a convenient means of handling additives before their use, as well as facilitating solution or dispersion of additives in lubricants. When preparing a lubricant that contains more than one type of additive (sometime referred to as "additive components"), each additive may be incorporated separately, each in the form of a concentrate. In many instances, however, it is convenient to provide a so-called additive "package" (also referred to as an "addpack") comprising one or more additives/co-additives, such as described hereinafter, in a single concentrate.

Typically, one or more base oils are present in the concentrate composition in an amount of less than 50 wt %, alternately 40 wt % or less, alternately 30 wt % or less, alternately 20 wt % or less, based on the total weight of the concentrate composition. Typically, one or more base oils are present in the concentrate composition at an amount of 0.1 to 49 mass %, alternately 5 to 40 mass %, alternately to 10 to 30 mass %, alternately 15 to 25 mass %, based upon the weight of the concentrate composition.

In the present disclosure, for the sake of clarity, any diluent used to dilute an active ingredient in a component of a lubricating oil composition or a component of a concentrate of the present invention is not considered to be referred to as a "base oil" in the sense of a separate component as described herein.

B. Dispersants

During engine operation, oil-insoluble oxidation byproducts are produced. Dispersants help keep these byproducts in solution, thus diminishing their deposition on metal surfaces. Dispersants used in the formulation of the lubricating compositions herein may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents tend to form ash upon combustion.

Dispersants useful herein typically contain a polar group attached to a relatively high molecular weight hydrocarbon chain. The polar group typically contains at least one element of nitrogen, oxygen, or phosphorus. Typical hydrocarbon chains contain 40 to 500, such as 50 to 400 carbon atoms.

Dispersants of (Poly)Alkenylsuccinic Derivatives

A particularly useful class of dispersants includes the (poly)alkenylsuccinic derivatives, typically produced by the reaction of a long chain hydrocarbyl-substituted succinic compound, usually a hydrocarbyl-substituted succinic anhydride, with a polyhydroxy or polyamino compound. The long chain hydrocarbyl group constituting the oleophilic portion of the molecule which confers solubility in the oil, is often a polyisobutylene group (typically the long chain hydrocarbyl group, such as a polyisobutylene group, has an Mn of 400 to 3000 g/mol, such as 450 to 2500 g/mol). Many examples of this type of dispersant are well known commercially and in the literature. Exemplary US Patents describing such dispersants include U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersants are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants useful herein may be found, for example, in European Patent Applications Nos. 0 471 071 and 0 451 380, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid or anhydride compound (typically having at least 25 carbon atoms, such as 28 to 400 carbon atoms, in the hydrocarbon substituent), with at least one equivalent of a polyhydroxy or polyamino compound (such as an alkylene amine) are particularly useful herein. Hydrocarbyl-substituted succinic acid and hydrocarbyl-substituted succinic anhydride derivatives may have a number average molecular weight of at least 400 g/mol, such as at least 900 g/mol, such as at least 1500 g/mol, such as from 400 to 4000 g/mol, such as from 800 to 3000, such as from 2000 to 2800 g/mol, such from about 2100 to 2500 g/mol, and such as from about 2200 to about 2400 g/mol.

Succinimides, which are particularly useful herein, are formed by the condensation reaction between: 1) hydrocarbyl-substituted succinic anhydrides, such as polyisobutylene succinic anhydride (PIBSA); and 2) polyamine (PAM). Examples of suitable polyamines include: polyhydrocarbyl polyamines, polyalkylene polyamines, hydroxy-substituted polyamines, polyoxyalkylene polyamines, and combinations thereof. Examples of polyamines include tetraethylene pentamine, pentaethylene hexamine, tetraethylenepentamine (TEPA), pentaethylenehaxamine (PEHA), N-phenyl-p-phenylenediamine (ADPA), and other polyamines having an average of 5, 6, 7, 8, or 9 nitrogen atoms per molecule. Mixtures where the average number of nitrogen atoms per polyamine molecule is greater than 7 are commonly called heavy polyamines or H-PAMs and may be commercially available under trade names such as HPA™ and HPA-X™ from DowChemical, E-100™ from Huntsman Chemical, et al. Examples of hydroxy-substituted polyamines include N-hydroxyalkyl-alkylene polyamines such as N-(2-hydroxyethyl)ethylene diamine, N-(2-hydroxyethyl)piperazine, and/or N-hydroxyalkylated alkylene diamines of the type described, for example, in U.S. Pat. No. 4,873,009. Examples of polyoxyalkylene polyamines include polyoxyethylene and/or polyoxypropylene diamines and triamines (as well as co-oligomers thereof) having an average Mn from about 200 to about 5000 g/mol. Products of this type are commercially available under the tradename Jeffamine™. Representative examples of useful succinimides are shown in U.S. Pat. Nos. 3,087,936; 3,172,892; 3,219,666;

3,272,746; 3,322,670; 3,652,616; 3,948,800; and 6,821,307; and CA Patent No. 1,094,044.

The dispersants may comprise one or more, optionally borated, higher molecular weight (Mn 1600 g/mol or more, such as 1800 to 3000 g/mol) succinimides and one or more, optionally borated, lower molecular weight (Mn less than 1600 g/mol) succinimides, where the higher molecular weight may be 1600 to 3000 g/mol, such as 1700 to 2800 g/mol, such as 1800 to 2500 g/mol, such as 1850 to 2300 g/mol; and the lower molecular weight may be 600 to less than 1600 g/mol, such as 650 to 1500 g/mol, such as 700 to 1400 g/mol, such as 800 to 1300 g/mol, such as 850 to 1200 g/mol such as 900 to 1150 g/mol, such as 900 to 1000 g/mol. In certain embodiments, the higher molecular weight succinimide dispersant is present in the lubricating composition in an amount of from 0.5 to 10 wt %, or from 0.8 to 6 wt %, or from 1.0 to 5 wt %, or from 1.2 to 4 wt %, or from 1.5 to 3.0 wt %. In certain embodiments, the higher molecular weight succinimide dispersant is present in the lubricating composition in an amount of from 0.5 to 10 wt %, or from 0.8 to 6 wt %, or from 1.0 to 5 wt %, or from 1.2 to 4 wt %, or from 1.5 to 3.0 wt %; and the lower molecular weight succinimides dispersant may be present in the lubricating composition in an amount of from 0.5 to 10 wt %, or from 0.8 to 6 wt %, or from 1.0 to 5 wt %, or from 1.2 to 4 wt %, or from 1.5 to 3.0 wt %. The lower molecular weight succinimides may differ from the higher molecular weight succinimides, by 500 g/mol or more, such as by 750 g/mol or more, such as by 1000 g/mol or more, such as by 1200 g/mol or more, such as by 500 to 3000 g/mol, such as by 750 to 2000 g/mol, such as by 1000 to 1500 g/mol.

Succinate esters useful as dispersants include those formed by the condensation reaction between hydrocarbyl-substituted succinic anhydrides and alcohols or polyols. For example, the condensation product of a hydrocarbyl-substituted succinic anhydride and pentaerythritol is a useful dispersant.

Succinate ester amides useful herein are formed by a condensation reaction between hydrocarbyl-substituted succinic anhydrides and alkanol amines. Suitable alkanol amines include ethoxylated polyalkylpolyamines, propoxylated polyalkylpolyamines, and polyalkenylpolyamines such as polyethylene polyamines and/or propoxylated hexamethylenediamine. Representative examples are shown in U.S. Pat. No. 4,426,305.

Hydrocarbyl-substituted succinic anhydrides (such as PIBSA) esters of hydrocarbyl bridged aryloxy alcohols are also useful as dispersants herein. For information on such dispersants, please see U.S. Pat. No. 7,485,603, particularly, col 2, ln 65 to col 6, ln 22 and col 23, In 40 to col 26, ln 46. In particular, PIBSA esters of methylene-bridged naphthyloxy ethanol (i.e., 2-hydroxyethyl-1-naphthol ether (or hydroxy-terminated ethylene oxide oligomer ether of naphthol) are useful herein. In certain embodiments of the invention, the lubricating oil composition or concentrate comprises no or substantially no PIBSA esters of methylene-bridged naphthyloxy ethanol, such as less than 0.6 mass %, such as less than 0.4 mass %, such as less than 0.2 mass %, such as less than 0.1 mass % based on the total mass of the lubricant oil composition. In certain embodiments, the lubricating oil composition or concentrate is absent or substantially absent PIBSA esters of methylene-bridged naphthyloxy ethanol.

The molecular weight of the hydrocarbyl-substituted succinic anhydrides used in the preceding paragraphs will typically range from 350 to 4000 g/mol, such as 400 to 3000 g/mol, such as 450 to 2800 g/mol, such as 800 to 2500 g/mol. The above (poly)alkenylsuccinic derivatives can be post-reacted with various reagents such as sulfur, oxygen, formaldehyde, carboxylic acids such as oleic acid.

The above (poly)alkenylsuccinic derivatives, can also be post reacted with boron compounds such as boric acid, borate esters or highly borated dispersants, to form borated dispersants generally having from about 0.1 to about 5 moles of boron per mole of dispersant reaction product.

Dispersants useful herein include borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having an Mn of from about 300 to about 5000 g/mol, or from about 500 to about 3000 g/mol, or about 700 to about 2000 g/mol, or a mixture of such hydrocarbylene groups, often with high terminal vinylic groups.

The dispersants together may be present in the lubricant in an amount of 2 mass % to 20 mass %, such as 2 to 15 mass %, such as 2 to 10 mass %, such as 3 to 8 mass %, such as 4 to 6 mass %, such as 4.5 to 5.5 mass %, based on the total mass of the lubricating oil composition.

The boron-containing dispersant may be present at 0.01 wt % to 20 wt %, or 0.02 wt % to 15 wt %, or 0.04 wt % to 10 wt %, or 0.06 wt % to 5 wt %, or 0.08 wt % to 1 wt %, or 0.1 wt % to 0.5 wt %, based on the total mass of the lubricating composition.

The boron-containing dispersant may be present in an amount to deliver boron to the composition at 15 ppm to 2000 ppm, or 25 ppm to 1000 ppm, or 40 ppm to 600 ppm, or 45 ppm to 350 ppm, or 50 ppm to 150 ppm, or 60 ppm to 100 ppm.

The borated dispersant may be used in combination with non-borated dispersant and may be the same or different compound as the non-borated dispersant. In one embodiment, the lubricating composition may include one or more boron-containing dispersants and one or more non-borated dispersants, wherein the total amount of dispersant may be 2 mass % to 20 mass %, such as 2 to 15 mass %, such as 2 to 10 mass %, such as 3 to 8 mass %, such as 4 to 6 mass %, such as 4.5 to 5.5 mass %, based on the total mass of the lubricating oil composition and wherein the ratio of borated dispersant to non-borated dispersant may be up to 1:40 (weight:weight), or up to 1:30, or up to 1:20, such 1:10 to 1:30, or 1:15 to 1:20.

The dispersant(s) of the present invention comprise one or more unborated (and optionally one or more borated) poly (alkenyl)succinimides, where the polyalkyenyl is derived from polyisobutylene and the imide is derived from a polyamine ("PIBSA-PAM").

The dispersant may comprise one or more PIBSA-PAMs, where the PIB is derived from polyisobutylene having an Mn of from 600 to 5000, such as from 700 to 4000, such as from 800 to 3000, such as from 900 to 2500 g/mol and the polyamine is derived from hydrocarbyl-substituted polyamines, such as tetraethylene pentamine, pentaethylene hexamine, tetraethylenepentamine (TEPA), pentaethylenehaxamine (PEHA), N-phenyl-p-phenylenediamine (ADPA), and other polyamines having an average of 5, 6, 7, 8, or 9 nitrogen atoms per molecule). The dispersant may be borated, typically at levels of up to 4 mass % such as from 1 to 3 mass %. The dispersant may comprise one or more borated and one or more non-borated PIBSA-PAM's. The dispersant may comprise one or more borated PIBSA-PAM's derived from a PIB having an Mn of 700 to 1800 g/mol (such as 800 to 1500 g/mol) and one or more non-borated PIBSA-PAM's derived from a PIB having an Mn of more than 1800 to 5000 g/mol (such as 2000 to 3000 g/mol). The dispersant may comprise one or more non-borated PIBSA-PAM's derived from a PIB having an Mn of 700 to 1800 g/mol (such as 800 to 1500 g/mol) and one or more borated PIBSA-PAM's derived from a PIB having an Mn of more than 1800 to 5000 g/mol (such as 2000 to 3000 g/mol).

The dispersant may comprise PIBSA derived from a PIB having an Mn of 700 to 5000 g/mol (such as 800 to 3000 g/mol) and one or more borated or non-borated PIBSA-PAM's derived from a PIB having an Mn of 700 to 5000 g/mol.

The dispersant may comprise PIBSA derived from a PIB having an Mn of 700 to 5000 g/mol (such as 800 to 3000 g/mol) and one or more borated PIBSA-PAM's derived from a PIB having an Mn of 700 to 1800 g/mol (such as 800 to 1500 g/mol) and one or more non-borated PIBSA-PAM's derived from a PIB having an Mn of more than 1800 to 5000 g/mol (such as 2000 to 3000 g/mol). The dispersant may comprise PIBSA derived from a PIB having an Mn of 700 to 5000 g/mol (such as 800 to 3000 g/mol) one or more non-borated PIBSA-PAM's derived from a PIB having an Mn of 700 to 1800 g/mol (such as 800 to 1500 g/mol) and one or more borated PIBSA-PAM's derived from a PIB having an Mn of more than 1800 to 5000 g/mol (such as 2000 to 3000 g/mol).

The dispersant may comprise one or more borated or non-borated PIBSA-PAM's and one or more PIBSA-esters of hydrocarbyl bridged aryloxy alcohols. In certain embodiments, the dispersant comprises no or substantially no PIBSA-esters of hydrocarbyl bridged naphtyloxy alcohol, such as less than 0.6 mass %, such as less than 0.4 mass %, such as less than 0.2 mass %, such as less than 0.1 mass %, based on the total mass of the lubricant oil composition. In certain embodiments, the lubricating oil composition or concentrate comprises no or substantially no aromatic dispersant, such as less than 0.5 mass %, such as less than 0.2 mass %, such as less than 0.1 mass % aromatic dispersant based on the total mass of the lubricant oil composition.

The dispersant may comprise one or more borated and one or more non-borated PIBSA-PAM's. Preferably, the unborated and borated PIBSA-PAM(s) of the lubricating oil composition together are present in an amount of 2.5 to 10 mass %, such as 3 to 8 mass %, such as 3.5 to 6 mass %. In embodiments, the unborated and borated PIBSA-PAM(s) of the lubricating oil composition together are present in an amount of 2.0 to 6.00 mass %, such as 2.5 to 5.8 mass %, such as 3.0 to 5.5 mass %, such as 3.5 to 5.2 mass %, such as 4.0 to 5.0 mass %, such as 4.2 to 4.8 mass %, based on the total mass of the lubricating oil composition. Preferably, the one or more unborated PIBSA-PAM(s) are present in an amount of at least 2.0 mass %, such as 2.5 to 5.5 mass %, such as 3.5 to 5.0 mass %, such as 4.0 to 0.5 mass %, based on the total mass of the lubricating oil composition. Preferably, the one or more borated PIBSA-PAM(s) are present in an amount of 0.05-0.5 mass %, such as 0.1-0.4 mass %, such as 0.15-0.3 mass %, such as 0.2-0.25 mass %, based on the total mass of the lubricating oil composition.

The dispersant(s) may comprise one or more unborated PIBSA-PAM(s), where the polyalkenyl is derived from polyisobutylene having a Mn of 1600 g/mol or more (GPC-PS) ("high molecular weight PIBSA-PAM"), one or more unborated PIBSA-PAM(s), where the polyalkenyl is derived from polyisobutylene having a Mn of less than 1600 g/mol (GPC-PS) ("low molecular weight PIBSA-PAM"), and optionally one or more borated low and/or high molecular weight PIBSA-PAM(s), where the higher molecular weight may be 1600 to 3000 g/mol, such as 1700 to 2800 g/mol, such as 1800 to 2500 g/mol, such as 2000 to 2300 g/mol; and the lower molecular weight may be 600 to less than 1600 g/mol, such as 650 to 1500 g/mol, such as 700 to 1400 g/mol, such as 750 to 1300 g/mol, such as 800 to 1200 g/mol, such as 850 to 1150 g/mol, such as 900 to 1000 g/mol. The higher molecular weight PIBSA-PAM dispersant may be present in the lubricating composition in an amount of from 0.5 to 10 wt %, or 0.5 to 4 mass %, such as 1.0 to 3.5 mass %, such as 1.5 to 3.0 mass %, such as 2.0 to 2.5 mass % based on the total mass of the lubricating oil composition; and the lower molecular weight PIBSA-PAM dispersant may be present in the lubricating composition in an amount of from 0.5 to 4 mass %, such as 1 to 3 mass %, such as 1.8 to 2.5 mass % based on the total mass of the lubricating oil composition. Preferably, the one or more unborated PIBSA-PAM(s) of the lubricating oil compositions comprise one or more unborated high molecular weight PIBSA-PAM(s) in an amount of 0.5 to 4 mass %, such as 1.0 to 3.5 mass %, such as 1.5 to 3.0 mass %, such as 2.0 to 2.5 mass % based on the total mass of the lubricating oil composition. More preferably, the one or more unborated PIBSA-PAM(s) of the lubricating oil compositions comprise one or more unborated high molecular weight PIBSA-PAM(s) in an amount of 0.5 to 4 mass %, such as 1.0 to 3.5 mass %, such as 1.5 to 3.0 mass %, such as 2.0 to 2.5 mass % based on the total mass of the lubricating oil composition, and one or more unborated low molecular weight PIBSA-PAM(s) in an amount of 0.5 to 4 mass %, such as 1 to 3 mass %, such as 1.8 to 2.5 mass % based on the total mass of the lubricating oil composition. In particular embodiments, the dispersants used in the lubricating oil compositions and concentrates of the present invention comprise, in particular consist of, a first higher molecular weight PIBSA-PAM; and a second and third lower molecular weight PIBSA-PAM (optionally, one of which is borated), where preferably the ratio of the higher molecular weight PIBSA PAM to the lower molecular weight PIBSA-PAM's is about 1:1 to about 2:3. Preferably, the dispersants used in the lubricant oil compositions and concentrates of the present invention comprise, in particular consists of, a first PIBSA-PAM dispersant derived from an 1800 to 2500 Mn PIB; and a second and a third PIBSA-PAM dispersant derived from a PIB with an Mn less than 1600, where at least one of the second PIBSA-PAM dispersant and the third PIBSA-PAM dispersant is unborated (optionally, at least one of the second PIBSA-PAM dispersant and the third PIBSA-PAM dispersant is borated). More preferably, the dispersants used in the lubricant oil compositions and concentrates of the present invention comprise, in particular consists of, a first unborated PIBSA-PAM dispersant derived from an 2200 Mn PIB; a second unborated PIBSA-PAM dispersant derived from a 950 Mn PIB; and a third unborated PIBSA-PAM dispersant derived from a 950 Mn PIB.

In particular, it has been found that a specific ratio of unborated PIBSA-PAM(s) to soap provides advantageous anti-wear properties of lubricating oil compositions, in particular lubricating oil compositions with less than 1000 ppm, such as 700 ppm to 900 ppm phosphorus. Thus, preferably the one or more unborated PIBSA-PAM(s) of the lubricating oil composition of the present invention is present in an amount so that the ratio of mass %, based on the total mass of the lubricating oil composition, of the one or more unborated PIBSA-PAM(s) to soap of the lubricating oil composition is from 7.0 to 15.0, such as from 7.2 to 13.0, such as from 7.4 to 11.0, such as from 7.6 to 10.0, such as from 7.8 to 9.0, such as from 8.0 to 8.5.

In certain embodiments, the ratio of mass %, based on the total mass of the lubricating oil composition, of the one or more unborated high molecular weight PIBSA-PAM(s) to the one or more unborated low molecular weight PIBSA-PAM(s) is less than 3.65, such as less than 3.5, such as less than 3.0, such as less than 2.5, such as less than 2.0, such as less than 1.5.

In certain embodiments, the one or more unborated low molecular weight PIBSA-PAM(s) are not derived from tetraethylenepentamine (TEPA). In certain embodiment, the one or more borated and unborated PIBSA-PAM(s) are derived from N-phenyl-p-phenylenediamine (ADPA).

Dispersants of Mannich Bases

Mannich base dispersants useful herein are typically made from the reaction of an amine component, a hydroxy aromatic compound (substituted or unsubstituted, such as alkyl substituted), such as alkylphenols, and an aldehyde, such as formaldehyde. See U.S. Pat. Nos. 4,767,551 and 10,899,986. Process aids and catalysts, such as oleic acid and sulfonic acids, can also be part of the reaction mixture. Representative examples are shown in U.S. Pat. Nos. 3,697,574; 3,703,536; 3,704,308; 3,751,365; 3,756,953; 3,798,165; 3,803,039; 4,231,759; 9,938,479; 7,491,248; and 10,899,986, and PCT Publication No. WO 01/42399.

Dispersants of Polymethacrylate or Polyacrylate Derivatives

Polymethacrylate or polyacrylate derivatives are another class of dispersants useful herein. These dispersants are typically prepared by reacting a nitrogen-containing monomer and a methacrylic or acrylic acid esters containing 5-25 carbon atoms in the ester group. Representative examples are shown in U.S. Pat. Nos. 2,100,993, and 6,323,164. Polymethacrylate and polyacrylate dispersants are typically lower molecular weights.

In particular embodiments, the dispersant(s) used in the lubricant oil compositions and additive concentrates of the present invention is absent Mannich base dispersants and/or poly(meth)acrylate dispersants.

The lubricating composition of the disclosure typically comprises dispersant at 0.1 mass % to 20 mass % of the composition, such as 0.2 to 15 mass %, such as 0.25 to 10 mass %, such as 0.3 to 5 mass %, such as 2.0 mass % to 4.0 mass % of the lubricating oil composition. Alternately the dispersant may be present at 0.1 wt % to 5 wt %, or 0.01 wt % to 4 wt % of the lubricating composition.

For further information on dispersants useful herein, please see U.S. Pat. No. 10,829,712, col 13, ln 36 to col 16, ln 67 and U.S. Pat. No. 7,485,603, col 2, ln 65 to col 6, ln 22, col 8, ln 25 to col 14, ln 53, and col 23, ln 40 to col 26, ln 46.

Compositions according to the present disclosure may contain an additive having a different enumerated function that also has secondary effects as a dispersant (for example, the functionalized polymer(s) P), in particular the amide, imide, and/or ester functionalized polymer comprising a partially or fully saturated polymer backbone comprising $C_{4-5}$ olefins as described herein below as functionalized polymer(s), may also have dispersant effects). These additives are not included as dispersants for purposes of determining the amount of dispersant in a lubricating oil composition or concentrate herein.

C. Detergents

The lubricating composition may comprise one or more metal detergents (such as blends of metal detergents) also referred to as a "detergent additive(s)." Metal detergents typically function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number ("TBN" as measured by ASTM D2896) of up to 150 mgKOH/g, such as from 0 to 80 (or 5-30) mgKOH/g. A large amount of a metal base may be incorporated by reacting excess metal compound (e.g., an oxide or hydroxide) with an acidic gas (e.g., carbon dioxide). Such detergents, sometimes referred to as overbased, may have a TBN of 100 mgKOH/g or more (such as 200 mgKOH/g or more), and typically will have a TBN of 250 mgKOH/g or more, such as 300 mgKOH/g or more, such as from 150 to 800 mgKOH/g, 200 to 700 mgKOH/g, 225 to 600 mgKOH/g, such as 275 to 500 mgKOH/g, such as 300 to 450 mgKOH/g. Preferably, the detergent(s) of the present disclosure are overbased detergents, more preferably detergent(s) having a TBN of 100 mgKOH/g or more, such as 200 mgKOH/g or more, such as 250 mgKOH/g or more, such as 300 mgKOH/g or more, such as from 150 to 800 mgKOH/g, 200 to 700 mgKOH/g, 225 to 600 mgKOH/g, such as 275 to 500 mgKOH/g, such as 300 to 450 mgKOH/g.

Suitable detergents include, oil-soluble neutral and overbased sulfonates, phenates, sulfurized phenates, thiophosphonates, salicylates, naphthenates and other oil-soluble carboxylates of a metal, particularly the alkali metals (Group 1 metals, e.g., Li, Na, K, Rb) or alkaline earth metals (Group 2 metals, e.g., Be, Mg, Ca, Sr, Ba), particularly, sodium, potassium, lithium, calcium, and magnesium, such as Ca and/or Mg. Furthermore, the detergent may comprise a hybrid detergent comprising any combination of sodium, potassium, lithium, calcium, or magnesium salts of sulfonates, phenates, sulfurized phenates, thiophosphonates, salicylates, naphthenates and/or other oil-soluble carboxylates of a Group 1 and/or 2 metal.

The overbased metal-containing detergent may be sodium salts, calcium salts, magnesium salts, or mixtures thereof of the phenates, sulfur-containing phenates, sulfonates, salixarates, and salicylates. Overbased phenates and salicylates typically have a total base number of 180 to 650 mgKOH/g, such as 200 to 450 TBN mgKOH/g. Overbased sulfonates typically have a total base number of 250 to 600 mgKOH/g, or 300 to 500 mgKOH/g. In embodiments, the sulfonate detergent may be predominantly a linear alkylbenzene sulfonate detergent having a metal ratio of at least 8 as is described in paragraphs [0026] to [0037] of US Patent Application Publication No. 2005/065045 (and granted as U.S. Pat. No. 7,407,919).

The one or more detergent(s) together may be present in an amount of 0 wt % to 15 wt %, or 0.1 wt % to 10 wt %, or 0.2 wt % to 8 wt %, or 0.2 wt % to 3 wt %, based upon the total mass of the lubricating composition. Preferably, the one or more detergent(s) of the present invention together are present in an amount of 0.1 to 4 mass %, such as 0.2 to 3 mass %, such as 0.4 to 2 mass %, such as 0.5 to 1.5 mass %, such as 0.8 to 1.2 mass % based on the total mass of the lubricating oil composition. For example, in a heavy-duty diesel engine, the detergent may be present at 0.8 wt % to 1.2 wt % of the lubricating composition. For a passenger car engine, the detergent may, for example, be present at 0.2 wt % to 1 wt % of the lubricating composition. Preferably, the one or more detergent(s) useful in the present disclosure comprises calcium and/or magnesium metal salts. The detergent may be a calcium and/or magnesium carboxylate (e.g., salicylates), sulfonate, or phenate detergent. More preferably, the detergent(s) are selected from magnesium salicylate, calcium salicylate, magnesium sulfonate, calcium sulfonate, magnesium phenate, calcium phenate, and hybrid detergents comprising two, three, four, or more of more of these detergents and/or combinations thereof. More preferably, the detergent(s) are selected from the group consisting of one or more calcium sulfonate(s), one or more magnesium sulfonate(s), one or more calcium salicylate(s), one or more magnesium salicylate(s), and combinations of two or more of these (including but not limited to combinations of calcium salicylate(s) and magnesium sulfonate(s)). Even more preferably, the detergent(s) are selected from the group consisting of one or more calcium sulfonate(s), one or more magnesium sulfonate(s), and mixtures thereof. Even more preferably, the detergent(s) are selected from the group consisting of calcium sulfonate, magnesium sulfonate, and a mixture. Particularly preferably, the detergent(s) are a mixture of calcium sulfonate and magnesium sulfonate.

The metal-containing detergent may also include "hybrid" detergents formed with mixed surfactant systems including phenate and/or sulfonate components, e.g., phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively. In certain embodiments, the lubricating oil composition of the present invention comprises no or substantially no phenate detergent, such as less than 0.5 mass %, such as less than 0.2 mass %, such as less than 0.1 mass % of the lubricant oil composition or the concentrate composition. In certain embodiments, phenate detergent is absent or is substantially absent in the lubricant oil composition or the concentrate of the present disclosure.

The detergent additive(s) may comprise one or more magnesium sulfonate detergents. The magnesium sulfonate may be a neutral salt or an overbased salt. Suitably, the magnesium sulfonate is an overbased magnesium sulfonate having a TBN of from 100 to 650 mgKOH/g (ASTM D2896), such as 200 to 500 mgKOH/g, such as 350 to 450 mgKOH/g.

Alternately, the detergent additive(s) may comprise a calcium sulfonate. The calcium sulfonate may be a neutral salt or an overbased salt. Suitably, the calcium sulfonate is an overbased calcium sulfonate having a TBN of from 100 to 650 mgKOH/g (ASTM D2896), such as 150 to 500 mgKOH/g, such as 200 to 400 mgKOH/g, such as 250 to 350 mgKOH/g.

In certain embodiments, the detergent(s) comprise 50 mass % or less, such as less than 50 mass %, such as less than 40 mass %, such as less than 30 mass %, such as less than 20 mass %, such as less than 10 mass %, of calcium salicylate based on the total mass of detergent(s) present in the lubricating oil composition or the concentrate.

Preferably, the detergent additive(s) is a combination of calcium sulfonate and magnesium sulfonate. More preferably, the calcium sulfonate has a TBN of from 100 to 650 mgKOH/g (ASTM D2896), such as 150 to 500 mgKOH/g, such as 200 to 400 mgKOH/g, such as 250 to 350 mgKOH/g, and the magnesium sulfonate has a TBN of from 100 to 650 mgKOH/g (ASTM D2896), such as 200 to 500 mgKOH/g, such as 350 to 450 mgKOH/g.

In certain embodiments, the magnesium detergent provides the lubricating composition thereof with from 200-4000 ppm of magnesium atoms, suitably from 200-2000 ppm, from 300 to 1500, from 450-1200 ppm, from 500-1000 ppm, from 600 to 900 ppm, or from 700 to 800 ppm, of magnesium atoms (ASTM D5185).

The detergent may comprise one or more calcium detergents such as calcium carboxylate (e.g., salicylate), sulfonate, or phenate detergent.

Suitably the calcium detergent has a TBN of from 30 to 700 mgKOH/g (ASTM D2896), such as 50 to 650 mgKOH/g, such as 200 to 500 mgKOH/g, such as 240 to 450 mgKOH/g or alternately of 150 mgKOH/g or less, such as 100 mgKOH/g or less, or 200 mgKOH/g or more, or 300 mgKOH/g or more, or 350 mgKOH/g or more.

Suitably, the calcium detergent is a calcium salicylate, sulfonate, or phenate having a TBN of from 30 to 700 mgKOH/g, 30 to 650 mgKOH/g (ASTM D2896), such as 50 to 650 mgKOH/g, such as 200 to 500 mgKOH/g, such as 240 to 450 mgKOH/g or alternately of 150 mgKOH/g or less, such as 100 mgKOH/g or less, or 200 mgKOH/g or more, or 300 mgKOH/g or more, or 350 mgKOH/g or more.

Calcium detergent(s) is typically present in amount sufficient to provide at least 500 ppm, preferably at least 750, more preferably at least 900 ppm, more preferably at least 1000 ppm, atomic calcium to the lubricating oil composition (ASTM D5185). If present, the calcium detergent(s) is suitably present in amount sufficient to provide no more than 4000 ppm, preferably no more than 3000 ppm, more preferably no more than 2000 ppm, more preferably no more than 1500 ppm, atomic calcium to the lubricating oil composition (ASTM D5185). If present, the calcium detergent(s) is suitably present in amount sufficient to provide from 500-4000 ppm, preferably from 750-3000 ppm, more preferably from 900-2000 ppm, more preferably from 1000 to 1500 ppm, atomic calcium to the lubricating oil composition (ASTM D5185).

Suitably the total atomic amount of metal from detergent in the lubrication composition according to all aspects of the disclosure is no more than 5000 ppm, preferably no more than 3000 μm and more preferably no more than 2500 ppm (ASTM D5185). The total amount of atomic metal from detergent in the lubrication oil composition according to all aspects of the disclosure is suitably at least 500 ppm, preferably at least 1000 ppm and more preferably at least 1500 ppm (ASTM D5185). The total amount of atomic metal from detergent in the lubrication oil composition according to all aspects of the disclosure is suitably from 500 to 5000 ppm, preferably from 1000 to 3000 ppm and more preferably from 1500 to 2500 ppm (ASTM D5185).

Sulfonate detergents may be prepared from sulfonic acids which are typically obtained by the sulfonation of alkyl substituted aromatic hydrocarbons, such as those obtained from the fractionation of petroleum or by the alkylation of aromatic hydrocarbons. Examples include those obtained by alkylating benzene, toluene, xylene, naphthalene, diphenyl, or their halogen derivatives such as chlorobenzene, chlorotoluene, and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety. The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product, but typically ranges from about 100 to 220 mass % (preferably at least 125 mass %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur-containing compound such as hydrogen sulfide, sulfur monohalide, or sulfur dihalide, to form products which are generally mixtures of compounds in which 2 or more phenols are bridged by sulfur-containing bridges.

Carboxylate detergents, e.g., salicylates, can be prepared by reacting an aromatic carboxylic acid (such as a $C_{5-100}$, $C_{9-30}$, $C_{14-24}$ alkyl-substituted hydroxy-benzoic acid) with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example, benzene is a preferred moiety. The aromatic carboxylic acid may contain one or more aromatic moieties, such as one or more benzene rings, either fused or connected via alkylene bridges.

Preferred substituents in oil-soluble salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

Further, metal organic and inorganic base salts, which are used as detergents, can contribute to the sulfated ash content of a lubricating oil composition, in embodiments of the present disclosure, the amounts of such additives are minimized. In order to maintain a low sulfur level, salicylate detergents can be used and the lubricating composition herein may comprise one or more salicylate detergents (said detergents are preferably used in amounts in the range of 0.05 to 20.0 wt %, more preferably from 1.0 to 10.0 wt % and most preferably in the range of from 2.0 to 5.0 wt %, based on the total weight of the lubricating composition).

The total sulfated ash (SASH) content of the lubricating composition herein is typically not greater than 2.0 wt %, alternately not greater than 1.0 wt %, alternately not greater than 0.9 wt %, and alternately not greater than 0.85 wt %, based on the total weight of the lubricating composition as determined by ASTM D874.

Furthermore, it is useful that each of the detergents, independently, have a TBN (total base number) value in the range of from 10 to 700 mgKOH/g, alternately in the range of from 100 to 650 mgKOH/g, alternately in the range of from 150 to 600, alternately in the range of from 200 to 500 mgKOH/g, and alternately in the range of from 250 to 450 mgKOH/g, as measured by ISO 3771 or ASTM D2896.

Preferably, the one or more detergent(s) together are present in an amount to provide less than 0.8 mass %, such as less than 0.7 mass %, such as less than 0.6 mass %, such as less than 0.55 mass % of soap, based on the total mass of the lubricating oil composition. More preferably, the one or more detergent(s) together are present in an amount to provide from 0.2 to 0.8 mass %, such as 0.3 to 0.7 mass %, such as 0.4 to 0.6 mass %, such as 0.45 to 0.55 mass % of soap, based on the total mass of the lubricating oil composition.

In particular embodiments, the sulfonate detergents (such as Ca and/or Mg sulfonate detergents) may be present in an amount to provide from 0.2 to 0.8 mass %, such as 0.3 to 0.7 mass %, such as 0.4 to 0.6 mass %, such as 0.45 to 0.55 mass % of sulfonate soap, based on the total mass of the lubricating oil composition.

Alternately, salicylate detergents (such as Ca and/or Mg salicylate detergents) may be present in an amount to provide from 0.2 to 0.8 mass %, such as 0.3 to 0.7 mass %, such as 0.4 to 0.6 mass %, such as 0.45 to 0.55 mass % of soap, based on the total mass of the lubricating oil composition.

Alternately, the sulfonate soap may be present in an amount of 0.1 wt % to 0.8 wt % of the lubricant composition, and the salicylate soap may be present in an amount 0.1 wt % to 0.8 wt % of the lubricant composition.

Typically, lubricating compositions formulated for use in heavy-duty diesel engines comprise detergents in an amount of 0.1 to 4 mass %, such as 0.2 to 3 mass %, such as 0.4 to 2 mass %, such as 0.5 to 1.5 mass %, such as 0.8 to 1.2 mass % based on the total mass of the lubricating oil composition. Preferably, lubricating compositions formulated for use in heavy-duty diesel engines comprise detergents in an amount to provide less than 0.8 mass %, such as less than 0.7 mass %, such as less than 0.6 mass %, such as less than 0.55 mass % of soap, based on the total mass of the lubricating oil composition; more preferably from 0.2 to 0.8 mass %, such as 0.3 to 0.7 mass %, such as 0.4 to 0.6 mass %, such as 0.45 to 0.55 mass % of soap, based on the total mass of the lubricating oil composition.

In particular embodiments, the lubricating oil compositions and concentrates of the present invention are absent phenate detergent and/or absent salicylate detergent. Preferably, the lubricating oil compositions and additive concentrates of the present invention comprise no or substantially no phenate detergent, such as less than 1.2 mass %, such as less than 1.0 mass %, such as less than 0.5 mass % based on the total mass of the lubricating oil composition or additive concentrate, and/or no or substantially no salicylate detergent, such as less than 1.2 mass %, such as less than 1.0 mass %, such as less than 0.5 mass % based on the total mass of the lubricating oil composition or additive concentrate. More preferably, the detergent(s) used in the lubricating oil compositions and additive concentrates of the present invention is, in particular consists of, a mixture of calcium sulfonate and magnesium sulfonate.

The lubricating oil composition and concentrate according to the present disclosure may further comprise one or more additives such as friction modifiers, antioxidants, pour point depressants, anti-foam agents, viscosity modifiers, corrosion inhibitors, anti-wear agents, extreme pressure additives, demulsifiers, seal compatibility agents, additive diluent base oils, functionalized polymer(s) etc. Specific examples of such additives are described in, for example, Kirk-Othmer Encyclopedia of Chemical Technology, third edition, volume 14, pp. 477-526, and several are discussed in further detail below.

D. Friction Modifiers

A friction modifier is any material or materials that can alter the coefficient of friction of a surface lubricated by any lubricant or fluid-containing such material(s). Friction modifiers, also known as friction reducers, or lubricity agents or oiliness agents, and other such agents that change the ability of base oils, formulated lubricating compositions, or functional fluids, to modify the coefficient of friction of a lubricated surface may be effectively used in combination with the base oils or lubricating compositions of the present disclosure if desired. Friction modifiers that lower the coefficient of friction are particularly advantageous in combination with the base oils and lubricating compositions of this disclosure.

Illustrative friction modifiers may include, for example, organometallic compounds or materials, or mixtures thereof. Illustrative organometallic friction modifiers useful in the lubricating oil formulations of this disclosure include, for example, tungsten and/or molybdenum compounds, such as molybdenum amine, molybdenum diamine, an organotungstenate, a molybdenum dithiocarbamate, molybdenum dithiophosphates, molybdenum amine complexes, molybdenum carboxylates, and the like, and mixtures thereof. Examples of useful molybdenum-containing compounds may conveniently include molybdenum dithiocarbamates, trinuclear molybdenum compounds, for example, as described in PCT Publication No. WO 98/26030, sulfides of molybdenum and molybdenum dithiophosphate.

Other known friction modifiers comprise oil-soluble organo-molybdenum compounds. Such organo-molybdenum friction modifiers may also provide antioxidant and antiwear credits to a lubricating oil composition. Examples of such oil-soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D664 or D2896 titration procedure and are typically hexavalent. Included are molybdic acid, ammonium molybdate, sodium molybdate, potassium molybdate, and other alkali metal molybdates and other molybdenum salts, e.g., hydrogen sodium molybdate, $MoOC_{14}$, $MoO_2Br_2$, $Mo_2O_3C_{16}$, molybdenum trioxide or similar acidic molybdenum compounds.

Among the molybdenum compounds useful in the compositions of this disclosure are organo-molybdenum compounds of the formula $Mo(R''OCS_2)_4$ and $Mo(R''SCS_2)_4$, wherein R" is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this disclosure are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 to 7, Q is selected from the group of neutral electron-donating compounds such as water, amines, alcohols, phosphines, and ethers, and z ranges from 0 to 5 and includes non-stoichiometric values. At least 21 carbon atoms should be present among all the ligand/organo groups, such as at least 25, at least 30, or at least 35, carbon atoms.

In certain embodiments of the present invention, the friction modifier is an inorganic or organometallic molybdenum compound. In certain embodiments the friction modifier is a molybdenum dialkyldithiocarbamate. In certain embodiments the friction modifier is a trinuclear molybdenum compound.

In certain embodiments, the lubricating oil compositions of the present disclosure contain at least 10 ppm, at least 30 ppm, at least 40 ppm and more preferably at least 50 ppm or at least 60 ppm molybdenum (measured as atoms of molybdenum). In certain other embodiments, the lubricating oil composition comprises no or substantially no molybdenum (Mo), such as less than 60 ppm, such as less than 50 ppm, such as less than 40 ppm of Mo.

For more information or useful friction modifiers containing Mo, please see U.S. Pat. No. 10,829,712 (col 8, ln 58 to col 11, In 31).

Ashless friction modifiers may be present in the lubricating oil compositions of the present disclosure and are known generally and include esters formed by reacting carboxylic acids and anhydrides with alkanols and amine-based friction modifiers. Other useful friction modifiers generally include a polar terminal group (e.g., carboxyl or hydroxyl) covalently bonded to an oleophilic hydrocarbon chain. Esters of carboxylic acids and anhydrides with alkanols are described in U.S. Pat. No. 4,702,850. Examples of other conventional organic friction modifiers are described by M. Belzer in the "Journal of Tribology" (1992), Vol. 114, pp. 675-682 and M. Belzer and S. Jahanmir in "Lubrication Science" (1988), Vol. 1, pp. 3-26. Typically, the total amount of organic ashless friction modifier in a lubricant according to the present disclosure does not exceed 5 mass %, based on the total mass of the lubricating oil composition and preferably does not exceed 2 mass % and more preferably does not exceed 0.5 mass %.

Illustrative friction modifiers useful in the lubricating compositions described herein include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isostearate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol monooleate, saturated mono-, di-, and tri-glyceride esters, glycerol monostearate, and the like. These can include polyol esters, hydroxyl-containing polyol esters, and the like. In certain embodiments of the present invention the friction modifier is an organic ashless friction modifier, particularly glycerol monooleate.

Illustrative borated glycerol fatty acid esters include, for example, borated glycerol monooleate, borated saturated mono-, di-, and tri-glyceride esters, borated glycerol monostearate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol di-oleates, glycerol tri-oleates, glycerol monoleates, glycerol di-stearates, and glycerol tri-stearates and the corresponding glycerol mono-palmitates, glycerol di-palmitates, and glycerol tri-palmitates, and the respective isostearates, linoleates, and the like. Ethoxylated, propoxylated, and/or butoxylated fatty acid esters of polyols, especially using glycerol as underlying polyol are useful herein.

Illustrative fatty alcohol ethers include, for example, stearyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can preferably be stearyl, myristyl, $C_1$-$C_{13}$ hydrocarbon, oleyl, isosteryl, and the like.

Useful concentrations of friction modifiers, if present, may range from 0.01 wt % to 5 wt %, or about 0.01 wt % to about 2.5 wt %, or about 0.02 wt % to about 1.5 wt %, or about 0.03 wt % to about 1.0 wt %, or about 0.04 wt % to about 0.5 wt %, or about 0.05 wt % to about 0.2 wt %. Concentrations of molybdenum (Mo)-containing materials are often described in terms of Mo metal concentration. Advantageous concentrations of Mo in the lubricant oil composition may range from 25 ppm to 700 ppm or more, and often with a preferred range of 50-200 ppm. Friction modifiers of all types may be used alone or in mixtures with the materials of this disclosure. Often mixtures of two or more friction modifiers, or mixtures of friction modifier(s) with alternate surface-active material(s), are also desirable. For example, combinations of Mo-containing compounds with polyol fatty acid esters, such as glycerol mono-oleate are useful herein.

E. Antioxidants

Antioxidants retard the oxidative degradation of base oils during service. Such degradation may result in deposits on metal surfaces, the presence of sludge, a viscosity increase in a lubricant, and the like. A wide variety of oxidation inhibitors that are useful in lubricating oil compositions. See Lubricants and Related Products, Klamann, Wiley VCH, 1984; U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics, which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_{6+}$ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include, for example, hindered 2,6-di-alkyl-phenolic proprionic ester derivatives. Bis-phenolic antioxidants may also be advantageously used herein. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include, for example, 4,4'-bis (2,6-di-t-butyl-phenol) and 4,4'-methylene-bis(2,6-di-t-butyl-phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants useful herein are more fully described in U.S. Pat. No. 8,048,833.

Non-phenolic oxidation inhibitors, which may be used include aromatic amine antioxidants and these may be used either as such or in combination with phenolics. Typical examples of non-phenolic antioxidants include: alkylated and non-alkylated aromatic amines such as aromatic monoamines of the formula $R_8R_9R_{10}N$, where $R_8$ is an aliphatic, aromatic or substituted aromatic group, $R_9$ is an aromatic or a substituted aromatic group, and $R_{10}$ is H, alkyl, aryl or $R_{11}S(O)XR_{12}$ where $R_{11}$ is an alkylene, alkenylene, or aralkylene group, $R_{12}$ is an alkyl group, or an alkenyl, aryl, or alkaryl group, and x is 0, 1, or 2. The aliphatic group $R_8$ may contain from 1 to about 20 carbon atoms, and preferably contains from about 6 to 12 carbon atoms. The aliphatic group is typically a saturated aliphatic group. Preferably, both $R_8$ and $R_9$ are aromatic or substituted aromatic groups, and the aromatic group may be a fused ring aromatic group such as naphthyl. Aromatic groups $R_8$ and $R_9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alpha-naphthylamine; and p-octylphenyl-alpha-naphthylamine.

Sulfur-containing antioxidants are also useful herein. In particular, one or more oil-soluble or oil-dispersible sulfur-containing antioxidant(s) can be used as an antioxidant additive. For example, sulfurized alkyl phenols and alkali or alkaline earth metal salts thereof also are useful antioxidants herein. Suitably, the lubricating oil composition(s) of the present disclosure may include the one or more sulfur-containing antioxidant(s) in an amount to provide the lubricating oil composition with from 0.02 to 0.2, preferably from 0.02 to 0.15, even more preferably 0.02 to 0.1, even more preferably 0.04 to 0.1 mass % sulfur based on the total mass of the lubricating oil composition. Optionally the oil-soluble or oil-dispersible sulfur-containing antioxidant(s) are selected from sulfurized $C_4$ to $C_{25}$ olefin(s), sulfurized aliphatic ($C_7$ to $C_{29}$) hydrocarbyl fatty acid ester(s), ashless sulfurized phenolic antioxidant(s), sulfur-containing organo-molybdenum compound(s), and combinations thereof. For further information, on sulfurized materials useful as antioxidants herein, please see U.S. Pat. No. 10,731,101 (col 15, ln 55 to col 22, ln 12).

Further typical antioxidants include: Irganox™ L67, Ethanox™ 4702, Lanxess Additin™ RC 7110; Ethanox™ 4782J; Irganox™ 1135, Irganox™ 5057, sulfurized lard oil, rapeseed oil, and palm oil fatty acid methyl ester.

Antioxidants useful herein include sulphurized methyl ester antioxidant, such as sulfurized rapeseed oil fatty acid methyl ester, hindered phenols, and/or arylamines. In certain embodiments, the antioxidants useful herein are selected from sulphurized methyl ester antioxidant, such as sulfurized rapeseed oil fatty acid methyl ester, and/or arylamines. These antioxidants may be used individually by type or in combination with one another. In particular embodiments, the antioxidants used in the lubricating oil compositions and concentrates of the present invention comprise, in particular consist of, alkylated diphenylamine antioxidant and sulphurized methyl ester antioxidant, such as sulfurized rapeseed oil fatty acid methyl ester.

Antioxidant additives may be used in an amount of about 0.01 to 10 mass %, alternately 0.05 to 5 wt %, alternately 0.1 to 4.5 mass %, alternately 0.5 to 4 wt %, alternately 1 to 3.5 wt %, alternately 2.5 to 3.5 wt %, based upon the weight of the lubricating composition.

Compositions according to the present disclosure may contain an additive having a different enumerated function that also has secondary effects as an antioxidant (for example, phosphorus-containing antiwear agents (such as ZDDP) may also have antioxidant effects). These additives are not included as antioxidants for purposes of determining the amount of antioxidant in a lubricating oil composition or concentrate herein.

F. Pour Point Depressants

Conventional pour point depressants (also known as lube oil flow improvers) may be added to the compositions of the present disclosure if desired. These pour point depressants may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 wt %, preferably about 0.01 to 1.5 wt %, based upon the weight of the lubricating composition.

G. Anti-Foam Agents

Anti-foam agents may advantageously be added to lubricant compositions described herein. These agents prevent or retard the formation of stable foams. Silicones and/organic polymers are typical anti-foam agents. For example, polysiloxanes, such as silicon oil or polydimethyl siloxane, provide anti-foam properties.

Anti-foam agents are commercially available and may be used in minor amounts such as 5 wt % or less, 3 wt % or less, 1 wt % or less, 0.1 wt % or less, such as from 0.001 wt % to 5 wt %, such as 0.002 to 3 mass %, such as 0.003 to 1 mass %, based on the total mass of the lubricating composition.

For example, it may be that the lubricating oil composition comprises an anti-foam agent comprising polyalkyl siloxane, such as a polydialkyl siloxane, for example, wherein the alkyl is a $C_1$-$C_{10}$ alkyl group, e.g., a polydimethylsiloxane (PDMS), also known as a silicone oil. Alternately, the siloxane is a poly($R^3$)siloxane, wherein $R^3$ is one or more same or different linear branched or cyclic hydrocarbyls, such as alkyls or aryls, typically having 1 to 20 carbon atoms. It may be that, for example, the lubricating oil composition comprises a polymeric siloxane compound according to Formula 1 below wherein $R^1$ and $R^2$ are independently methyl, ethyl, propyl, butyl, pentyl, hexyl, heptyl, octyl, nonyl or decyl, phenyl, naphthyl, alkyl substituted phenyl, or isomers thereof (such as methyl, phenyl) and n is from 2 to 1000, such as 50 to 450, alternately such as 40 to 100.

Additionally, or alternatively, it may be that the lubricating oil composition comprises an organo-modified siloxane (OMS), such as a siloxane modified with an organo group such as a polyether (e.g., ethylene-propyleneoxide copolymer), long chain hydrocarbyl (e.g., $C_{11}$-$C_{100}$ alkyl), or aryl (e.g., $C_6$-$C_{14}$ aryl). It may be that, for example, the lubricating oil composition comprises an organo-modified siloxane compound according to Formula 1, wherein n is from 2 to 2000, such as 50 to 450 (alternately such as 40 to 100), and wherein $R^1$ and $R^2$ are the same or different, optionally wherein each of $R^1$ and $R^2$ is, independently an organo group, such as an organo group selected from polyether (e.g., ethylene-propyleneoxide copolymer), long chain hydrocarbyl (e.g., $C_{11}$-$C_{100}$ alkyl), or aryl (e.g., $C_6$-$C_{14}$ aryl). Preferably, one of $R^1$ and $R^2$ is $CH_3$.

Formula 1

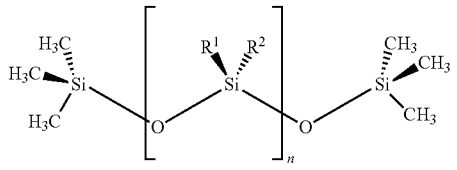

Based on the total weight of the lubricant composition, the siloxane according to Formula 1 is incorporated so as to provide about 0.1 to less than about 30 ppm Si, or about 0.1 to about 25 ppm Si, or about 0.1 to about 20 ppm Si, or about 0.1 to about 15 ppm Si, or about 0.1 to about 10 ppm Si. More preferably, it is in the range of about 3-10 ppm Si.

In embodiments, silicone anti-foam agents useful herein are available from Dow Corning Corporation and Union Carbide Corporation, such as Dow Corning FS-1265 (1000 centistokes), Dow Corning DC-200, and Union Carbide UC-L45. Silicone anti-foamants useful herein include polydimethylsiloxane, phenyl-methyl polysiloxane, linear, cyclic or branched siloxanes, silicone polymers and copolymers, and/organo-silicone copolymers. Also, a siloxane polyether copolymer Anti-foamant available from OSI Specialties, Inc. of Farmington Hills, Michigan and may be substituted or included. One such material is sold as SILWET-L-7220.

Acrylate polymer anti-foam agent can also be used herein. Typical acrylate anti-foamants include polyacrylate anti-foamant available from Monsanto Polymer Products Co. known as PC-1244. A preferred acrylate polymer anti-foam agent useful herein is PX™3841 (i.e., an alkyl acrylate polymer), commercially available from Dorf Ketl, also referred to as Mobilad™C402.

In embodiments, a combination of sililcone anti-foamant and acrylate anti-foamant can be used, such as at a weight ratio of the silicone anti-foamant to the acrylate anti-foamant of from about 5:1 to about 1:5, see, for example, US Patent Application Publication No. 2021/0189283.

H. Viscosity Modifiers

Viscosity modifiers (also referred to as viscosity index improvers or viscosity improvers) can be included in the lubricating compositions described herein. Viscosity modifiers provide lubricants with high and low temperature operability. These additives impart shear stability at elevated temperatures and acceptable viscosity at low temperatures. Suitable viscosity modifiers include high molecular weight hydrocarbons, polyesters, and viscosity modifier dispersants that can function as both a viscosity modifier and a dispersant. Typical molecular weights of these polymers are between about 10,000 to 1,500,000 g/mol, more typically about 20,000 to 1,200,000 g/mol, and even more typically between about 50,000 and 1,000,000 g/mol.

Examples of suitable viscosity modifiers are linear or star-shaped polymers and copolymers of methacrylate, butadiene, olefins, or alkylated styrenes. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 g/mol molecular weight.

Copolymers useful as viscosity modifiers include those commercially available from Chevron Oronite Company LLC under the trade designation "PARATONE™" (such as "PARATONE™ 8921," "PARATONE™ 68231," "PARATONE™ 24EX," and "PARATONE™ 8941"); from Afton Chemical Corporation under the trade designation "HiTEC™" (such as HiTEC™ 5850B); and from The Lubrizol Corporation under the trade designation "Lubrizol™ 7067C" and "Lubrizol™ 7077D". Hydrogenated polyisoprene star polymers useful as viscosity modifiers herein include those commercially available from Infineum International Limited, e.g., under the trade designation "SV203™", "SV200™", and "SV600™". Hydrogenated diene-styrene block copolymers useful as viscosity modifiers herein are commercially available from Infineum International Limited, e.g., under the trade designation "SV 50™".

Polymers useful as viscosity modifiers herein include polymethacrylate or polyacrylate polymers, such as linear polymethacrylate or polyacrylate polymers, such as those available from Evnoik Industries under the trade designation "Viscoplex™" (e.g., Viscoplex™ 6-954) or star polymers which are available from Lubrizol Corporation under the trade designation Asteric™ (e.g., Lubrizol™ 87708 and Lubrizol™ 87725).

Vinyl aromatic-containing polymers useful as viscosity modifiers herein may be derived from vinyl aromatic hydrocarbon monomers, such as styrenic monomers, such as styrene. Illustrative vinyl aromatic-containing copolymers useful herein may be represented by the following general formula: A-B wherein A is a polymeric block derived predominantly from vinyl aromatic hydrocarbon monomer (such as styrene), and B is a polymeric block derived predominantly from conjugated diene monomer (such as isoprene).

Vinyl aromatic-containing polymers useful as viscosity modifiers may have a Kinematic viscosity at 100° C. of 20 cSt or less, such as 15 cSt or less, such as 12 cSt or less, but may be diluted (such as in Group I, II, and/or III basestock) to higher Kinematic viscosities at 100° C., such as to 40 cSt or more, such as 100 cSt or more, such as 1000 cSt or more, such as 1000 to 2000 cSt.).

Typically, if present, the viscosity modifiers may be used in an amount of about 0.01 to about 13 wt %, such as about 0.1 to about 7 wt %, such as 0.1 to about 4 wt %, such as about 0.2 to about 2 wt %, such as about 0.2 to about 1 wt %, and such as about 0.2 to about 0.5 wt %, based on the total weight of the formulated lubricant composition.

Viscosity modifiers are typically added as concentrates, in large amounts of diluent oil. The "as delivered" viscosity modifier typically contains from 20 wt % to 75 wt % of an active polymer for polymethacrylate or polyacrylate polymers, or from 8 wt % to 20 wt % of an active polymer for olefin copolymers, hydrogenated polyisoprene star polymers, or hydrogenated diene-styrene block copolymers, in the "as delivered" polymer concentrate.

Compositions according to the present disclosure may contain an additive having a different enumerated function that also has secondary effects as viscosity modifier (for example, Component P) functionalized polymer(s), in particular the amide, imide, ester and/or alcohol functionalized polymers described below, may also have viscosity modifying effects). These additives are not included as viscosity modifiers for purposes of determining the amount of viscosity modifiers in a lubricating oil composition or concentrate herein.

J. Corrosion Inhibitors/Anti-Rust Agents

Corrosion inhibitors may be used to reduce the corrosion of metals and are often alternatively referred to as metal deactivators or metal passivators. Some corrosion inhibitors may alternatively be characterized as antioxidants.

Suitable corrosion inhibitors may include nitrogen and/or sulfur-containing heterocyclic compounds such as triazoles (e.g., benzotriazoles), substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines and derivatives of any one or more thereof. A particular corrosion inhibitor is a benzotriazole represented by the structure:

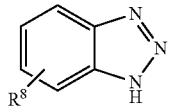

wherein $R^8$ is absent (hydrogen) or is a $C_1$ to $C_{20}$ hydrocarbyl or substituted hydrocarbyl group which may be linear or branched, saturated or unsaturated. It may contain ring structures that are alkyl or aromatic in nature and/or contain heteroatoms such as N, O, or S. Examples of suitable compounds may include benzotriazole, alkyl-substituted benzotriazoles (e.g., tolyltriazole, ethylbenzotriazole, hexylbenzotriazole, octylbenzotriazole, etc.), aryl substituted benzotriazole, alkylaryl- or arylalkyl-substituted benzotriazoles, and the like, as well as combinations thereof. For instance, the triazole may comprise or be a benzotriazole and/or an alkylbenzotriazole in which the alkyl group contains from 1 to about 20 carbon atoms or from 1 to about 8 carbon atoms. Non-limiting examples of such corrosion inhibitors may comprise or be benzotriazole, tolyltriazole, and/or optionally, substituted benzotriazoles such as Irgamet™ 39, which is commercially available from BASF of Ludwigshafen, Germany. A preferred corrosion inhibitor may comprise or be benzotriazole and/or tolyltriazole.

Additionally, or alternatively, the corrosion inhibitor may include one or more substituted thiadiazoles represented by the structure:

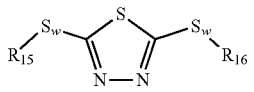

wherein $R_{15}$ and $R_{16}$ are independently hydrogen or a hydrocarbon group, which group may be aliphatic or aromatic, including cyclic, alicyclic, aralkyl, aryl and alkaryl, and wherein each w is independently 1, 2, 3, 4, 5, or 6 (preferably 2, 3, or 4, such as 2). These substituted thiadiazoles are derived from the 2,5-dimercapto-1,3,4-thiadiazole (DMTD) molecule. Many derivatives of DMTD have been described in the art, and any such compounds may be included in the fluid used in the present disclosure. For example, U.S. Pat. Nos. 2,719,125; 2,719,126; and 3,087,937; describe the preparation of various 2, 5-bis-(hydrocarbon dithio)-1, 3,4-thiadiazoles.

Further, additionally or alternatively, the corrosion inhibitor may include one or more other derivatives of DMTD, such as a carboxylic ester in which $R_{15}$ and $R_{16}$ may be joined to the sulfide sulfur atom through a carbonyl group. Preparation of these thioester-containing DMTD derivatives is described, for example, in U.S. Pat. No. 2,760,933. DMTD derivatives produced by condensation of DMTD with alpha-halogenated aliphatic carboxylic acids having at least 10 carbon atoms are described, for example, in U.S. Pat. No. 2,836,564. This process produces DMTD derivatives wherein $R_{15}$ and $R_{16}$ are HOOC—CH($R_{19}$)—($R_{19}$ being a hydrocarbyl group). DMTD derivatives further produced by amidation or esterification of these terminal carboxylic acid groups may also be useful.

The preparation of 2-hydrocarbyldithio-5-mercapto-1,3, 4-thiadiazoles is described, for example, in U.S. Pat. No. 3,663,561.

A class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC™ 4313 and are commercially available from Afton Chemical Company.

The preparation of 2-hydrocarbyldithio-5-mercapto-1,3, 4-thiadiazoles is described, for example, in U.S. Pat. No. 3,663,561.

A class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC™ 4313 and are commercially available from Afton Chemical Company.

Still further, additionally or alternatively, the corrosion inhibitor may include a trifunctional borate having the structure, $B(OR_{46})_3$, in which each $R_{46}$ may be the same or different. As the borate may typically be desirably compatible with the non-aqueous medium of the composition, each $R_{46}$ may, in particular, comprise or be a hydrocarbyl $C_1$-$C_8$ moiety. For compositions in which the non-aqueous medium comprises or is a lubricating oil basestock, for example, better compatibility can typically be achieved when the hydrocarbyl moieties are each at least $C_4$. Non-limiting examples of such corrosion inhibitors thus include, but are not limited to, triethylborate, tripropylborates such as triisopropylborate, tributylborates such as tri-tert-butylborate, tripentylborates, trihexylborates, trioctylborates such as tri-(2-ethylhexyl)borate, monohexyl dibutylborate, and the like, as well as combinations thereof.

When used, a corrosion inhibitor may comprise a substituted thiadiazole, a substituted benzotriazole, a substituted triazole, a trisubstituted borate, or a combination thereof.

When desired, corrosion inhibitors can be used in any effective amount, but, when used, may typically be used in amounts from about 0.001 wt % to 5.0 wt %, based on the weight of the composition, e.g., from 0.005 wt % to 3.0 wt % or from 0.01 wt % to 1.0 wt %. Alternately, such additives may be used in an amount of about 0.01 to 5 wt %, preferably about 0.05 to 1.5 wt %, based upon the weight of the lubricating composition.

In some embodiments, 3,4-oxypyridinone-containing compositions may contain substantially no (e.g., 0, or less than 0.001 wt %, 0.0005 wt % or less, not intentionally added, and/or absolutely no) triazoles, benzotriazoles, substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines, derivatives thereof, combinations thereof, or all corrosion inhibitors.

Compositions according to the present disclosure may contain an additive having a different enumerated function that also has secondary effects as a corrosion inhibitor (for example, Component P) Functionalized polymer(s) described below, may also have corrosion inhibitor effects). These additives are not included as corrosion inhibitor for purposes of determining the amount of corrosion inhibitor in a lubricating oil composition or concentrate herein.

K. Antiwear Agents

The lubricating oil composition of the present disclosure can contain one or more antiwear agents that can reduce friction and excessive wear. Any antiwear agent known by a person of ordinary skill in the art may be used in the lubricating oil composition. Non-limiting examples of suitable antiwear agents include zinc dithiophosphate, metal (e.g., Pb, Sb, Mo, and the like) salts of dithiophosphates, metal (e.g., Zn, Pb, Sb, Mo, and the like) salts of dithiocarbamates, metal (e.g., Zn, Pb, Sb, and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the antiwear agent may vary from about 0.01 wt % to about 5 wt %, from about 0.05 wt % to about 3 wt %, from about 0.1 wt % to about 2 wt %, from about 0.5 wt % to about 1 wt %, or from about 0.6 wt % to about 0.8 wt %, based on the total weight of the lubricating oil composition.

In embodiments, the antiwear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel, or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms. In further embodiments, the alkyl group is linear or branched.

Useful antiwear agents also include substituted or unsubstituted thiophosphoric acids, and salts thereof include zinc-containing compounds such as zinc dithiophosphate compounds selected from zinc dialkyl-, diaryl- and/or alkylaryl-dithiophosphates.

A metal alkylthiophosphate and more particularly a metal dialkyl dithio phosphate in which the metal constituent is zinc, or zinc dialkyl dithio phosphate (ZDDP) can be a useful component of the lubricating compositions of this disclosure. ZDDP can be derived from primary alcohols, secondary alcohols or mixtures thereof. ZDDP compounds generally are of the formula $Zn[SP(S)(OR_1)(OR_2)]_2$ where $R_1$ and $R_2$ are $C_1$-$C_{18}$ alkyl groups, preferably $C_2$-$C_{12}$ alkyl groups. These alkyl groups may be straight chain or branched. Alcohols used in the ZDDP can be 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be used. Alkyl aryl groups may also be used. Useful zinc dithiophosphates include secondary zinc dithiophosphates such as those available from The Lubrizol Corporation under the trade designations "LZ 677A", "LZ 1095" and "LZ 1371", from Chevron Oronite under the trade designation "OLOA™ 262" and from Afton Chemical under the trade designation "HiTEC™ 7169".

In embodiments, the zinc compound can be a zinc dithiocarbamate complex, such as the zinc dithiocarbamates represented by the formula:

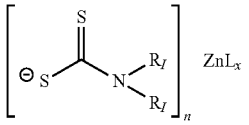

where each $R_1$ is independently a linear, cyclic, or branched, saturated or unsaturated, aliphatic hydrocarbon moiety having from 1 to about 10 carbon atoms, n is 0, 1, or 2, L is a ligand that saturates the coordination sphere of zinc, and x is 0, 1, 2, 3, or 4. In certain embodiments, the ligand, L, is selected from the group consisting of water, hydroxide, ammonia, amino, amido, alkylthiolate, halide, and combinations thereof.

The antiwear additives, such as ZDDP and/or the zinc carbamates, are typically used in amounts of from about 0.4 wt % to about 1.2 wt %, preferably from about 0.5 wt % to about 1.0 wt %, and more preferably from about 0.6 wt % to about 0.8 wt %, based on the total weight of the lubricating composition. Preferably, the antiwear additive is ZDDP, such as primary ZDDP, secondary ZDDP or a mixture of primary and secondary ZDDP, and is present in an amount of from 0.4 wt % to 1.2 wt %, preferably from 0.5 wt % to 1.0 wt %, and more preferably from 0.6 wt % to 0.8 wt %, based on the total weight of the lubricating composition. As indicated above, the lubricating oil composition of the present invention contains less than 1000 ppm phosphorus. Thus, the antiwear additive, preferably ZDDP, is present in an amount to provide less than 1000 ppm phosphorus, based on the total mass of the lubricating compositions, as measured by ASTM D5185. Preferably, the antiwear additive, preferably ZDDP, is present in an amount to provide less than 900 ppm phosphorus, such as less than 850 ppm phosphorus, based on the total mass of the lubricating compositions, as measured by ASTM D5185. More preferably, the antiwear additive, preferably ZDDP, is present in an amount to provide 700 ppm to 900 ppm phosphorus, based on the total mass of the lubricating compositions, as measured by ASTM D5185.

Antiwear additives useful herein also include boron-containing compounds, such as borate esters, borated fatty amines, borated epoxides, alkali metal (or mixed alkali metal or alkaline earth metal) borates and borated overbased metal salts.

Compositions according to the present disclosure may contain an additive having a different enumerated function that also has secondary effects as an antiwear agent (for example, Component B Dispersant(s) described above and Component P functionalized polymer(s) described below, may also have antiwear effects). These additives are not included as antiwear agents for purposes of determining the amount of antiwear agents in a lubricating oil composition or concentrate herein.

L. Demulsifiers

Demulsifiers useful herein include those described in U.S. Pat. No. 10,829,712 (col 20, ln 34-40). Typically, a small amount of a demulsifying component may be used herein. A preferred demulsifying component is described in European Patent No. 330 522. It is obtained by reacting an alkylene oxide with an adduct obtained by reacting a bis-epoxide with a polyhydric alcohol. Such additives may be used in an amount of about 0.001 to 5 wt %, preferably about 0.01 to 2 wt %.

M. Seal Compatibility Agents

Other optional additives include seal compatibility agents such as organic phosphates, aromatic esters, aromatic hydrocarbons, esters (butylbenzyl phthalate, for example), and polybutenyl succinic anhydride. Such additives may be used in an amount of about 0.001 to 5 wt %, preferably about 0.01 to 2 wt %, more preferably 0.05 to 1 wt %, more preferably 0.1 to 0.5 wt %. In embodiments the seal compatibility agents are sea swell agents, such as PIBSA (polyisobutenyl succinic anhydride).

N. Extreme Pressure Agents

The lubricating oil composition of the present disclosure can contain one or more extreme pressure agents that can prevent sliding metal surfaces from seizing under conditions of extreme pressure. Any extreme pressure agent known by a person of ordinary skill in the art may be used in the lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally substituted dihydrocarbyl polysulfides, thia-aldehydes, thia-ketones, epithio compounds, sulfur-containing acetal derivatives, co-sulfurized blends of terpene and acyclic olefins, and poly sulfide olefin products, amine salts of phosphoric acid esters or thiophosphoric acid esters, and combinations thereof. The amount of the extreme pressure agent may vary from about 0.01 wt % to about 5 wt %, from about 0.05 wt % to about 3 wt %, or from about 0.1 wt % to about 1 wt %, based on the total weight of the lubricating oil composition.

O. Non-Basestock Unsaturated Hydrocarbons

The lubricating oil composition of the present disclosure can contain one or more unsaturated hydrocarbons. These unsaturated hydrocarbons are distinct from any baseoils (lubricating oil basestocks of Group I, II, III, IV and/or V) and/or viscosity modifiers that may be present in the compositions and always have at least one (and typically only one, in the case of linear alpha-olefins, or LAOs) unsaturation per molecule. Without being bound by theory, the unsaturation(s) may provide an antioxidation functionality and/or a sulfur-trapping functionality that may supplement and/or replace one or more antioxidant additives and/or one or more corrosion inhibitor additives, but unsaturated hydrocarbons (LAOs) will typically not provide the only antioxidant nor the only corrosion inhibition functionality in lubrication oil compositions. Non-limiting examples of unsaturated hydrocarbons can include one or more unsaturated $C_{12}$-$C_{60}$ hydrocarbons (such as $C_{12}$-$C_{48}$ hydrocarbons, $C_{12}$-$C_{36}$ hydrocarbons, $C_{12}$-$C_{30}$ hydrocarbons, or $C_{12}$-$C_{24}$ hydrocarbons). When only one unsaturation is present, the unsaturated hydrocarbons may be termed linear alpha-olefins (LAOs). Other non-limiting examples of unsaturated hydrocarbons can include oligomers/polymers of polyisobutylenes that have retained (or been post-polymerization modified to exhibit) a (near-) terminal unsaturation, and/or blends thereof. When present, unsaturated hydrocarbons (LAOs) may be present from 0.01 to 5 wt % (in particular, 0.1 to 3 mass %, alternately 0.1 to 1.5 mass %), based on total weight of the lubricating oil composition.

P. Functionalized Polymer(s)

In embodiments, the lubricating oil composition or concentrate of the invention comprises one or more functionalized polymers. Suitable functionalized polymer(s) include functionalized polyolefins, for example, ethylene-propylene copolymers that have been functionalized with an acylating agent such as maleic anhydride and an amine; polymethacrylates functionalized with an amine, or esterified styrene-maleic anhydride copolymers reacted with an amine. More detailed description of functionalized polymer(s) are disclosed in WO 2006/015130 or U.S. Pat. Nos. 4,863,623; 6,107,257; 6,107,258; and 6,117,825. In embodiments, the functionalized polymer(s) may include those described in U.S. Pat. No. 4,863,623 (see column 2, line 15 to column 3, line 52) or in WO 2006/015130 (see page 2, paragraph [0008] and preparative examples are described at paragraphs [0065] to [0073]). Preferred functionalized polymer(s) include functionalized polymers described in U.S. patent application Ser. No. 18/480,571, filed Oct. 4, 2023 and U.S. Patent Application Ser. No. 63/379,006, filed Oct. 11, 2022, including but not limited to amide, imide, ester and/or alcohol functionalized partially or fully saturated polymer comprising $C_{4\ to\ 5}$ olefins having an Mw/Mn of less than 2, a functionality parameter of 1.4 to 15 per 10,000 g/mol and wherein the polymer prior functionalization has an Mn of 30,000 g/mol or more (GPC-polystyrene standards), such as an amine functionalized partially or fully saturated polyisoprene, where GPC-polystyrene standards, Mw/Mn, and functionality parameter are as described in U.S. patent application Ser. No. 18/480,571 filed Oct. 4, 2023 and U.S. Patent Application Ser. No. 63/379,006, filed Oct. 11, 2022, which are incorporated by reference herein.

In certain embodiments, the lubricating oil composition or concentrate comprises an amide, imide, and/or ester functionalized polymer comprising a partially or fully saturated polymer backbone comprising $C_{4\text{-}5}$ olefins having i) an Mw/Mn of less than 2, such as less than 1.6, such as less than 1.5, such as 1.4 or less, such as from 1 to 1.3, such as from 1.0 to 1.25, such as from 1.0 to 1.2, such as 1.0 to 1.15, such as from 1.0 to 1.1, as determined by GPC-PS, ii) a Functionality Distribution (Fd) value of 3.5 or less, and iii) an Mn of 10,000 g/mol or more, such as 20,000 g/mol or more, such as 25,000 g/mol or more, such as 30,000 g/mol or more, such as 35,000 g/mol or more, or alternately 10,000 to 300,000 g/mol, such as 20,000 to 150,000 g/mol, such as 30,000 to 125,000 g/mol, such as 35,000 to 100,000 g/mol, such as 40,000 to 80,000 g/mol of the polymer prior to functionalization (as determined by GPC-PS).

The polymer useful herein to prepare the amide, imide, and/or ester functionalized polymer and/or the functionalized polymer may be a homopolymer or copolymer. The copolymer may be a random copolymer, a tapered block copolymer, a star copolymer, or a block copolymer. Block copolymers are formed from a monomer mixture comprising one or more first monomers (such as isobutylene), wherein, for example, a first monomer forms a discrete block of the polymer joined to a second discrete block of the polymer formed from a second monomer (such as butadiene). While block copolymers have substantially discrete blocks formed from the monomers, a tapered block copolymer may be composed of, at one end, a relatively pure first monomer and, at the other end, a relatively pure second monomer. The middle of the tapered block copolymer may be more of a gradient composition of the two monomers.

The polymer useful herein to prepare the amide, imide, and/or ester functionalized polymer may be a copolymer or homopolymer of butadiene, isoprene, or the like.

The polymer useful herein to prepare the amide, imide, and/or ester functionalized polymer may be a copolymer of isoprene and one or more of styrene, methyl-styrene, 2,3-dimethyl-butadiene, 2-methyl-1,3-pentadiene, myrcene, 3-methyl-1,3-pentadiene, 4-methyl-1,3-pentadiene, 2-phenyl-1,3-butadiene, 2-phenyl-1,3-pentadiene, 3-phenyl-1,3 pentadiene, 2,3-dimethyl-1,3-pentadiene, 2-hexyl-1,3-butadiene, 3-methyl-1,3-hexadiene, 2-benzyl-1,3-butadiene, 2-p-tolyl-1,3-butadiene 1,3-butadiene, 1,3-pentadiene, 1,3-hexadiene, 1,3-heptadiene, 2,4-heptadiene, 1,3-octadiene, 2,4-octadiene, 3,5-octadiene, 1,3-nonadiene, 2,4-nonadiene, 3,5-nonadiene, 1,3-decadiene, 2,4-decadiene, and 3,5-decadiene, (optionally the comonomer(s) are present at less than 20 mol %, less than 5 mol %, such as less than 3 mol %, such as less than 1 mol %, such as less than 0.1 mol %).

In embodiments, the functionalized polymer comprises 10 (such as 9, such as 8, such as 7, such as 6, such as 5, such as 4, such as 3, such as 2, such as 1) wt %, or less, based upon the weight of the functionalized polymer, of styrene monomer.

In embodiments, styrene repeat units may be absent in the functionalized polymer.

In embodiments, the functionalized polymer may be a block or taperered block copolymer that does not comprise a styrene block.

In embodiments, the functionalized polymer may be a block or taperered block copolymer comprising (or consisting of or consisting essentially of) isoprene.

In embodiments, the functionalized polymer may be a block or taperered block copolymer comprising 50 wt % or more isoprene, based upon the weight of the copolymer.

In embodiments, the functionalized polymer may be a block or taperered block copolymer comprising (or consisting of or consisting essentially of) $C_{4\text{-}5}$ conjugated diene, preferably comprising 50 (such as 60, such as 70, such as 80, such as 90, such as 95, such as 98) wt % or more $C_{4\text{-}5}$ conjugated diene, based upon the weight of the copolymer.

In embodiments, the functionalized polymer may be a copolymer comprising 50 (such as 60, such as 70, such as 80, such as 90, such as 95, such as 98) wt % or more isoprene, based upon the weight of the copolymer.

In embodiments, the functionalized polymer may be a copolymer comprising 50 (such as 60, such as 70, such as 80, such as 90, such as 95, such as 98) wt % or more butadiene, based upon the weight of the copolymer.

In embodiments, the functionalized polymer may be a copolymer comprising 50 (such as 60, such as 70, such as 80, such as 90, such as 95, such as 98) wt % or more butadiene and isoprene, based upon the weight of the copolymer.

In embodiments, the functionalized polymer may be a di-block copolymer comprising at least one block of isoprene homo- or co-polymer.

In embodiments, the polymer useful herein to prepare the amide, imide, and/or ester functionalized polymer is a homopolymer of isoprene, or a copolymer of isoprene and less than 5 mol % (such as less than 3 mol %, such as less than 1 mol %, such as less than 0.1 mol %) comonomer.

Preferably, the polymer backbone of the functionalized polymer is derived from homo- or copolymers, preferably homopolymers, of partially or fully hydrogenated isoprene or butadiene. More preferably, the polymer backbone of the functionalized polymer comprises at least 90% partially or fully hydrogenated isoprene repeating units. More preferably, the polymer backbone of the functionalized polymer is partially or fully hydrogenated homo-polyisoprene. More preferably, the polymer backbone of the functionalized polymer is partially or fully hydrogenated homo-polyisoprene having an Mn of 30,000 g/mol or more (GPC-PS).

Optionally, the polymer backbone comprises repeat units of one or more polar monomers, such as (but not limited to) those selected from the group consisting of fumarates, acrylates and combinations thereof.

Optionally, styrene repeat units may be absent in the polymer useful herein to prepare the functionalized polymer. Optionally, styrene repeat units may be absent in the functionalized hydrogenated/saturated polymers.

Optionally, butadiene repeat units may be absent in the polymer useful herein to prepare the functionalized polymer. Optionally, butadiene repeat units may be absent in the functionalized hydrogenated/saturated polymers.

Optionally, the polymer useful herein to prepare the functionalized polymer may be not homopolybutylene. Optionally, the functionalized hydrogenated/saturated polymer may be not homopolybutylene.

Optionally, the polymer useful herein to prepare the functionalized polymer may be not homopolyisobutylene. Optionally, the functionalized hydrogenated/saturated polymer may be not homopolyisobutylene.

Optionally, the polymer useful herein to prepare the functionalized polymer may not be a copolymer of isoprene and butadiene. Optionally, the functionalized hydrogenated/saturated polymer may not be a copolymer of isoprene and butadiene.

Generally, the polymerized conjugated diene in the functionalized polymer includes monomer units that have been inserted in the growing polymer chain by conjugated addition and non-conjugated addition. In embodiments the functionalized polymer contains at least about 50% of by conjugated addition insertions, such as at least about 75% of by conjugated addition insertions, such as about 80% of by conjugated addition insertions, such as from about 85% to about 100% of by conjugated addition insertions, based upon the total number of by conjugated addition and non-conjugated insertions, as measured by $^{13}C$ NMR.

Generally, the polymerized conjugated diene polymer useful herein to prepare the amide, imide, and/or ester functionalized polymer includes a mixture of 1,4- and 1,2-insertions (a.k.a. 2,1-insertions; for butadiene, 1,2-insertions are the same as 3,4-insertions). As measured by 1H NMR, the polymerized conjugated diene polymer useful herein to prepare the functionalized polymer contains at least about 50% of 1,4-insertions, such as at least about 75% of 1,4 insertions, such as at least about 80% of 1,4 insertions, such as at least about 90% of 1,4 insertions, such as at least about 95% of 1,4 insertions, such as at least 98% of 1,4 insertions, based upon the total of the 2,1 insertions, 1,4 insertions, and 3,4 insertions of isoprene. For purposes of this disclosure: 1) the phrase "1,4 insertion" includes 1,4 and 4,1 insertions, 2) the phrase "2,1 insertion" includes 2,1 and 1,2 insertions, and 3) the phrase "3,4 insertion" includes 3,4 and 4,3 insertions.

The insertion of isoprene most often occurs by 2,1 insertions, 1,4 insertions (trans and cis), and 3,4 insertions of isoprene. (Measurements of the insertion geometry are determined by $^{1}H$ NMR.). As measured by $^{1}H$ NMR, the functionalized isoprene polymer contains at least about 50% of 1,4-insertions, such as at least about 75% of 1,4 insertions, such as at least about 80% of 1,4 insertions, such as at least about 90% of 1,4 insertions, such as at least about 95% of 1,4 insertions, such as at least 98% of 1,4 insertions, based upon the total of the 2,1 insertions, 1,4 insertions, and 3,4 insertions of isoprene. For purposes of this disclosure: 1) the phrase "1,4 insertion" includes 1,4 and 4,1 insertions, 2) the phrase "2,1 insertion" includes 2,1 and 1,2 insertions, and 3) the phrase "3,4 insertion" includes 3,4 and 4,3 insertions.

The polymer useful herein to prepare the functionalized polymer may typically have an Mn (i.e., prior to functionalization) of 10,000 to 150,000 g/mol, alternately about 10,000 to about 100,000 g/mol, or 20,000 to about 150,000 g/mol, alternately 30,000 to about 125,000 g/mol, such as about 30,000 to about 50,000 g/mol, such as about 30,000 to about 40,000 g/mol, alternately 35,000 to about 100,000 g/mol, alternately 40,000 to 80,000 g/mol (GPC-PS). Alternatively, the polymer prior to functionalization may have an Mn of at least 25,000 g/mol, such as at least 30,000 g/mol (GPC-PS).

Polymers useful herein to prepare the functionalized polymers may typically have an Mw/Mn (as determined by GPC-PS) of 1 to 2, alternately greater than 1 to less than 2, alternately 1.1 to 1.8, alternately 1.2 to 1.5. Alternately, the polymers useful herein to prepare the functionalized polymers may typically have an Mw/Mn of 1 or greater than 1 to less than 2 (such as less than 1.8, such as less than 1.7, such as less than 1.6, such as less than 1.5, such as less than 1.4, such as less than 1.3, such as 1.25 or less, such as less than 1.2, such as less than 1.15, such as less than 1.12, such as less than 1.10). As functionalization occurs, Mw/Mn broadening may occur.

In embodiments, the functionalized polymer may have a number average molecular weight (Mn) of 15,000 (such as 20,000, such as 25,000, such as 30,000, such as 35,000 such as 40,000) g/mol or more, as determined by GPC-PS. In certain embodiments, the functionalized polymer may have a number average molecular weight (Mn) of 20,000 to 60,000, and particularly of 30,000 to 40,000 g/mol (GPC-PS).

In embodiments, the functionalized polymer may have a weight average molecular weight (Mw) of 50,000 (such as 40,000, such as 35,000) g/mol or less, as determined by GPC-PS. In embodiments, the functionalized polymer may have a weight average molecular weight (Mw) of 1000 to 50,000 g/mol, such as 5000 to 40,000 g/mol as determined by GPC-PS.

The functionalized polymer may typically have an Mw/Mn (GPC-PS) of 1 to 3, alternately 1 to 2, alternately greater than 1 to less than 2, alternately 1.05 to 1.9, alternately 1.10 to 1.8, alternately 1.10 to 1.7, alternately 1.12 to 1.6, alternately 1.13 to 1.5, alternately 1.15 to 1.4, alternately 1.15 to 1.3. Alternately, the functionalized polymer may typically have an Mw/Mn of 1 or greater than 1 to less than 2 (such as less than 1.8, such as less than 1.7, such as less than 1.6, such as less than 1.4, such as less than 1.2, such as less than 1.15, such as less than 1.12, such as less than 1.10).

The polymers used to prepare the functionalized polymers may have an Mz (as determined by GPC-PS) of 20,000 to 150,000 g/mol, alternately 30,000 to about 125,000 g/mol, alternately 35,000 to about 100,000 g/mol, alternately 40,000 to 80,000 g/mol, such as about 50,000 to about 60,000 g/mol, alternately 40,000 to 60,000 g/mol (GPC-PS).

In embodiments, the functionalized polymer may have a z average molecular weight (Mz) of 5000 to 150,000 g/mol, such as 10,000 to 150,000 g/mol, such as 15,000 to 70,000 g/mol, such as 20,000 to 150,000 g/mol, alternately 20,000 to about 150,000 g/mol, alternately 30,000 to about 125,000 g/mol, alternately 35,000 to about 100,000 g/mol, alternately 40,000 to 80,000 g/mol, alternately 40,000 to 60,000 g/mol (GPC-PS).

Polymers useful herein to prepare the functionalized polymers may have a glass transition temperature (Tg) of −25° C. or less, such as −40° C. or less, such as −50° C. or less, as determined by Differential Scanning calorimetry (DSC) using a Perkin Elmer or TA Instrument Thermal Analysis System (sample is heated from ambient to 210° C. at 10° C./minute and held at 210° C. for 5 minutes, then cooled down to −40° C. at 10° C./minute and held for 5 minutes.)

Polymers useful herein to prepare the functionalized polymers typically have a residual unsaturation of less than 3%, such less than 2%, such less than 1%, such as less than 0.5%, such as less than 0.25% based upon number of double bonds in the non-hydrogenated polymer.

Polymers useful herein to prepare the functionalized polymers typically have a residual metal (such as Li, Co, and Al) content of less than 100 ppm, such less than 50 ppm, such as less than 25 ppm, such as less than 10 ppm, such as less than 5 ppm.

The amide, imide, and/or ester functionalized fully or partially saturated (such as fully or partially hydrogenated) polymers of $C_{4-5}$ conjugated dienes described herein may be obtained by reacting fully or partially saturated (such as fully or partially hydrogenated) polymers of $C_{4-5}$ conjugated dienes having an Mw/Mn of less than 2, with an acylating agent, such as maleic acid or maleic anhydride and thereafter reacting the acylated polymer with an amine (such as a polyamine) to form an imide, amide or combination thereof.

Details on the hydrogenation, acylation, and functionalization of the polymers to prepare the amide, imide, and/or ester functionalized polymers of the present invention are disclosed in U.S. patent application Ser. No. 18/480,571 filed Oct. 4, 2023, in particular paragraphs [0223] to [0262], and in U.S. Patent Application Ser. No. 63/379,006, filed Oct. 11, 2022, in particular paragraphs [0213] to [0252].

In embodiments, the amide, imide, and/or ester functionalized polymer is not prepared in aromatic solvent (such as benzene or toluene), or aromatic solvent is present at 2 wt % or less (such as 1 wt % or less, such as 0.5 wt % or less), based upon the weight of solvent, diluent, and polymer.

In embodiments, the amide, imide, and/or ester functionalized polymer is not prepared in an alkylated naphthylenic solvent, or alkylated naphthylenic solvent is present at 5 wt % or less (such as 3 wt % or less, such as 1 wt % or less), based upon the weight of solvent, diluent, and polymer.

In embodiments, the functionalized polymer may have an average functionality of 1.4 to 20 FG grafts/polymer chain, such as 1.4 to 15 FG grafts/polymer chain, such as 3 to 12.5 FG grafts/polymer chain, such as 4 to 10 FG grafts/polymer chain, as determined by GPC-PS, for example 7, 8 or 9 FG grafts/polymer chain.

The functionalized polymer may have an average functionality of 15 (such as 14, 13, 12,11, 10, 9, 8, 7, or 6) or less FG grafts/polymer chain, as determined by GPC-PS.

The functionalized polymer may have an average functionality of 1 (such as 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or 4.0) or more FG grafts/polymer chain, as determined by GPC-PS.

The functionalized polymer may have an average functionality from 1 (such as 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, or 4.0) to 15 (such as 14, 13, 12,11, 10, 9, 8, 7, or 6) FG grafts/polymer chain, as determined by GPC-PS.

In embodiments, the functionalized polymer may have an aromatic content of 5% or less, such as 3% or less, such as 1% or less, such as 0%, based upon the weight of the polymer.

In embodiments, the functionalized polymer may comprise acylated polymers of branched $C_{4-5}$ monomers having an Mn of 20,000 to 500,000 g/mol having an Mw/Mn of 2 or less, such as from 1 to 2.0, as determined by GPC-PS.

In embodiments, the functionalized polymer may have a gel content of less than about 5 wt %, less than 3 wt %, less than 2 wt %, less than 1 wt %, less than 0.5 wt %, less than 0.1 wt %, or 0 wt %, where the gel content is measured by determining the amount of material that is extractable from the polymer by using boiling xylene (or cyclohexane) as an extractant. The percent of soluble and insoluble (gel) material in a polymer composition is measured by determining the amount of material that is extractable from the polymer by using boiling xylene (or cyclohexane) as an extractant. The percent of soluble and insoluble (gel) material in a polymer composition is determined by soaking a nominally 0.5 mm thick thin film specimen of polymer for 48 hours in cyclohexane at 23° C. or refluxing the thin film specimen in boiling xylene for one half hour, removing the solvent, weighing the dried residue and calculating the amount of soluble and insoluble (gel) material. This method is generally described in U.S. Pat. No. 4,311,628, which is incorporated herein by reference. For purposes of this disclosure, gel content is measured using boiling xylene, unless the sample is not soluble in xylene, then the cyclohexane method is used.

In embodiments, the functionalized polymer may have a Functionality Distribution (Fd) value of 3.5 or less (such as 3.4 or less, such as from 1 to 3.3, such as from 1.1 to 3.2, such as from 1.2 to 3.0, such as 1.4 to 2.9, such as 1.7 to 1.9, as determined by GPC-PS) and an average functionality of 1.4 to 20 FG grafts/polymer chain, such as 1.4 to 15 FG grafts/polymer chain, such as 3 to 12.5 FG grafts/polymer chain, such as 4 to 10 FG grafts/polymer chain, such as 7, 8 or 9 FG grafts/polymer chain, as determined by GPC-PS.

In certain embodiments, the lubricating oil composition or concentrate comprises an amide, imide, and/or ester functionalized hydrogenated/saturated polymers comprising (consisting essentially of or consisting of) $C_{4-5}$ olefins having an Mw/Mn of less than 2, a Functionality Distribution (Fd) value of 3.5 or less (such as 3.4 or less, such as from 1 to 3.3, such as from 1.1 to 3.2, such as from 1.2 to 3.0, such as 1.4 to 2.9, as determined by GPC-PS, and wherein, if the polymer prior to functionalization is a $C_4$ olefin polymer such as polyisobutylene, polybutadiene, or a copolymer thereof (preferably a polyisobutylene or a copolymer of isobutylene and butadiene), then the $C_4$ olefin polymer has an Mn of 10,000 g/mol or more (GPC-PS), and if the polymer prior to functionalization is a $C_4/C_5$ copolymer of isoprene and butadiene, then the Mn of the copolymer is greater than 25,000 Mn (GPC-PS).

In certain embodiments, the lubricating oil composition or concentrate comprises an amide, imide, and/or ester functionalized hydrogenated/saturated polymers comprising 90 mol % or more isoprene repeat units, having an Mw/Mn of less than 2, a Functionality Distribution (Fd) value of 3.5 or less (such as 3.4 or less, such as from 1 to 3.3, such as from 1.1 to 3.2, such as from 1.2 to 3.0, such as 1.4 to 2.9, as determined by GPC-PS), and wherein the polymer prior to functionalization has an Mn of 10,000 g/mol or more, such as 30,000 g/mol or more (GPC-PS).

In certain embodiments, the lubricating oil composition or concentrate comprises an amide, imide, and/or ester functionalized hydrogenated/saturated homopolymers of isoprene having an Mw/Mn of less than 2, such as less than 1.8, a Functionality Distribution (Fd) value of 3.5 or less (such as 3.4 or less, such as 2.5 or less, or from 1 to 3.3, such as from 1.1 to 3.2, such as from 1.2 to 3.0, such as 1.4 to 2.9, as determined by GPC-PS), an average functionality (Fv) of 4 to 10 functional group grafts/polymer chain, and wherein the polymer prior to functionalization has an Mn of 20,000 g/mol or more, such as 20,000 to 50,000 g/mol (as determined by GPC-PS).

In particular embodiments, the functionalized polymer used in the lubricating oil compositions and concentrates of the present invention has an Mw/Mn of from 1.0 to 2, such as from 1.1 to 1.8, such as from 1.2 to 1.5; a Functionality Distribution (Fd) value of from 1.0 to 3.5. such as from 1.5 to 2.5, such as from 1.9 to 2.1, as determined by GPC-PS as disclosed herein; an average functionality (Fv) of 4 to 10, such as from 6 to 8 (determined as disclosed herein); an Mn of 20,000 to 50,000 g/mol, such as 30,000 to 40,000 g/mol (GPC-PS); and/or an Mz of 40,000 to 70,000 g/mol, such as 50,000 to 60,000 g/mol (GPC-PS); and/or has a backbone of homo-polyisoprene that has been functionalized with maleic anhydride and further reacted with a polyamine, such as an N-phenylphenylene diamine (NPPDA), such as 4-aminodiphenylamine (ADPA).

In certain embodiments, the amide, imide, and/or ester functionalized polymer of the present invention is present in the lubricating oil composition in an amount of 0.01 to 5 mass %, such as 0.05 to 4 mass %, such as 0.1 to 3 mass %, such as 0.2 to 2 mass %, such as 0.3 to 1.0 mass %, such as 0.4 to 0.8 mass %, based on the total mass of the lubricating oil composition.

In certain embodiments, the lubricating oil composition or concentrate comprises no or substantially no, such as less than 0.6 mass %, such as less than 0.5 mass %, such as less than 0.4 mass %, such as less than 0.3 mass %, such as less than 0.2 mass %, such as less than 0.1 mass %, based on the total mass of the lubricant oil composition, of an amine functionalized hydrogenated isoprene polymer having an average functionality (Fv) of 7.0, a Functionality Distribution (Fd) value of 1.86, an Mw/Mn of 1.250, an Mn of 35,140 g/mol (GPC-PS), and an Mz of 55,726 g/mol (GPC-PS).

In the lubricating oil compositions and the concentrates according to the present disclosure, component P), in particular the amide, imide, and/or ester functionalized polymer as described herein, is considered as a dispersant in addition to the dispersant(s) of component B), in particular the PIBSA-PAM dispersant(s) of component B). Thus, the dispersants of component B), in particular the PIBSA-PAM(s) of component B), and the functionalized polymer(s) of component P), in particular the amide, imide, and/or ester functionalized polymers described herein, are taken together for purposes of determining the amount of dispersant(s) in a lubricating oil composition or concentrate disclosed herein. However, it is to be understood that the functionalized polymer(s) of component P), in particular the amide, imide, and/or ester functionalized polymers described herein, are not PIBSA-PAM(s). In certain embodiments, the one or more dispersant(s) comprise the amide, imide, and/or ester functionalized polymer at 0.01 to 50 mass %, such as 0.1 to 40 mass %, such as 1 to 30 mass %, such as 5 to 25 mass %, such as 10 to 20 mass %, such as 12 to 16 mass %, based upon the total mass of the dispersant(s).

When lubricating oil compositions contain one or more of the additives discussed above, the additive(s) are typically blended into the composition in an amount sufficient for it to perform its intended function. Typical amounts of such additives useful in the present disclosure, especially for use in crankcase lubricants, are shown in the Table below.

It is noted that many of the additives are shipped from the additive manufacturer as a concentrate, containing one or more additives together, with a certain amount of base oil or other diluents. Accordingly, the weight amounts in the table below, as well as other amounts mentioned herein, are directed to the amount of active ingredient (that is the non-diluent portion of the ingredient). The weight percent (mass %) indicated below is based on the total weight of the lubricating oil composition.

Typical Amounts of Optional Lubricating Oil Components

| Additive Formulations | A (mass % a.i.) | B (mass % a.i.) | C (mass % a.i.) | D (mass % a.i.) |
|---|---|---|---|---|
| borated and or non-borated dispersant, such as PIBSA-PAM | 0-10 | 0-5 | 0-4 | 0.5 to 3 |
| Detergents | 0.1-20 | 0.1-10 | 0.2-9 | 0.5 to 2 |
| Corrosion Inhibitor/Anti-rust agent | optional | 0-5 | 0-1.5 | 0-1 |
| Antioxidant | 0.01-10 | 0.1-6 | 0.1-5 | 0.5 to 4 |
| Pour Point Depressant | optional | 0-5 | 0.01-1.5 | 0.05 to 2 |
| Anti-foaming Agent | optional | 0-5 | 0.001-0.15 | 0.001 to 0.05 |
| Functionalized Polymer | 0.01-10 | 0.1-6 | 0.1-4 | 0.2 to 2 |
| Friction Modifier | optional | 0.1 to 10 | 0.2 to 0.5 | 0.05-0.4 |
| Antiwear Agent | 0.01-10 | 0.1-5 | 0.1-3 | 0.1 to 1 |
| Viscosity Modifier | optional | 0-10 | 0.01-3 | 0.01 to 1 |
| Seal Swell Agents | optional | 0-5 | 0-2 | 0.01 to 1 |
| Unsaturated Hydrocarbons (LAOs) | optional | 0-5 | 0-3 | 0-3 |
| Basestock | Balance (such as 50 to 95%) | Balance | Balance | Balance |

The foregoing additives are typically commercially available materials. These additives may be added independently, but are usually pre-combined in packages, which can be obtained from suppliers of lubricant oil additives. Additive packages with a variety of ingredients, proportions and characteristics are available and selection of the appropriate package will take the use of the ultimate composition into account.

The following non-limiting examples are provided to illustrate the disclosure.

Fuels

This disclosure also relates to a method of lubricating an internal combustion engine during operation of the engine comprising:

(i) providing to a crankcase of the internal combustion engine an automotive crankcase the lubricating composition as described herein;

(ii) providing a hydrocarbon fuel in the internal combustion engine; and (iii) combusting the fuel in the internal combustion engine, such as a spark-ignited or compression-ignited two- or four-stroke reciprocating engines such as a diesel engine or passenger car engine (such as a spark-ignited combustion engine).

This disclosure also relates to a fuel composition comprising the lubricating oil compositions described herein and a hydrocarbon fuel, wherein the fuel may be derived from petroleum and/or biological sources ("biofuel" or "renewable fuel"). In embodiments, the fuel comprises from 0.1 to 100 mass % renewable fuel, alternately from 1 to 75 mass % renewable fuel, alternately from 5 to 50 mass % renewable fuel, based upon the total mass of the from 1 to 50 mass % renewable fuel and the petroleum derived fuel.

The renewable fuel component is typically produced from vegetable oil (such as palm oil, rapeseed oil, soybean oil, jatropha oil), microbial oil (such as algae oil), animal fats (such as cooking oil, animal fat, and/or fish fat) and/or biogas. Renewable fuel refers to biofuel produced from biological resources formed through contemporary biological processes. In an embodiment, the renewable fuel component is produced by means of a hydrotreatment process. Hydrotreatment involves various reactions where molecular hydrogen reacts with other components, or the components undergo molecular conversions in the presence of molecular hydrogen and a solid catalyst. The reactions include, but are not limited to, hydrogenation, hydrodeoxygenation, hydrodesulfurization, hydrodenitrification, hydrodemetallization, hydrocracking, and isomerization. The renewable fuel component may have different distillation ranges, which provide the desired properties to the component, depending on the intended use.

In certain embodiments, the fuel is one or more of a hydrocarbon fuel, renewable fuel, hydrogen fuel, natural gas or any blend thereof, preferably a hydrocarbon fuel.

In certain embodiments, the engine is a diesel engine, such as a heavy-duty diesel engine or an automotive diesel engine.

In certain embodiments, the engine is a motorcycle engine, stationary gas or diesel-powered engine, a locomotive engine, or a 4-stroke medium speed trunk piston engine.

Uses

The lubricating compositions of the disclosure may be used to lubricate mechanical engine components, particularly in internal combustion engines, e.g., spark-ignited or compression-ignited, two- or four-stroke reciprocating engines, by adding the lubricant thereto. Typically, they are crankcase lubricants, such as passenger car motor oils or heavy-duty diesel engine lubricants.

In particular, the lubricating compositions of the present disclosure are suitably used in the lubrication of the crankcase of a compression-ignited, internal combustion engine, such as a heavy-duty diesel engine.

In particular, the lubricating compositions of the present disclosure are suitably used in the lubrication of the crankcase of a spark-ignited turbo charged internal combustion engine.

In embodiments, the lubricating oils of this disclosure are used in spark-assisted high compression internal combustion engines and, when used in high compression spark ignition internal combustion engines the lubricating oil compositions of this disclosure are useful in lubricating high compression spark ignition engines.

In embodiments, the lubricating compositions of the present disclosure are suitably used in the lubrication of the crankcase of an engine for a heavy-duty diesel vehicle (i.e., a heavy-duty diesel vehicle having a gross vehicle weight rating of 10,000 pounds or more.)

In embodiments, the lubricating compositions of the present disclosure are suitably used in the lubrication of the crankcase of a passenger car diesel engine.

In particular, lubricating oil formulations of this disclosure are particularly useful in compression-ignited internal combustion engines, i.e., heavy-duty diesel engines, employing low viscosity oils, such as API FA-4 and future oil categories, in which wear protection of the valve train becomes challenging.

This disclosure further relates to the following items:

1. A lubricating oil composition containing less than 1000 ppm phosphorus, comprising:

A) at least 50 mass % of one or more base oil(s), based on the total mass of the lubricating oil composition;

B) one or more dispersant(s), wherein said one or more dispersant(s) comprise 2.0 to 6.00 mass %, based on the total mass of the lubricating oil composition, of one or more poly(alkenyl) succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and C) one or more detergent(s), wherein said one or more detergent(s) together provide soap to the lubricating oil composition in an amount of 0.1 to 0.9 mass %, based on the total mass of the lubricating oil composition;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

2. The lubricating oil composition of item 1, wherein:

A) the one or more base oils together are present in an amount of at least 50 mass % based on the total mass of the lubricating oil composition;

B) the one or more dispersants together are present in an amount of 2 to 15 mass % based on the total mass of the lubricating oil composition; and C) the one or more detergents together are present in an amount of 0.1 to 5 mass % based on the total mass of the lubricating oil composition.

3. The lubricating oil composition of item 1 or item 2 further comprising one or more additional additives selected from the group consisting of friction modifiers, antioxidants, pour point depressants, anti-foam agents, viscosity modifiers, corrosion inhibitors, anti-rust agents, antiwear agents, seal compatibility agents, extreme pressure agents, unsaturated $C_{12}$-$C_{60}$ hydrocarbons, and functionalized polymer(s).

4. The lubricating oil composition of any of the preceding items, further comprising one or more additional additives selected from the group consisting of:

D) 0.01 to 5 mass %, based on the total mass of the lubricating oil composition, of one or more friction modifiers;

E) 0.01 to 13, (such as 0.1 to 10 mass %), based on the total mass of the lubricating oil composition, of one or more antioxidants;

F) 0.01 to 5 mass %, based on the total mass of the lubricating oil composition, of one or more pour point depressants;

G) 0.001 to 5 mass %, based on the total mass of the lubricating oil composition, of one or more anti-foam agents;

H) 0.001 to 10 mass %, based on the total mass of the lubricating oil composition, of one or more viscosity modifiers;

J) 0.001 to 5 mass %, based on the total mass of the lubricating oil composition, of one or more corrosion inhibitors and/or anti-rust agents;

K) 0.001 to 10 mass %, based on the total mass of the lubricating oil composition, of one or more antiwear agents;

M) 0.01 to 5 wt %, based on total weight of the lubricating oil composition, of one or more seal compatibility agents, such as seal swell agents;

N) optionally, from 0.01 to 5 mass %, based on total weight of the lubricating oil composition, of one or more extreme pressure agents, O) 0.01 to 5 mass %, based on total weight of the lubricating oil composition, of one or more unsaturated $C_{12}$-$C_{60}$ hydrocarbons, and P) 0.001 to 10 mass %, based on total weight of the lubricating oil composition, of one or more functionalized polymer(s).

5. The lubricating oil composition of any of the preceding items, containing less than 900 ppm, such as less than 850 ppm phosphorus.

6. The lubricating oil composition of any of the preceding items, containing 700 ppm to 900 ppm phosphorus.

7. The lubricating oil composition of any of the preceding items, comprising 50 to 95 mass %, such as 60 to 90 mass %, such as 70 to 85 mass % of one or more base oils, based on the total mass of the lubricating oil composition.

8. The lubricating oil composition of any of the preceding items, wherein the one or more base oil(s) comprise one or more group II base oil(s) and optionally one or more group III base oil(s).

9. The lubricating oil composition of any of the preceding items, wherein the one or more base oil(s) comprise at least 50 mass %, such as at least 70 mass %, such as at least 90 mass % of a group II base oil based on the total mass of base oil(s) present in the lubricating oil composition.

10. The lubricating oil composition of any of the preceding items, comprising at least 50 mass %, such as at least 60 mass %, such as at least 65 mass % of a group II base oil based on the total mass of the lubricating oil composition.

11. The lubricating oil composition of any of the preceding items, wherein the one or more detergent(s) are selected from the group consisting of oil-soluble neutral or overbased sulfonates, phenates, sulfurized phenates, thiophosphonates, salicylates, naphthenates, other oil-soluble carboxylates, and mixtures thereof, of an alkali or alkaline earth metal.

12. The lubricating oil composition of any of the preceding items, wherein the one or more detergent(s) are selected from the group consisting of oil-soluble neutral or overbased sulfonates, salicylates, and mixtures thereof, of calcium and/or magnesium.

13. The lubricating oil composition of any of the preceding items, wherein the one or more detergent(s) comprise 50 mass % or less, based on the total mass of detergent(s) present in the lubricating oil composition, of calcium salicylate.

14. The lubricating oil composition of any of the preceding items, wherein the one or more detergent(s) are selected from the group consisting of oil-soluble overbased sulfonates of calcium and/or magnesium.

15. The lubricating oil composition of any of the preceding items, comprising no or substantially no phenate detergent, such as less than 0.5 mass %, such as less than 0.2 mass %, such as less than 0.1 mass % phenate detergent based on the total mass of the lubricant oil composition.

16. The lubricating oil composition of any of the preceding items, wherein the lubricating oil composition is absent or is substantially absent phenate detergent.

17. The lubricating oil composition of any of the preceding items, wherein the one or more detergent(s) together are present in an amount of 0.1 to 4 mass %, such as 0.2 to 3 mass %, such as 0.4 to 2 mass %, such as 0.5 to 1.5 mass %, such as 0.8 to 1.2 mass % based on the total mass of the lubricating oil composition.

18. The lubricating oil composition of any of the preceding items, wherein the one or more detergent(s) together provide less than 0.8 mass %, such as less than 0.7 mass %, such as less than 0.6 mass %, such as less than 0.55 mass % of soap, based on the total mass of the lubricating oil composition.

19. The lubricating oil composition of any of the preceding items, wherein the one or more detergent(s) together provide from 0.2 to 0.8 mass %, such as 0.3 to 0.7 mass %, such as 0.4 to 0.6 mass %, such as 0.45 to 0.55 mass % of soap, based on the total mass of the lubricating oil composition.

20. The lubricating oil composition of any of the preceding items, wherein the one or more unborated PIBSA-PAM(s) are present in an amount of 2.5 to 5.5 mass %, such as 3.5 to 5.0 mass %, such as 4.0 to 4.5 mass %, based on the total mass of the lubricating oil composition.

21. The lubricating oil composition of any of the preceding items, wherein the one or more unborated PIBSA-PAM (s) comprise one or more unborated PIBSA-PAM(s), where the polyalkenyl is derived from polyisobutylene having a Mn of 1600 g/mol or more (GPC-PS) ("high molecular weight PIBSA-PAM") and optionally one or more unborated PIBSA-PAM(s), where the polyalkenyl is derived from polyisobutylene having a Mn of less than 1600 g/mol (GPC-PS) ("low molecular weight PIBSA-PAM").

22. The lubricating oil composition of any of the preceding items, wherein the one or more unborated PIBSA-PAM(s) comprise one or more unborated high molecular weight PIBSA-PAM(s) in an amount of 0.5 to 4 mass %, such as 1.0 to 3.5 mass %, such as 1.5 to 3.0 mass %, such as 2.0 to 2.5 mass % based on the total mass of the lubricating oil composition.

23. The lubricating oil composition of any of the preceding items, wherein the one or more unborated PIBSA-PAM(s) comprise one or more unborated high molecular weight PIBSA-PAM(s) in an amount of 0.5 to 4 mass %, such as 1.0 to 3.5 mass %, such as 1.5 to 3.0 mass %, such as 2.0 to 2.5 mass % based on the total mass of the lubricating oil composition, and one or more unborated low molecular weight PIBSA-PAM(s) in an amount of 0.5 to 4 mass %, such as 1 to 3 mass %, such as 1.8 to 2.5 mass % based on the total mass of the lubricating oil composition.

24. The lubricating oil composition of any of the preceding items, wherein the ratio of mass %, based on the total mass of the lubricating oil composition, of the one or more unborated high molecular weight PIBSA-PAM(s) to the one or more unborated low molecular weight PIBSA-PAM(s) is less than 3.65, such as less than 3.5, such as less than 3.0, such as less than 2.5, such as less than 2.0, such as less than 1.5.

25. The lubricating oil composition of any of the preceding items, wherein the one or more unborated low molecular weight PIBSA-PAM(s) is not derived from tetraethylenepentamine.

26. The lubricating oil composition of any of the preceding items, wherein the one or more dispersant(s) further comprise one or more borated PIBSA-PAM(s), wherein the one or more borated PIBSA-PAM(s) are present in an amount of 0.05-0.5 mass %, such as 0.1-0.4 mass %, such as 0.15-0.3 mass %, such as 0.2-0.25 mass %, based on the total mass of the lubricating oil composition.

27. The lubricating oil composition of any of the preceding items, wherein the unborated and borated PIBSA-PAM(s) together are present in an amount of 2.5 to 5.8 mass %, such as 3.0 to 5.5 mass %, such as 3.5 to 5.2 mass %, such as 4.0 to 5.0 mass %, such as 4.2 to 4.8 mass %, based on the total mass of the lubricating oil composition.

28. The lubricating oil composition of any of the preceding items, wherein the one or more dispersant(s) together are present in an amount of 2 to 10 mass %, such as 3 to 8 mass %, such as 4 to 6 mass %, such as 4.5 to 5.5 mass %, based on the total mass of the lubricating oil composition.

29. The lubricating oil composition of any of the preceding items, comprising no or substantially no aromatic dispersant, such as less than 0.5 mass %, such as less than 0.2 mass %, such as less than 0.1 mass % aromatic dispersant based on the total mass of the lubricant oil composition.

30. The lubricating oil composition of any of the preceding items, comprising no or substantially no PIBSA ester of hydrocarbyl-bridged naphthyloxy alcohol, such as less than 0.6 mass %, such as less than 0.4 mass %, such as less than 0.2 mass %, such as less than 0.1 mass % based on the total mass of the lubricant oil composition.

31. The lubricating oil composition of any of the preceding items, wherein the lubricating oil composition is absent or substantially absent PIBSA ester of hydrocarbyl-bridged naphthyloxy alcohol.

32. The lubricating oil composition of any of the preceding items, wherein i) the ratio of mass %, based on the total mass of the lubricating oil composition, of the one or more unborated PIBSA-PAM(s) to soap of the lubricating oil composition is from 7.0 to 15.0, such as from 7.2 to 13.0, such as from 7.4 to 11.0, such as from 7.6 to 10.0, such as from 7.8 to 9.0, such as from 8.0 to 8.5.

33. The lubricating oil composition of any of the preceding items, wherein ii) the lubricating oil composition has an SAE viscosity grade of 15W-40, 5W-30, or 10W-30.

34. The lubricating oil composition of any of the preceding items, further comprising an amide, imide, and/or ester functionalized polymer comprising a partially or fully saturated polymer backbone comprising $C_{4-5}$ olefins having:

i) an Mw/Mn of less than 2, ii) a Functionality Distribution (Fd) value of 3.5 or less, and iii) an Mn of 10,000 g/mol or more (GPC-PS) of the polymer prior to functionalization.

35. The lubricating oil composition of item 34, wherein the polymer backbone of the functionalized polymer is derived from homo- or copolymers of partially or fully hydrogenated isoprene and butadiene.

36. The lubricating oil composition of item 34, wherein the polymer backbone of the functionalized polymer comprises at least 90% partially or fully hydrogenated isoprene repeating units.

37. The lubricating oil composition of item 34, wherein the polymer backbone of the functionalized polymer is partially or fully hydrogenated homo-polyisoprene.

38. The lubricating oil composition of item 34, wherein the polymer backbone of the functionalized polymer is partially or fully hydrogenated homo-polyisoprene having an Mn of 30,000 g/mol or more (GPC-PS).

39. The lubricating oil composition of any one of items 34 to 38, wherein the functionalized polymer is present in an amount of 0.01 to 5 mass %, such as 0.05 to 4 mass %, such as 0.1 to 3 mass %, such as 0.2 to 2 mass %, such as 0.3 to 1.0 mass %, such as 0.4 to 0.8 mass %, based on the total mass of the lubricating oil composition.

40. The lubricating oil composition of any of the preceding items, comprising no or substantially no, such as less than 0.6 mass %, such as less than 0.5 mass %, such as less than 0.4 mass %, such as less than 0.3 mass %, such as less than 0.2 mass %, such as less than 0.1 mass %, based on the total mass of the lubricant oil composition, of an amine functionalized hydrogenated isoprene polymer having an average functionality (Fv) of 7.0, a Functionality Distribution (Fd) value of 1.86, an Mw/Mn of 1.250, an Mn of 35,140 g/mol (GPC-PS), and an Mz of 55,726 g/mol (GPC-PS).

41. The lubricating oil composition of any of the preceding items, wherein the lubricating oil composition is a heavy-duty diesel oil.

42. The lubricating oil composition of any of the preceding items, wherein the lubricating oil composition provides a valve train rocker arm wear of less than 120 mg, such as less than 110 mg, such as less than 100 mg, such as less than 90 mg, such as less than 80 mg, such as less than 70 mg, such as less than 60 mg, such as less than 50 mg, such as less than 40 mg, as determined by the Ford 6.7 L Power Stroke Diesel Engine Test for soot induced wear and viscosity control.

43. The lubricating oil composition of any of the preceding items, wherein the lubricating oil composition comprises one or more compounds comprising molybdenum (Mo), wherein said one or more compounds comprising Mo together provide at least 50 ppm, such as at least 60 ppm, Mo to the lubricating oil composition.

44. The lubricating oil composition of any one of items 1 to 41, comprising no or substantially no molybdenum (Mo), such as less than 60 ppm, such as less than 50 ppm, such as less than 40 ppm of Mo.

45. A lubricating oil composition containing less than 1000 ppm phosphorus, comprising:

A) at least 50 mass % of one or more base oil(s), based on the total mass of the lubricating oil composition;

B) one or more dispersant(s), wherein said one or more dispersant(s) comprise 2 to 10 mass %, based on the total mass of the lubricating oil composition, of one or more poly(alkenyl)succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and C) one or more detergent(s), wherein said one or more detergent(s) together provide soap to the lubricating oil composition in an amount of 0.1 to 0.9 mass %, based on the total mass of the lubricating oil composition; and wherein said one or more detergent(s) comprise 50 mass % or less, based on the total mass of detergent(s) present in the lubricating oil composition, of calcium salicylate;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

46. The lubricating oil composition of item 45, wherein the one or more PIBSA-PAM(s) are present in an amount of 2.5 to 10 mass %, such as 3 to 8 mass %, such as 3.5 to 6 mass %, based on the total mass of the lubricating composition.

47. The lubricating oil composition of item 45 or item 46, wherein the lubricating oil composition is further as defined in any one of items 2 to 44.

48. A lubricating oil composition containing less than 1000 ppm phosphorus, comprising:

A) at least 50 mass % of one or more base oil(s), based on the total mass of the lubricating oil composition;

B) one or more dispersant(s), wherein said one or more dispersant(s) comprise 2 to 10 mass %, based on the total mass of the lubricating oil composition, of one or more poly(alkenyl)succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and C) one or more detergent(s), wherein said one or more detergent(s) together provide soap to the lubricating oil composition in an amount of 0.1 to 0.9 mass %, based on the total mass of the lubricating oil composition; and P) an amide, imide, and/or ester functionalized polymer comprising a partially or fully saturated polymer backbone comprising $C_{4-5}$ olefins having:

i) an Mw/Mn of less than 2, ii) a Functionality Distribution (Fd) value of 3.5 or less, and iii) an Mn of 10,000 g/mol or more (GPC-PS) of the polymer prior to functionalization;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

49. The lubricating oil composition of item 48, wherein the lubricating oil composition is further as defined in any one of items 2 to 44.

50. A concentrate comprising or resulting from the admixing of

A) 1 to less than 50 mass % of one or more base oils, based on the total mass of the concentrate;

B) one or more dispersant(s), wherein said one or more dispersants comprise one or more unborated poly(alkenyl)succinimides, in which the polyalkenyl is derived from polyisobutylene and the imide is derived from polyamine ("PIBSA-PAM"); and C) one or more detergent(s), wherein said one or more detergents provide soap to the concentrate;

wherein said one or more detergents comprise 50 mass % or less, based on the total mass of detergent(s) present in the concentrate, of calcium salicylate;

wherein: i) the ratio of mass %, based on the total mass of the concentrate, of the one or more unborated PIBSA-PAM(s) to soap of the concentrate is 6.65 or more.

51. The concentrate of item 50 further comprising one or more additional additives selected from the group consisting of friction modifiers, antioxidants, pour point depressants, anti-foam agents, viscosity modifiers, corrosion inhibitors, anti-rust agents, antiwear agents, seal compatibility agents, extreme pressure agents, unsaturated $C_{12}$-$C_{60}$ hydrocarbons, and functionalized polymer(s).

52. The concentrate of item 50 or item 51, wherein the one or more detergent(s) are selected from the group consisting of oil-soluble neutral or overbased sulfonates, phenates, sulfurized phenates, thiophosphonates, salicylates, naphthenates, other oil-soluble carboxylates, and mixtures thereof, of an alkali or alkaline earth metal.

53. The concentrate of any one of items 50 to 52, wherein the one or more detergent(s) are selected from the group consisting of oil-soluble neutral or overbased sulfonates, salicylates, and mixtures thereof, of calcium and/or magnesium.

54. The concentrate of any one of items 50 to 53, wherein the one or more detergent(s) are selected from the group consisting of oil-soluble neutral or overbased sulfonates of calcium and/or magnesium.

55. The concentrate of any one of items 50 to 54, wherein the concentrate is absent or is substantially absent phenate detergent.

56. The concentrate of any one of items 50 to 55, wherein the one or more unborated PIBSA-PAM(s) comprise one or more unborated PIBSA-PAM(s), where the polyalkenyl is derived from polyisobutylene having a Mn of 1600 g/mol or more (GPC-PS) ("high molecular weight PIBSA-PAM") and optionally one or more unborated PIBSA-PAM(s), where the polyalkenyl is derived from polyisobutylene having a Mn of less than 1600 g/mol (GPC-PS) ("low molecular weight PIBSA-PAM").

57. The concentrate of any one of items 50 to 56, wherein the ratio of mass %, based on the total mass of the concentrate, of the one or more unborated high molecular weight PIBSA-PAM(s) to the one or more unborated low molecular weight PIBSA-PAM(s) is less than 3.65, such as less than 3.5, such as less than 3.0, such as less than 2.5, such as less than 2.0, such as less than 1.5.

58. The concentrate of any one of items 50 to 57, wherein the one or more unborated low molecular weight PIBSA-PAM(s) is not derived from tetraethylenepentamine.

59. The concentrate of any one of items 50 to 58, wherein the one or more dispersant(s) further comprise one or more borated PIBSA-PAM(s).

60. The concentrate of any one of items 50 to 59, comprising no or substantially no aromatic dispersant, such as less than 0.5 mass %, such as less than 0.2 mass %, such as less than 0.1 mass % aromatic dispersant based on the total mass of the concentrate.

61. The concentrate of any one of items 50 to 60, comprising less than 8.0 mass %, such as less than 7.0 mass %, such as less than 6 mass %, such as less than 5 mass %, such as less than 4 mass %, such as less than 3 mass %, such as less than 2 mass %, such as less than 1 mass %, based on the total mass of the concentrate, of a PIBSA ester of hydrocarbyl-bridged naphthyloxy alcohol.

62. The concentrate of any one of items 50 to 61, wherein the concentrate is absent or substantially absent PIBSA ester of hydrocarbyl-bridged naphthyloxy alcohol.

63. The concentrate of any one of items 50 to 62, wherein i) the ratio of mass %, based on the total mass of the concentrate, of the one or more unborated PIBSA-PAM(s) to soap of the lubricating oil composition is from 7.0 to 15.0, such as from 7.2 to 13.0, such as from 7.4 to 11.0, such as from 7.6 to 10.0, such as from 7.8 to 9.0, such as from 8.0 to 8.5.

64. The concentrate of any one of items 50 to 63, further comprising an amide, imide, and/or ester functionalized polymer comprising a partially or fully saturated polymer backbone comprising $C_{4-5}$ olefins having:

i) an Mw/Mn of less than 2, ii) a Functionality Distribution (Fd) value of 3.5 or less, and iii) an Mn of 10,000 g/mol or more (GPC-PS) of the polymer prior to functionalization.

65. The concentrate of item 64, wherein the polymer backbone of the functionalized polymer is derived from homo- or copolymers of partially or fully hydrogenated isoprene and butadiene.

66. The concentrate of item 64, wherein the polymer backbone of the functionalized polymer comprises at least 90% partially or fully hydrogenated isoprene repeating units.

67. The concentrate of item 64, wherein the polymer backbone of the functionalized polymer is partially or fully hydrogenated homo-polyisoprene.

68. The concentrate of item 64, wherein the polymer backbone of the functionalized polymer is partially or fully hydrogenated homo-polyisoprene having an Mn of 30,000 g/mol or more (GPC-PS).

69. The concentrate of any one of items 50 to 68, comprising no or substantially no, such as less than 0.6 mass %, such as less than 0.5 mass %, such as less than 0.4 mass %, such as less than 0.3 mass %, such as less than 0.2 mass %, such as less than 0.1 mass %, based on the total mass of the concentrate, of an amine functionalized hydrogenated isoprene polymer having an average functionality (Fv) of 7.0, a Functionality Distribution (Fd) value of 1.86, an Mw/Mn of 1.250, an Mn of 35,140 g/mol (GPC-PS), and an Mz of 55,726 g/mol (GPC-PS).

70. A lubricating oil composition comprising or resulting from the admixing of the concentrate of any one of items 50 to 69 with one or more base oils.

71. The lubricating oil composition of item 70, wherein the one or more base oil(s) comprise one or more group II and/or one or more group III base oil(s).

72. The lubricating oil composition of item 70, wherein the lubricating oil composition is as defined in any of items 1 to 49.

73. A method of lubricating an internal combustion engine during operation of the engine comprising:

(i) providing to a crankcase of the internal combustion engine the lubricating composition of any of items 1 to 49 or 70 to 72;

(ii) providing a fuel in the internal combustion engine; and (iii) combusting the fuel in the internal combustion engine.

74. The method of item 73, wherein the fuel is one or more of a hydrocarbon fuel, renewable fuel, hydrogen fuel, or any blend thereof.

75. The method of item 73, wherein the fuel is a hydrocarbon fuel.

76. The method of any one of items 73 to 75, wherein the engine is a diesel engine, such as a heavy-duty diesel engine or an automotive diesel engine.

77. The method of any one of items 73 to 75, wherein the engine is a motorcycle engine, stationary gas or diesel-powered engine, a locomotive engine, or a 4-stroke medium speed trunk piston engine.

78. A method of increasing the anti-wear capability of a lubricating oil composition containing less than 1000 ppm phosphorus, the method comprising including in the lubricating oil composition:

i) at least 50 mass % of one or more base oils, based on the total mass of the lubricating oil composition;

ii) one or more dispersants, wherein said one or more dispersants comprise 2.0 to 6.00 mass %, based on the total mass of the lubricating oil composition, of one or more poly(alkenyl) succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and iii) one or more detergents, wherein said one or more detergents together provide soap to the lubricating oil composition in an amount of 0.1 to 0.9 mass %, based on the total mass of the lubricating oil composition;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

79. A method of increasing the anti-wear capability of a lubricating oil composition containing less than 1000 ppm phosphorus, the method comprising including in the lubricating oil composition:

i) at least 50 mass % of one or more base oils, based on the total mass of the lubricating oil composition;

ii) one or more dispersants, wherein said one or more dispersants comprise 2 to 10 mass %, based on the total mass of the lubricating oil composition, of one or more poly(alkenyl)succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and iii) one or more detergents, wherein said one or more detergents together provide soap to the lubricating oil composition in an amount of 0.1 to 0.9 mass %, based on the total mass of the lubricating oil composition;

wherein said one or more detergent(s) comprise 50 mass % or less, based on the total mass of detergent(s) present in the lubricating oil composition, of calcium salicylate;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

80. The method of item 76 or item 77, wherein the anti-wear capability is increased such that the valve train rocker arm wear is less than 120 mg, such as less than 110 mg, such as less than 100 mg, such as less than 90 mg, such as less than 80 mg, such as less than 70 mg, such as less than 60 mg, such as less than 50 mg, such as less than 40 mg, as determined by the Ford 6.7 L Power Stroke Diesel Engine Test for soot induced wear and viscosity control.

81. A method of making a lubricating oil composition containing less than 1000 ppm phosphorus comprising combining:

A) at least 50 mass % of one or more base oils, based on the total mass of the lubricating oil composition;

B) one or more dispersants, wherein said one or more dispersants comprise 2.0 to 6.00 mass %, based on the total mass of the lubricating oil composition, of one or more poly(alkenyl) succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and C) one or more detergents, wherein said one or more detergents together provide soap to the lubricating oil composition in an amount of 0.1 to 0.9 mass %, based on the total mass of the lubricating oil composition;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

82. A method of making a lubricating oil composition containing less than 1000 ppm phosphorus comprising combining:

A) at least 50 mass % of one or more base oil(s), based on the total mass of the lubricating oil composition;

B) one or more dispersant(s), wherein said one or more dispersant(s) comprise 2 to 10 mass %, based on the total mass of the lubricating oil composition, of one or more poly(alkenyl)succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and C) one or more detergent(s), wherein said one or more detergent(s) together provide soap to the lubricating oil composition in an amount of 0.1 to 0.9 mass %, based on the total mass of the lubricating oil composition; and wherein said one or more detergent(s) comprise 50 mass % or less, based on the total mass of detergent(s) present in the lubricating oil composition, of calcium salicylate;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

83. A fuel composition comprising the lubricating oil composition of any of items 1 to 49 or 70 to 72 and one or more of hydrocarbon fuel (including but not limited to natural gas), renewable fuel, hydrogen fuel, or any blend thereof.

This disclosure further relates to the following:

In certain embodiment, this disclosure relates to the following items:

A1. A lubricating oil composition containing less than 1000 ppm phosphorus, comprising:

A) at least 50 mass % of one or more base oil(s), based on the total mass of the lubricating oil composition;

B) one or more dispersant(s), wherein said one or more dispersant(s) comprise 2.0 to 6.00 mass %, based on the total mass of the lubricating oil composition, of one or more poly(alkenyl) succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and C) one or more detergent(s), wherein said one or more detergent(s) together provide soap to the lubricating oil composition in an amount of 0.1 to 0.9 mass %, based on the total mass of the lubricating oil composition;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30.

A2. The lubricating oil composition of item A1, wherein:

A) the one or more base oils together are present in an amount of at least 50 mass % based on the total mass of the lubricating oil composition;

B) the one or more dispersants together are present in an amount of 2 to 15 mass % based on the total mass of the lubricating oil composition; and C) the one or more detergents together are present in an amount of 0.1 to 5 mass % based on the total mass of the lubricating oil composition; and wherein the lubricating oil composition preferably further comprises one or more additional additives selected from the group consisting of:

D) 0.01 to 5 mass %, based on the total mass of the lubricating oil composition, of one or more friction modifiers;

E) 0.01 to 10 mass %, based on the total mass of the lubricating oil composition, of one or more antioxidants;

F) 0.01 to 5 mass %, based on the total mass of the lubricating oil composition, of one or more pour point depressants;

G) 0.001 to 5 mass %, based on the total mass of the lubricating oil composition, of one or more anti-foam agents;

H) 0.001 to 10 mass %, based on the total mass of the lubricating oil composition, of one or more viscosity modifiers;

J) 0.001 to 5 mass %, based on the total mass of the lubricating oil composition, of one or more corrosion inhibitors and/or anti-rust agents;

K) 0.001 to 10 mass %, based on the total mass of the lubricating oil composition, of one or more antiwear agents;

M) 0.01 to 5 wt %, based on total weight of the lubricating oil composition, of one or more seal compatibility agents, such as seal swell agents;

N) optionally, from 0.01 to 5 mass %, based on total weight of the lubricating oil composition, of one or more extreme pressure agents, O) 0.01 to 5 mass %, based on total weight of the lubricating oil composition, of one or more unsaturated $C_{12}$-$C_{60}$ hydrocarbons, and P) 0.001 to 10 mass %, based on total weight of the lubricating oil composition, of one or more functionalized polymer(s).

A3. The lubricating oil composition of any of the preceding items A1 to A2, containing 700 ppm to 900 ppm phosphorus.

A4. The lubricating oil composition of any of the preceding items A1 to A3, comprising 50 to 95 mass %, such as 60 to 90 mass %, such as 70 to 85 mass % of one or more base oils, based on the total mass of the lubricating oil composition; wherein preferably the one or more base oil(s) comprise one or more group II base oil(s) and optionally one or more group III base oil(s).

A5. The lubricating oil composition of any of the preceding items A1 to A4, wherein the one or more detergent(s) together provide from 0.2 to 0.8 mass %, such as 0.3 to 0.7 mass %, such as 0.4 to 0.6 mass %, such as 0.45 to 0.55 mass % of soap, based on the total mass of the lubricating oil composition.

A6. The lubricating oil composition of any of the preceding items A1 to A5, wherein the one or more unborated PIBSA-PAM(s) are present in an amount of 2.5 to 5.5 mass %, such as 3.5 to 5.0 mass %, such as 4.0 to 4.5 mass %, based on the total mass of the lubricating oil composition.

A7. The lubricating oil composition of any of the preceding items A1 to A6, wherein the one or more dispersant(s) together are present in an amount of 2 to 10 mass %, such as 3 to 8 mass %, such as 4 to 6 mass %, such as 4.5 to 5.5 mass %, based on the total mass of the lubricating oil composition.

A8. A concentrate comprising or resulting from the admixing of

A) 1 to less than 50 mass % of one or more base oils, based on the total mass of the concentrate;

B) one or more dispersant(s), wherein said one or more dispersants comprise one or more unborated poly(alkenyl)succinimides, in which the polyalkenyl is derived from polyisobutylene and the imide is derived from polyamine ("PIBSA-PAM"); and C) one or more detergent(s), wherein said one or more detergents provide soap to the concentrate;

wherein said one or more detergents comprise 50 mass % or less, based on the total mass of detergent(s) present in the concentrate, of calcium salicylate;

wherein: i) the ratio of mass %, based on the total mass of the concentrate, of the one or more unborated PIBSA-PAM(s) to soap of the concentrate is 6.65 or more.

A9. The concentrate of item A8 further comprising one or more additional additives selected from the group consisting of friction modifiers, antioxidants, pour point depressants, anti-foam agents, viscosity modifiers, corrosion inhibitors, anti-rust agents, antiwear agents, seal compatibility agents, extreme pressure agents, unsaturated $C_{12}$-$C_{60}$ hydrocarbons, and functionalized polymer(s).

A10. The lubricating oil composition or the concentrate of any of the preceding items A1 to A9, wherein the one or more detergent(s) are selected from the group consisting of oil-soluble neutral or overbased sulfonates, salicylates, and mixtures thereof, of calcium and/or magnesium; preferably wherein the one or more detergent(s) are selected from the group consisting of oil-soluble overbased sulfonates of calcium and/or magnesium.

A11. The lubricating oil composition or the concentrate of any of the preceding items A1 to A10, wherein the one or more unborated PIBSA-PAM(s) comprise one or more unborated PIBSA-PAM(s), where the polyalkenyl is derived from polyisobutylene having a Mn of 1600 g/mol or more (GPC-PS) ("high molecular weight PIBSA-PAM") and optionally one or more unborated PIBSA-PAM(s), where the polyalkenyl is derived from polyisobutylene having a Mn of less than 1600 g/mol (GPC-PS) ("low molecular weight PIBSA-PAM"); wherein preferably the ratio of mass %, based on the total mass of the lubricating oil composition or the concentrate, of the one or more unborated high molecular weight PIBSA-PAM(s) to the one or more unborated low molecular weight PIBSA-PAM(s) is less than 3.65, such as less than 3.5, such as less than 3.0, such as less than 2.5, such as less than 2.0, such as less than 1.5.

A12. The lubricating oil composition or the concentrate of any of the preceding items A1 to A11, wherein the one or more dispersant(s) further comprise one or more borated PIBSA-PAM(s).

A13. The lubricating oil composition or the concentrate of any of the preceding items A1 to A12, wherein i) the ratio of mass %, based on the total mass of the lubricating oil composition or the concentrate, of the one or more unborated PIBSA-PAM(s) to soap of the lubricating oil composition is from 7.0 to 15.0, such as from 7.2 to 13.0, such as from 7.4 to 11.0, such as from 7.6 to 10.0, such as from 7.8 to 9.0, such as from 8.0 to 8.5.

A14. The lubricating oil composition or the concentrate of any of the preceding items A1 to A13, further comprising an amide, imide, and/or ester functionalized polymer comprising a partially or fully saturated polymer backbone comprising $C_{4-5}$ olefins having:

i) an Mw/Mn of less than 2, ii) a Functionality Distribution (Fd) value of 3.5 or less, and iii) an Mn of 10,000 g/mol or more (GPC-PS) of the polymer prior to functionalization.

A15. A lubricating oil composition comprising or resulting from the admixing of the concentrate of any of items A8 to A14 with one or more base oils.

A16. A method of lubricating an internal combustion engine during operation of the engine comprising:

(i) providing to a crankcase of the internal combustion engine the lubricating composition of any of items A1 to A12 or A15;

(ii) providing a fuel in the internal combustion engine; and (iii) combusting the fuel in the internal combustion engine.

A17. A method of increasing the anti-wear capability of a lubricating oil composition containing less than 1000 ppm phosphorus, the method comprising including in the lubricating oil composition:

i) at least 50 mass % of one or more base oils, based on the total mass of the lubricating oil composition;

ii) one or more dispersants, wherein said one or more dispersants comprise 2.0 to 6.00 mass %, based on the total mass of the lubricating oil composition, of one or more poly(alkenyl) succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and iii) one or more detergents, wherein said one or more detergents together provide soap to the lubricating oil composition in an amount of 0.1 to 0.9 mass %, based on the total mass of the lubricating oil composition;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30;

wherein preferably the anti-wear capability is increased such that the valve train rocker arm wear is less than 120 mg, such as less than 110 mg, such as less than 100 mg, such as less than 90 mg, such as less than 80 mg, such as less than 70 mg, such as less than 60 mg, such as less than 50 mg, such as less than 40 mg, as determined by the Ford 6.7 L Power Stroke Diesel Engine Test for soot induced wear and viscosity control.

A18. A fuel composition comprising the lubricating oil composition of any of items A1 to A12 or A15 and one or more of hydrocarbon fuel, renewable fuel, hydrogen fuel, or any blend thereof.

The following non-limiting examples are provided to illustrate the disclosure.

EXPERIMENTAL

All molecular weights are number average molecular weights (Mn) reported in g/mol, as determined by gel permeation chromatography using polystyrene standards, unless otherwise noted. "A.I.", "ai", "a.i.", and "ai" are wt % active ingredient, unless otherwise indicated.

Testing Procedures

Viscosity index is measured according to ASTM D2270.

High Temperature High Shear Viscosity, ("HTHS" or "HTHS150") is determined at 150° C. according to ASTM D4683 and is reported in cPs.

KV100 is Kinematic viscosity measured at 100° C. according to ASTM D445-19a.

Cold Cranking Simulator ("CCS"), at −25° C. unless otherwise indicated, is a measure of the cold-cranking characteristics of crankcase lubricants and is determined as described in ASTM D5293-92.

Phosphorus, Boron, Calcium, Zinc, Molybdenum, and Magnesium content are measured by ASTM D5185.

Sulfated ash ("SASH") content is measured by ASTM D874.

Ford 6.7 L Power Stroke Diesel Engine Test for soot induced wear and viscosity control was conducted in a 6.7 L Power Stroke Diesel engine. The test was 200 hours with the peak power 2800 rpm/WOT. Samples were taken every 25 hours for soot measurement according to ASTM D5967, TGA. Soot level is typically in the range between 5.5 to 6.5% at the end of the test. After the test is completed the rocker arms were dissembled and weighed and compared to the weights before the tests to determine the weight loss. KV100 of the oil sample was also measured every 25 hours to determine the viscosity of the oil.

The moments of molecular weight (Mw, Mn, Mz) were determined by Gel Permeation Chromatography ("GPC-PS") using polystyrene standards (Acquity™ APC Polystyrene High MW Calibration Kit, 266-1,760,000 Da) and the software provided by the vendor (Empower™ 3, version 7.41.00.00) as follows. Molecular weights [number average molecular weight (Mn), weight average molecular weight (Mw), and z-average molecular weight (Mz)] are determined using an Agilent Acuity P-SM-FTN and P-15m high temperature GPC-SEC (gel permeation/size exclusion chromatograph) equipped with an on-line differential refractive index (DRI) detector and a PDA UV detector for 215,254 and 304 wavelengths. The GPC uses 3 Agilent PLgel 10 micron Mixed B LS columns. The column separation is performed using a flow rate of 0.25 mL/min and a nominal injection volume of 10 microliters. The detectors and columns are maintained at 30° C. when in low flow mode(idle) and heated up to 35° C. when preparing to run samples. The stream emerging from the SEC columns is directed into the optical flow cell and then into the DRI detector. Solvent for the SEC experiment is un-inhibited THF (tetrahydrofuran). Polymer solutions are prepared by placing dry polymer in a glass container, adding the desired amount of THF. Once the sample is added to machine it is given time to reach 35° C. before the run begins. The GPC runs a pre-run programmed equilibrium of approx 1.5 hours. Samples are agitated for 2 to 15 hours depending on solubility. Samples are filtered after the agitation and before being run. All quantities are measured gravimetrically. The THF densities used to express the polymer concentration in mass/volume units are 0.887 g/mL at 68° C. The injection sample concentration is 3 mg/mL. Prior to running each sample, the DRI detector and the injector are purged. Flow rate in the apparatus is then increased from 0.01 to 0.25 mL/minute, and the DRI is allowed to stabilize for 4 to 5 hours before injecting the first sample. Software used to run the GPC and prepare reports is Empower™ 3, version 7.41.00.00.

Materials

F-H-PI is 7.0-F-H-Polyisoprene-A. Amine functionalized hydrogenated isoprene polymer having an average functionality (Fv) of 7.0 was prepared using SA-H-Polyisoprene-A (succinate functionality of 7.0) by adding one equivalent of amine (4-amino-diphenylamine, ADPA) per succinate unit (as determined by SAP, ASTM D94) at 170° C. under nitrogen. The reaction is allowed to continue and heat soak for up to two hours, after which it is diluted with additional oil (Group III, 4 cSt (Yubase™ 4) and allowed to cool to ambient temperature. During cooling the material is combined with ethoxylated alcohol (such as Berol™ 1214 or Surfonic™ L24-4, Huntsman) at 10 wt % of reaction mixture. The 7.15-F-H-Polyisoprene-A had a Functionality Distribution (Fd) value of 1.76, an Mw/Mn of 1.239, an Mn of 31629 g/mol, an Mz of 47835 g/mol, and was used as a blend in oil with an ai of 0.5 wt %, unless otherwise indicated.

PIB is polyisobutylene.

PaBSA is polyisobutylene succinic anhydride.

PSBSA-PAM is polyisobutylene succinic anhydride-polyalkylene amine.

Component Chart Component Chart above). This means for example that the active ingredient content of the PIBSA-PAM 2200 Mn in Oil

| Lubricating Oil Components | Description |
|---|---|
| F-H-PI (1) | Functionalised hydrogenated polyisoprene in oil, ai ~40%, having an Fv of about 7, an Fd of about 1.9, an Mw/Mn of about 1.2 and an Mn of about 35,140 g/mol (GPC-PS) produced according to methods similar to those described in U.S. Ser. No. 18/480,571 filed Oct. 4, 2023 and U.S. Ser. No. 63/379,006, filed Oct. 11, 2022 |
| F-H-PI (2) | Functionalised hydrogenated polyisoprene in oil, ai ~27.7%, having an Fv of about 7, an Fd of about 1.9, an Mw/Mn of about 1.2 and an Mn of about 35,140 g/mol (GPC-PS) produced according to methods similar to those described in U.S. Ser. No. 18/480,571 filed Oct. 4, 2023 and U.S. Ser. No. 63/379,006, filed Oct. 11, 2022 |
| Borated PIBSA-PAM | Polyisobutylene succinimide having 1 to 3 mass % boron, based upon a PIB having an Mn of about 950 g/mol in oil, ai ~45% |
| PIBSA-PAM 950 Mn | Polyisobutylene succinimide based upon a PIB having an Mn of about 950 g/mol in oil, ai ~51% |
| PIBSA-PAM 2200 Mn | Polyisobutylene succinimide based upon a PIB having an Mn of about 2200 g/mol in oil, ai ~55% |
| Calcium sulfonate | Calcium sulfonate detergent having a TBN of approximately 300 mgKOH/g, in oil, ai ~55%, soap of 29 mass %, |
| Magnesium sulfonate | Magnesium sulfonate detergent having a TBN of approximately 400 mgKOH/g in oil, ai ~57%, soap of 26 mass % |
| ZDDP | Zinc dialkyl dithiophosphate in oil, where the alkyl groups are derived from a mixture of 1° and 2° alcohols, ai ~75% |
| Mo Friction modifier | Trimeric Mo dialkyldithiocarbamate compound in oil, ~45% ai |
| DPA antioxidant | Alkylated diphenylamine antioxidant, 100% ai |
| Sulphurised alkyl methyl ester | Sulphurised methyl ester, active sulfur = 3.2% |
| Corrosion inhibitor | Berol ™ 1214 - nonionic fatty alcohol ethoxylate surfactant |
| Anti-foamant | Polydimethylsiloxane |
| PIBSA | Polyisobutylene succinate having an Mn of about 950 g/mol in oil, ai ~72% |
| PIB | Polyisobutylene having an Mn of about 950 g/mol |
| Diluent | Group I base oil diluent |
| Lube oil flow improver (LOFI) | $C_{12-18}$ dialkylfumarate/vinyl acetate copolymer, ai ~50%, available as Infineum V387 ™ from Infineum USA LP, Linden NJ, USA |
| Viscosity modifier (1) | Semi-crystalline olefin copolymer viscosity modifier, 20 SSI. ai = 11.4% |
| Viscosity modifier (2) | Semi-crystalline Olefin copolymer viscosity modifier, 25 SSI. ai = 10.15% |
| Viscosity modifier (3) | Amorphous olefin copolymer viscosity modifier, 25 SSI. ai = 13% |
| Group II 4.5 cSt base oil | Lubricating oil basestock having a $KV_{100}$ of about 4.4-4.7 cSt available as ExxonMobil EHC ™ 45 from ExxonMobil Lubricants & Petroleum Specialties Company, Spring TX, USA |
| Group II 6.5 cSt base oil | Lubricating oil basestock having a $KV_{100}$ of about 6.3-6.6 cSt available as ExxonMobil EHC ™ 65 from ExxonMobil Lubricants & Petroleum Specialties Company, Spring TX, USA |

In the following tables of the Examples, the amounts indicated for the individual materials refer to the amounts of the components (which contain a certain amount of active ingredient in oil, as indicated in the Component Chart above). For example, the component PIBSA-PAM 2200 Mn has an active ingredient (a.i.) content of about 55 wt %, the remainder of the component being diluent oil (see the A (see Table 1 below, indicating a content of 4.0 mass % of the PIBSA-PAM 2200 Mn component) is 2.2 mass % (i.e., 4.0 mass %×0.55). Likewise, the active ingredient content of the unborated PIBSA-PAMs in Oil A (indicating a content of 4.0 mass % of the PIBSA-PAM 2200 Mn component and a content of 4.0 mass % of the PIBSA-PAM 950 Mn component) is 4.24 mass % (i.e., 4.0 mass %×0.55+4.0 mass %×0.51). Further, the soap of Oil A is obtained by adding the soap mass % provided by each detergent, i.e, 1.0 mass %×29 mass %+0.85 mass %×26 mass %=0.511 mass %. In this OIL A, the ratio of the unborated PIBSA-PAMs to soap is thus 4.24 mass %/0.511 mass %=8.30. The ratio of the unborated PIBSA-PAMs to soap of the other oils can be calculated analogously, based on the mass % of the respective components indicated in the example tables below and using the active ingredient content as indicated for the respective component in the Component Chart above.

EXAMPLES

Example 1: Ford 6.7 L Power Stroke Diesel Engine Test for Soot Induced Wear and Viscosity Control Oil A and B, as well as Comparative Oils C1 and C2 were prepared as indicated in Table 1.1 below and tested for soot induced wear and viscosity control in the Ford 6.7 L Power Stroke Diesel Engine Test described above.

Table 1.1

| | Oil A mass % | Oil B mass % | Oil C1 (comperative) mass % | Oil C2 (comperative) mass % |
|---|---|---|---|---|
| | Component** | | | |
| PIBSA-PAM 2200 Mn | 4.000 | 4.000 | 2.000 | 2.000 |
| PIBSA-PAM 950 Mn | 4.000 | 4.000 | 4.000 | 4.000 |
| Borated PIBSA-PAM | 0.500 | 0.500 | 0.500 | 3.000 |
| F-H-PI (1) | 1.560 | 1.560 | — | — |
| F-H-PI (2) | — | — | 2.200 | 2.200 |
| Mo Friction modifier | 0.120 | — | 0.120 | 0.120 |
| Viscosity modifier (1) | — | 0.400 | — | — |
| Viscosity modifier (2) | 0.400 | — | — | — |
| Viscosity modifier (3) | — | — | 1.800 | 1.200 |
| Group II 4.5-6 cSt base oil | 80.100 | 79.320 | 80.060 | 78.160 |
| | Properties | | | |
| SAE viscosity grade | 10W-30 | 10W-30 | 10W-30 | 10W-30 |
| HTHS150 (cP) | 3.2 | 3.1 | 3.0 | 3.0 |
| $KV_{100}$ | 9.9 | 9.7 | 10.1 | 9.8 |
| CCS at −25° C. | 5780 | 5990 | 5570 | 5780 |
| Phosphorus ppm | 800 | 800 | 800 | 800 |
| Calcium mass % | 0.12 | 0.12 | 0.12 | 0.12 |
| Magnesium mass % | 0.08 | 0.08 | 0.08 | 0.08 |
| Molybdenum ppm | 66 | — | 66 | 66 |
| SASH mass % | 0.85 | 0.85 | 0.85 | 0.86 |
| Soap mass % | 0.511 | 0.511 | 0.511 | 0.511 |
| PIBSA PAM (a.i.) mass % | 4.465 | 4.465 | 3.365 | 4.490 |
| Unborated PIBSA PAM (a.i.) | 4.240 | 4.240 | 3.140 | 3.140 |
| Mass % PIBSA PAM (a.i.) to Soap | 8.74 | 8.74 | 6.59 | 8.79 |
| Mass % unborated PIBSA PAM (a.i.) to Soap | 8.30 | 8.30 | 6.145 | 6.145 |
| Valve train rocker arm loss (mg), Ford 6.7 L Power Stroke Diesel Engine Test | 32/37/39/40* | 39 | 212 | 139 |

*results of 4 tests of Oil A,

**the formulations had the same amount of calcium and magnesium sulfonate, ZDDP, DPA antioxidant, sulfurized fatty acid methyl ester, anti-foamant, corrosion inhibitor, PIB, PIBSA, LOFI, diluent from adpak.

Oil A and Oil B are characterized by a higher ratio of unborated PIBSA-PAM to soap of the lubricating oil composition compared to comparative Oil C1 and comparative Oil C2. Oil A and Oil B show a drastic improvement in anti-wear properties providing a valve train rocker arm loss of only 37 mg and 39 mg, respectively. Further, Oil A and Oil B clearly pass the Ford 6.7 L Power Stroke Diesel Engine Test (pass criterium: <100 mg rocker arm mass loss) while only having 800 ppm phosphorus.

All documents described herein are incorporated by reference herein, including any priority documents and/or testing procedures, to the extent they are not inconsistent with this text. As is apparent from the foregoing general description and the specific embodiments, while forms of the invention have been illustrated and described, various modifications can be made without departing from the spirit and scope of the invention. Accordingly, it is not intended that the invention be limited thereby. The term "comprising" is considered synonymous with the term "including." Likewise, whenever a composition, an element, or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

What is claimed is:

1. A lubricating oil composition containing less than 1000 ppm phosphorus, comprising:

A) at least 50 mass % of one or more base oil(s), based on the total mass of the lubricating oil composition;

B) one or more dispersant(s), wherein said one or more dispersant(s) comprise 2.0 to 6.00 mass %, based on the total mass of the lubricating oil composition, of one or more poly(alkenyl) succinimides, in which the polyalkenyl is derived from polyisobutylene and the imide is derived from polyamine ("PIBSA-PAM");

wherein the one or more poly(alkenyl)succinimides (PIBSA-PAM(s)) comprise at least 2.0 mass %, based on the total mass of the lubricating oil composition, of one or more unborated poly(alkenyl) succinimides (PIBSA-PAM(s));

C) one or more detergent(s), wherein said one or more detergent(s) together provide soap to the lubricating oil composition in an amount of 0.1 to 0.9 mass %, based on the total mass of the lubricating oil composition; and D) a functionalized polymer at from 0.1 to 10 mass % based upon the total mass of the lubricating oil composition, wherein the functionalized polymer comprises an amide or imide functionalized partially or fully saturated homo-polyisoprene, having:

i) an Mn of 10,000 g/mol or more (GPC-PS) of the polymer prior to functionalization, ii) where the functional group is derived from an acylating agent and a compound containing amino and/or hydroxyl groups (including but not limited to where the polymer is functionalized with an acylating agent and subsequently reacted with a compound containing amino and/or hydroxyl groups), and, iii) an Mw/Mn of less than 2, iv) a Functionality Distribution (Fd) value of 3.5 or less, and v) an average functionality (Fv) of 5 to 20 functional group grafts/polymer chain;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30, wherein the mass ratio of the one or more unborated PIBSA-PAM to the soap of the one or more detergents is greater than or equal to 8.30.

2. The lubricating oil composition of claim 1, wherein:

A) the one or more base oils together are present in an amount of at least 50 mass % based on the total mass of the lubricating oil composition;

B) the one or more dispersants together are present in an amount of 2 to 15 mass % based on the total mass of the lubricating oil composition; and C) the one or more detergents together are present in an amount of 0.1 to 5 mass % based on the total mass of the lubricating oil composition.

3. The lubricating oil composition of claim 1, further comprising one or more additional additives selected from the group consisting of:

D) 0.01 to 5 mass %, based on the total mass of the lubricating oil composition, of one or more friction modifiers;

E) 0.01 to 10 mass %, based on the total mass of the lubricating oil composition, of one or more antioxidants;

F) 0.01 to 5 mass %, based on the total mass of the lubricating oil composition, of one or more pour point depressants;

G) 0.001 to 5 mass %, based on the total mass of the lubricating oil composition, of one or more anti-foam agents;

H) 0.001 to 13 mass %, based on the total mass of the lubricating oil composition, of one or more viscosity modifiers;

J) 0.001 to 5 mass %, based on the total mass of the lubricating oil composition, of one or more corrosion inhibitors and/or anti-rust agents;

K) 0.001 to 10 mass %, based on the total mass of the lubricating oil composition, of one or more antiwear agents;

M) 0.01 to 5 mass %, based on total weight of the lubricating oil composition, of one or more seal compatibility agents, such as seal swell agents;

N) optionally, from 0.01 to 5 mass %, based on total weight of the lubricating oil composition, of one or more extreme pressure agents, and O) 0.01 to 5 mass %, based on total weight of the lubricating oil composition, of one or more unsaturated $C_{12}$-$C_{60}$ hydrocarbons.

4. The lubricating oil composition of claim 1, containing 700 ppm to 900 ppm phosphorus.

5. The lubricating oil composition of claim 1, wherein the one or more base oil(s) comprise at least 50 mass % of a group II base oil based on the total mass of base oil(s) present in the lubricating oil composition.

6. The lubricating oil composition of claim 1, wherein the one or more detergent(s) are selected from the group consisting of oil-soluble neutral or overbased sulfonates, salicylates, and mixtures thereof, of calcium and/or magnesium.

7. The lubricating oil composition of claim 1, wherein the one or more detergent(s) comprise 50 mass % or less, based on the total mass of detergent(s) present in the lubricating oil composition, of calcium salicylate.

8. The lubricating oil composition of claim 1, wherein the one or more detergent(s) are selected from the group consisting of oil-soluble overbased sulfonates of calcium and/or magnesium.

9. The lubricating oil composition of claim 1, wherein the lubricating oil composition is absent or is substantially absent phenate detergent.

10. The lubricating oil composition of claim 1, wherein the one or more detergent(s) together are present in an amount of 0.1 to 4 mass %, based on the total mass of the lubricating oil composition and optionally wherein the one or more detergent(s) together provide less than 0.8 mass % of soap, based on the total mass of the lubricating oil composition.

11. The lubricating oil composition of claim 1, wherein the one or more unborated PIBSA-PAM(s) are present in an amount of 2.5 to 5.5 mass %, based on the total mass of the lubricating oil composition, and wherein the one or more unborated PIBSA-PAM(s) comprise: 1) one or more unborated PIBSA-PAM(s) where the polyalkenyl of the PIBSA-PAM is derived from polyisobutylene having a Mn of 1600 g/mol or more (GPC-PS) ("high molecular weight PIBSA-PAM") and 2) optionally one or more unborated PIBSA-PAM(s), where the polyalkenyl of the PIBSA-PAM is derived from polyisobutylene having a Mn of less than 1600 g/mol (GPC-PS) ("low molecular weight PIBSA-PAM".

12. The lubricating oil composition of claim 11, wherein the one or more unborated PIBSA-PAM(s) comprise one or more unborated high molecular weight PIBSA-PAM(s) in an amount of 0.5 to 4 mass %, based on the total mass of the lubricating oil composition, and one or more unborated low molecular weight PIBSA-PAM(s) in an amount of 0.5 to 4 mass %, based on the total mass of the lubricating oil composition.

13. The lubricating oil composition of claim 12, wherein the ratio of mass %, based on the total mass of the lubricating oil composition, of the one or more unborated high molecular weight PIBSA-PAM(s) to the one or more unborated low molecular weight PIBSA-PAM(s) is less than 3.65.

14. The lubricating oil composition of claim 1, wherein the one or more unborated low molecular weight PIBSA-PAM(s) is not derived from tetraethylenepentamine.

15. The lubricating oil composition of claim 1, wherein the one or more dispersant(s) further comprise one or more borated PIBSA-PAM(s), wherein the one or more borated PIBSA-PAM(s) are present in an amount of 0.05-0.5 mass %, based on the total mass of the lubricating oil composition.

16. The lubricating oil composition of claim 1, wherein the one or more dispersant(s) together are present in an amount of 2 to 10 mass %, based on the total mass of the lubricating oil composition.

17. The lubricating oil composition of claim 1, comprising no or substantially no aromatic dispersant, based on the total mass of the lubricant oil composition.

18. The lubricating oil composition of claim 1, comprising no or substantially no PIBSA ester of hydrocarbyl-bridged naphthyloxy alcohol, based on the total mass of the lubricant oil composition.

19. The lubricating oil composition of claim 1, wherein i) the ratio of mass %, based on the total mass of the lubricating oil composition, of the one or more unborated PIBSA-PAM(s) to soap of the lubricating oil composition is from 7.0 to 15.0.

20. The lubricating oil composition of claim 1, wherein ii) the lubricating oil composition has an SAE viscosity grade of 15W-40, 5W-30, or 10W-30.

21. The lubricating oil composition of claim 1, wherein the lubricating oil composition provides a valve train rocker arm wear of less than 120 mg, as determined by the Ford 6.7 L Power Stroke Diesel Engine Test for soot induced wear and viscosity control.

22. The lubricating oil composition of claim 1, wherein the lubricating oil composition comprises one or more compounds comprising molybdenum (Mo), wherein said one or more compounds comprising Mo together provide at least 50 ppm Mo to the lubricating oil composition.

23. The lubricating oil composition of claim 1, comprising no or substantially no molybdenum (Mo).

24. A lubricating oil composition containing less than 1000 ppm phosphorus, comprising:

A) at least 50 mass % of one or more base oil(s), based on the total mass of the lubricating oil composition;

B) one or more dispersant(s), wherein said one or more dispersant(s) comprise 2 to 10 mass %, based on the total mass of the lubricating oil composition, of one or more poly(alkenyl)succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s);

C) one or more detergent(s), wherein said one or more detergent(s) together provide soap to the lubricating oil composition in an amount of 0.1 to 0.9 mass %, based on the total mass of the lubricating oil composition; and wherein said one or more detergent(s) comprise 50 mass % or less, based on the total mass of detergent (s) present in the lubricating oil composition, of calcium salicylate; and D) a functionalized polymer at from 0.1 to 10 mass % based upon the total mass of the lubricating oil composition, wherein the functionalized polymer comprises an amide or imide functionalized partially or fully saturated homo-polyisoprene, having:

i) an Mn of 10,000 g/mol or more (GPC-PS) of the polymer prior to functionalization, ii) where the functional group is derived from an acylating agent and a compound containing amino and/or hydroxyl groups (including but not limited to where the polymer is functionalized with an acylating agent and subsequently reacted with a compound containing amino and/or hydroxyl groups), and, iii) an Mw/Mn of less than 2, iv) a Functionality Distribution (Fd) value of 3.5 or less, and v) an average functionality (Fv) of 5 to 20 functional group grafts/polymer chain;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30, wherein the mass ratio of the one or more unborated PIBSA-PAM to the soap of the one or more detergents is greater than or equal to 8.30.

25. The lubricating oil composition of claim 24, wherein the one or more PIBSA-PAM(s) are present in an amount of 2.5 to 10 mass %, based on the total mass of the lubricating composition.

26. A lubricating oil composition containing less than 1000 ppm phosphorus, comprising:

A) at least 50 mass % of one or more base oil(s), based on the total mass of the lubricating oil composition;

B) one or more dispersant(s), wherein said one or more dispersant(s) comprise 2 to 10 mass %, based on the total mass of the lubricating oil composition, of one or more poly(alkenyl)succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s); and C) one or more detergent(s), wherein said one or more detergent(s) together provide soap to the lubricating oil composition in an amount of 0.1 to 0.9 mass %, based on the total mass of the lubricating oil composition; and D) an amide, imide, and/or ester functionalized polymer comprising a partially or fully saturated homo-polyisoprene having:

i) an Mw/Mn of less than 2, ii) a Functionality Distribution (Fd) value of 3.5 or less, and iii) an Mn of 10,000 g/mol or more (GPC-PS) of the polymer prior to functionalization; and iv) an average functionality (Fv) of 5 to 20 functional group grafts/polymer chain;

wherein: i) the ratio of mass %, based on the total mass of the lubricating oil composition, of the one or more unborated PIBSA-PAM(s) to soap of the lubricating oil composition is 6.65 or more, and ii) the lubricating oil composition has an SAE viscosity grade of 20W-X, 15W-X, 10W-X, or 5W-X, where X represents any one of 8, 12, 16, 20, 30, and 40, such as 30 or 40, such as 30, wherein the mass ratio of the one or more unborated PIBSA-PAM to the soap of the one or more detergents is greater than or equal to 8.30.

27. A method of lubricating an internal combustion engine during operation of the engine comprising:

(i) providing to a crankcase of the internal combustion engine the lubricating composition of claim 1;

(ii) providing a fuel in the internal combustion engine; and (iii) combusting the fuel in the internal combustion engine.

28. A method of increasing the anti-wear capability of a lubricating oil composition containing less than 1000 ppm phosphorus, the method comprising including in the lubricating oil composition:

i) at least 50 mass % of one or more base oils, based on the total mass of the lubricating oil composition;

ii) one or more dispersants, wherein said one or more dispersants comprise 2.0 to 6.00 mass %, based on the total mass of the lubricating oil composition, of one or more poly(alkenyl) succinimides, in which the polyalkenyl is derived from polyisobutylene and the imide is derived from polyamine ("PIBSA-PAM");

wherein the one or more PIBSA-PAM(s) comprise at least 2.0 mass % of one or more unborated PIBSA-PAM(s);

iii) one or more detergents, wherein said one or more detergents together provide soap to the lubricating oil composition in an amount of 0.1 to 0.9 mass %, based on the total mass of the lubricating oil composition; and iv) an amide, imide, and/or ester functionalized polymer comprising a partially or fully saturated homo-polyisoprene having:

i) an Mw/Mn of less than 2, ii) a Functionality Distribution (Fd) value of 3.5 or less, and iii) an Mn of 10,000 g/mol or more (GPC-PS) of the polymer prior to functionalization; and iv) an average functionality (Fv) of 5 to 20 functional group grafts/polymer chain;

wherein: a) the ratio of mass %, based on the total mass of the lubricating oil composition, of the one or more unborated PIBSA-PAM(s) to soap of the lubricating oil composition is 6.65 or more, and b) the lubricating oil composition has an SAE viscosity grade of 20W-X, 15W-X, 10W-X, or 5W-X, where X represents any one of 8, 12, 16, 20, 30, and 40, such as 30 or 40, such as 30, wherein the mass ratio of the one or more unborated PIBSA-PAM to the soap of the one or more detergents is greater than or equal to 8.30.

29. A method of increasing the anti-wear capability of a lubricating oil composition containing less than 1000 ppm phosphorus, the method comprising including in the lubricating oil composition:

i) at least 50 mass % of one or more base oils, based on the total mass of the lubricating oil composition;

ii) one or more dispersants, wherein said one or more dispersants comprise 2 to 10 mass %, based on the total mass of the lubricating oil composition, of one or more poly(alkenyl)succinimides, in which the polyalkenyl is derived from polyisobutylene and the imide is derived from polyamine ("PIBSA-PAM");

wherein the one or more PIBSA-PAM(s) comprise at least 2.0 mass %, based on the total mass of the lubricating oil composition, of one or more unborated PIBSA-PAM(s);

iii) one or more detergents, wherein said one or more detergents together provide soap to the lubricating oil composition in an amount of 0.1 to 0.9 mass %, based on the total mass of the lubricating oil composition;

wherein said one or more detergent(s) comprise 50 mass % or less, based on the total mass of detergent (s) present in the lubricating oil composition, of calcium salicylate; and iv) an amide, imide, and/or ester functionalized polymer comprising a partially or fully saturated homo-polyisoprene having:

i) an Mw/Mn of less than 2, ii) a Functionality Distribution (Fd) value of 3.5 or less, and iii) an Mn of 10,000 g/mol or more (GPC-PS) of the polymer prior to functionalization; and iv) an average functionality (Fv) of 5 to 20 functional group grafts/polymer chain;

wherein: i) the ratio of mass %, based on the total mass of the lubricating oil composition, of the one or more unborated PIBSA-PAM(s) to soap of the lubricating oil composition is 6.65 or more, ii) the lubricating oil composition has an SAE viscosity grade of 20W-X, 15W-X, 10W-X, or 5W-X, where X represents any one of 8, 12, 16, 20, 30, and 40, such as 30 or 40, and iii) optionally wherein the anti-wear capability of the lubricating oil composition is increased such that the valve train rocker arm wear is less than 120 mg, as determined by the Ford 6.7 L Power Stroke Diesel Engine Test for soot induced wear and viscosity control, wherein the mass ratio of the one or more unborated PIBSA-PAM to the soap of the one or more detergents is greater than or equal to 8.30.

30. A fuel composition comprising the lubricating oil composition of claim 1 and one or more of hydrocarbon fuel, renewable fuel, hydrogen fuel, natural gas, or any blend thereof.

31. The lubricating oil composition of claim 1, further including one or more friction modifiers comprising a molybdenum amine complex.

* * * * *